US006491085B1

(12) United States Patent
Anthony et al.

(10) Patent No.: US 6,491,085 B1
(45) Date of Patent: Dec. 10, 2002

(54) CONTROL AND SUSPENSION SYSTEM FOR A VERTICAL VANE COVERING FOR ARCHITECTURAL OPENINGS

(75) Inventors: James M. Anthony, Denver, CO (US); Wendell B. Colson, Weston, MA (US); David G. Mateer, Niwot, CO (US); Larry J. Delliman, Englewood, CO (US); Richard N. Anderson, Whitesville, KY (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 0 days.

(21) Appl. No.: 09/525,613

(22) Filed: Mar. 14, 2000

Related U.S. Application Data

(63) Continuation-in-part of application No. 09/007,576, filed on Jan. 15, 1998, now Pat. No. 6,076,588, which is a division of application No. 08/639,905, filed on Apr. 24, 1996, now Pat. No. 5,819,833, and a continuation-in-part of application No. 08/472,992, filed on Jun. 7, 1995, now Pat. No. 5,626,177.

(51) Int. Cl.[7] ..... E06B 9/30

(52) U.S. Cl. ..... 160/168.1 V; 160/173 V; 160/178.1 V

(58) Field of Search ..... 160/168.1 R, 168.1 V, 160/172 R, 172 V, 173 R, 173 V, 174 R, 174 V, 176.1 R, 176.1 V, 177 R, 178.1 R, 178.1 V

(56) References Cited

U.S. PATENT DOCUMENTS

| | | | | |
|---|---|---|---|---|
| 1,820,328 | A | 8/1931 | Schlegel | 16/122 |
| 2,164,206 | A | 6/1939 | Gits et al. | 16/122 |
| 2,621,723 | A | 12/1952 | Etten | 160/34 |
| 2,660,751 | A | 12/1953 | Falkenberg | 16/122 |
| 2,759,534 | A | 8/1956 | Harju | 160/168 |
| 2,854,071 | A | 9/1958 | Toti | 160/176 |
| 2,876,834 | A | 3/1959 | Walker | 160/168 |

(List continued on next page.)

FOREIGN PATENT DOCUMENTS

| | | |
|---|---|---|
| EP | 120425 | 10/1984 |
| EP | 159812 | 10/1985 |
| EP | 446587 | 9/1991 |
| GB | 868961 | 5/1961 |
| GB | 1159635 | 7/1969 |
| GB | 1470533 | 4/1977 |
| GB | 2171441 | 8/1986 |
| GB | 2247488 | 3/1992 |

*Primary Examiner*—Bruce A. Lev
(74) *Attorney, Agent, or Firm*—Dorsey & Whitney LLP

(57) ABSTRACT

A control system for a vertical vane covering for use in an architectural opening includes a headrail having an upwardly opening channel in which a plurality of carriers are disposed for sliding movement along the length of the headrail. The headrail is of a thin profile with only a minority portion of the carriers being positioned within the hollow interior of the headrail. The carriers are interconnected by a scissors-type linkage to effect uniform separation of the vanes when the covering is expanded across an architectural opening, and each carrier includes a rack and pinion system or a meshing gear system for rotating the vanes suspended thereby. Unique mountings for the endmost vanes allow the endmost vanes to cover the ends of the headrail. Rotation of a tilt wand or translation of a tilt cord results in rotation of a tilt rod via a pair of drive gears or a positive-grip pulley. Rotation of the tilt rod activates the rack and pinion system or the meshing gear system.

109 Claims, 61 Drawing Sheets

U.S. PATENT DOCUMENTS

| | | | | | |
|---|---|---|---|---|---|
| 3,334,682 | A | | 8/1967 | Eldredge, Jr. | 160/178 |
| 3,486,549 | A | | 12/1969 | Rosenquist | 160/183 |
| D231,326 | S | | 4/1974 | Miki | D8/9 |
| 3,996,988 | A | | 12/1976 | De Witt | 160/168 R |
| 4,214,622 | A | | 7/1980 | Debs | 160/168 A |
| 4,267,875 | A | | 5/1981 | Koks | 160/176 R |
| 4,293,021 | A | | 10/1981 | Arena | 160/178 R |
| 4,316,493 | A | | 2/1982 | Arena | 160/168 R |
| 4,361,179 | A | | 11/1982 | Benthin | 160/176 R |
| 4,366,852 | A | | 1/1983 | Holzer | 160/320 |
| 4,381,029 | A | | 4/1983 | Ford et al. | 160/172 |
| 4,386,644 | A | | 6/1983 | Debs | 160/174 |
| 4,425,955 | A | | 1/1984 | Kaucic | 160/168 R |
| 4,557,309 | A | * | 12/1985 | Judkins | 160/84 R |
| 4,628,981 | A | | 12/1986 | Ciriaci et al. | 160/176 R |
| 4,646,808 | A | * | 3/1987 | Anderson | 160/178 C |
| 4,648,436 | A | | 3/1987 | Oskam | 160/168 R |
| 4,662,422 | A | * | 5/1987 | Anderson | 160/168 R |
| 4,724,883 | A | | 2/1988 | Liebowitz | 160/84 R |
| 4,773,464 | A | | 9/1988 | Kobayashi | 160/168.1 |
| 4,799,527 | A | | 1/1989 | Volloch et al. | 160/168.1 |
| 4,802,522 | A | * | 2/1989 | Anderson | 160/168.1 |
| 4,834,162 | A | * | 5/1989 | John | 160/168.1 |
| 4,834,163 | A | | 5/1989 | Dickstein | 160/176.1 |
| 4,869,309 | A | | 9/1989 | Evans | 160/177 |
| 4,909,298 | A | | 3/1990 | Langhart et al. | 160/178.1 |
| 5,012,850 | A | | 5/1991 | Schrader | 160/38 |
| 5,088,542 | A | | 2/1992 | Biba et al. | 160/168.1 |
| D325,681 | S | | 4/1992 | Gartenmaier | D6/580 |
| 5,249,617 | A | | 10/1993 | Durig | 160/168.1 |
| 5,263,528 | A | * | 11/1993 | Patel | 160/178.2 |
| 5,289,863 | A | * | 3/1994 | Schon | 160/168.1 |
| 5,351,741 | A | * | 10/1994 | Swopes | 160/168.1 |
| 5,560,414 | A | | 10/1996 | Judkins et al. | 160/178.1 |
| 5,562,140 | A | | 10/1996 | Biba | 160/178.1 |
| 5,626,177 | A | * | 5/1997 | Colson et al. | 160/168.1 |
| 5,819,833 | A | * | 10/1998 | Swiszcz et al. | 160/168.1 V |
| 6,076,588 | A | * | 6/2000 | Swiszcz et al. | 160/168.1 V |
| 6,116,322 | A | * | 9/2000 | Anderson et al. | 160/168.1 V |
| 6,135,188 | A | * | 10/2000 | Anderson et al. | 160/178.1 V |
| 6,148,894 | A | * | 11/2000 | Judkins | 160/177 R |

* cited by examiner 24
26
28
46
146
118
148
16
32
163
164
116
174
142
34
110
168
160
56
178
182
42
122
172
30
180
48
72
44
54
68
70
58
62
60
66

416
420
326'
436

416
326'
346
434

60A
59A
420
326'
434
346
436
434
60A
59A 416
420
380
326'
346
406
434
436
434
346

416
412
414
382
326'
434
436
434

CONTROL AND SUSPENSION SYSTEM FOR A VERTICAL VANE COVERING FOR ARCHITECTURAL OPENINGS

CROSS REFERENCE TO RELATED APPLICATIONS

This application is a continuation-in part of U.S. utility application Ser. No. 09/007,576, filed Jan. 15, 1998, now U.S. Pat. No. 6,076,588 for End Cap for Headrail in a Covering for an Architectural Opening, pending and allowed, which is a division of U.S. utility application Ser. No. 08/639,905, filed Apr. 24, 1996, now U.S. Pat. No. 5,819,833 for Control and Suspension System for a Vertical Vane Covering for Architectural Openings, which is a continuation-in-part of U.S. utility application Ser. No. 08/472,992, filed Jun. 7, 1995, now U.S. Pat. No. 5,626,177 for Control and Suspension System for a Vertical Vane Covering for Architectural Openings. Each of these patents and applications, which are all commonly owned by the owner of the present application, is hereby incorporated by reference as though fully set forth herein.

BACKGROUND OF THE INVENTION

1. Field of the Invention

The present invention relates generally to coverings for architectural openings such as doors, windows and the like, and more particularly to a control system for a covering having a plurality of vertically suspended vanes that are moveable between extended and retracted positions as well as open and closed positions to control visibility and the passage of light through the architectural opening.

2. Description of the Relevant Art

Covers for architectural openings such as doors, windows an the like have been known in various forms for many years. One form of such covering is commonly referred to as a vertical vane covering wherein a control system suspends and is operable to selectively manipulate a plurality of vertically suspended vanes such that the vanes can be moved laterally across the architectural opening to extend or retract the covering, an pivoted about longitudinal vertical axes to open and close the vanes.

Control systems for operating vertical vane coverings typically include a headrail in which a plurality of carriers, one associated with each vane, are movably mounted for lateral movement and include internal mechanisms for pivoting the vanes about their vertical axes. The headrails vary in construction and configuration to house the various types of carriers, but typically the headrails are relatively large in cross-section to enclose the working components of the system and have a slot along a bottom or side wall through which a portion of each carrier protrudes for connection to an associated vane.

An example of a control system wherein a headrail includes a slot along a side thereof through which a portion of the carriers protrudes is shown in U.S. Pat. No. 4,425,955 issued to Kaucic on Jan. 17, 1984. One problem with headrails having a slot in the side thereof resides in the fact that the slot is visible in the room in which the system is mounted and therefore is aesthetically unattractive.

U.S. Pat. No. 4,361,179 issued to Benthin on Nov. 30, 1982 discloses a headrail having an opening through the top thereof so as to improve the aesthetics of the headrail. The primary components of each carrier in the system are confined within the interior of the headrail, and generally C-shaped hangers associated with each carrier circumscribe the headrail so as to be in a position to support an associated vane from beneath the headrail. The Benthin patent accordingly acknowledges the desire of having the opening in the headrail concealed from normal view. The drawback with a system of the type disclosed in the Benthin patent resides in the fact that a majority of the working components of each carrier is confined within the headrail thereby necessitating a headrail with a fairly large cross-section which in and of itself is aesthetically unattractive.

A patent of interest from the standpoint of minimizing the size of the headrail is U.S. Pat. No. 2,869,636, which shows a relatively thin headrail having a slot in a rear wall thereof through which each carrier projects and wherein most of the carrier components are disposed outside the headrail. The headrail, while being relatively small, is oval in configuration with the broad side of the oval facing the interior of the room in which the system is mounted so as to undesirably present a relatively large profile.

As will be appreciated, while the prior art includes many different forms of control systems and headrails in which various types of carriers are movably mounted, they each suffer from aesthetic drawbacks related either to the size of the headrail at it is presented to the interior of the room in which the system is mounted or to the visibility of slots provided in the headrail. Further, most prior art systems are noisy in operation rendering them undesirable for that reason as well.

It is to overcome the shortcomings in prior art systems and to provide a new and improved control system that is easy to operate, quiet in operation, and aesthetically pleasing that the present invention has been made.

SUMMARY OF THE INVENTION

The control system of the present invention is adapted for use in a covering for an architectural opening and includes a very thin profile headrail which is a aesthetically attractive and a plurality of carriers supported by the headrail for independently supporting and pivoting connected vanes used in the covering. The carriers project through an opening in the top of the headrail which does not detract from the appearance of the covering. The carriers are interconnected by a scissors-type linkage so that the vanes suspended by the carriers can be stacked adjacent one or both sides of an architectural opening when the covering is retracted, but are uniformly spaced when the covering is extended to cover the architectural opening. The scissors-type linkage is disposed above the headrail and is also of a very thin profile so as not to be a detriment to the aesthetics of the system. A lead one of the carriers is connected to a traverse cord and is moveable by the cord longitudinally of the headrail or transversely of the opening in which the architectural covering is mounted, and movement of the lead carrier causes the remaining follower carriers to move therewith.

Each carrier is mounted on the headrail for smooth and quiet sliding movement and, in a first embodiment, includes a rack and pinion system for pivoting a suspended vane. The rack and pinion system is operatively engaged with a tilt rod that runs the length of the headrail. The tilt rod is mounted for rotative movement about its longitudinal a such that a manually operable tilt cord or wand disposed at one end of the headrail can selectively rotate the tilt rod in either rotative direction to reversibly effect pivotal movement of the vanes about their vertical longitudinal axes.

According to the first embodiment, the tilt rod is star shaped in cross section having a plurality of radially directed longitudinally extending teeth that engage a first set of teeth on a rack in each carrier such that rotative movement of the tilt rod effects translative or linear movement of the rack. A pivotal hanger pin in each carrier, which supports an associated vane, has a pinion gear adapted to operatively engage teeth on the rack so that translative movement of the rack causes pivotal movement of the carrier pin and consequently the vane connected thereto.

According to a second embodiment, the control system for a vertical blind that includes a plurality of vertically suspended vanes, each vane having a longitudinal axis, comprises an elongated headrail having a primary end cap, the vanes longitudinally movable along the headrail between an extended position and a retracted position a plurality of carriers operatively associated with and longitudinally movable along the headrail, wherein one vane is operatively associated with each carrier; a first control means for selectively moving the vanes between the extended position and the retracted position; and a second control means for selectively pivoting the vanes about pivot axes parallel to their longitudinal axes between an opened angular position and a closed angular position.

The components of the carriers are made of a low coefficient of friction plastic material and are configured in such a way that the contact area of the carriers with the headrail is minimized whereby the relative movement of the component parts is very quiet and smooth as is the sliding movement of the carriers along the length of the headrail. While the tilt rod is preferably made of a metal material, its engagement with the low-coefficient-of-friction plastic is likewise very quiet so that the entire mechanism is relatively noiseless operation.

Each carrier has only a minority portion thereof disposed within the hollow trough-like interior of the headrail so that the headrail can be of a thin profile. The remainder of each carrier is disposed above the headrail and overhangs a front side of the headrail. All of the visual components of the carrier are of thin dimension so as to present thin profile from inside the room in which the system is mounted.

As will also be appreciated, since the bottom of the headrail is closed, thereby hiding many of the working components of the system from the interior of the room where it is mounted, the bottom of the headrail prevents any working component from sagging, due to gravity, below the headrail.

The system further includes unique components for connection to the endmost vanes so that the covering can uniquely wrap around the ends of the headrail in a neat and attractive manner.

Other aspects, features, and details of the present invention can be more completely understood by reference to the following detailed description of preferred embodiments, taken in conjunction with the drawings and from the appended claims.

BRIEF DESCRIPTION OF THE DRAWING

FIG. 113 is similar to FIG. 112, but the vanes are depicted in a first closed configuration;

FIG. 114 is a fragmentary, top plan view similar to FIG. 113, but with the vanes rotated nearly 180° about their longitudinal, vertical axes to a second closed configuration;

FIG. 115 is an isometric view looking upwardly at a mounting block having snap fingers of a first form;

FIG. 116 is an isometric view of the mounting block depicted in FIG. 115, but looking downwardly at the mounting block;

FIG. 116A is similar to 116, but depicts a mounting block having slightly different snap fingers;

FIG. 116B is similar to 116A, but the snap fingers have been moved to the opposite side of the mounting block;

FIG. 117 is a top plan view of the mounting block depicted in FIG. 115 and 116;

FIG. 118 is an elevation looking at the side of the mounting block from which the snap fingers extend;

FIG. 119 is a cross-sectional view of the mounting block depicted in FIGS. 115 and 116, taken along line 119—119 of FIG. 117;

FIG. 120A is an isometric view looking downwardly at a top and inside end of the first embodiment of the assembled secondary end cap also depicted in FIGS. 37, 38, and 39;

FIG. 120B is an isometric view of the secondary end cap depicted in FIG. 120A, but looking upwardly to better show the mounted location of an idler pulley;

FIG. 121 is an exploded, isometric view of the secondary end cap main body and cover plate depicted in FIGS. 120A and 120B;

Figure 110:
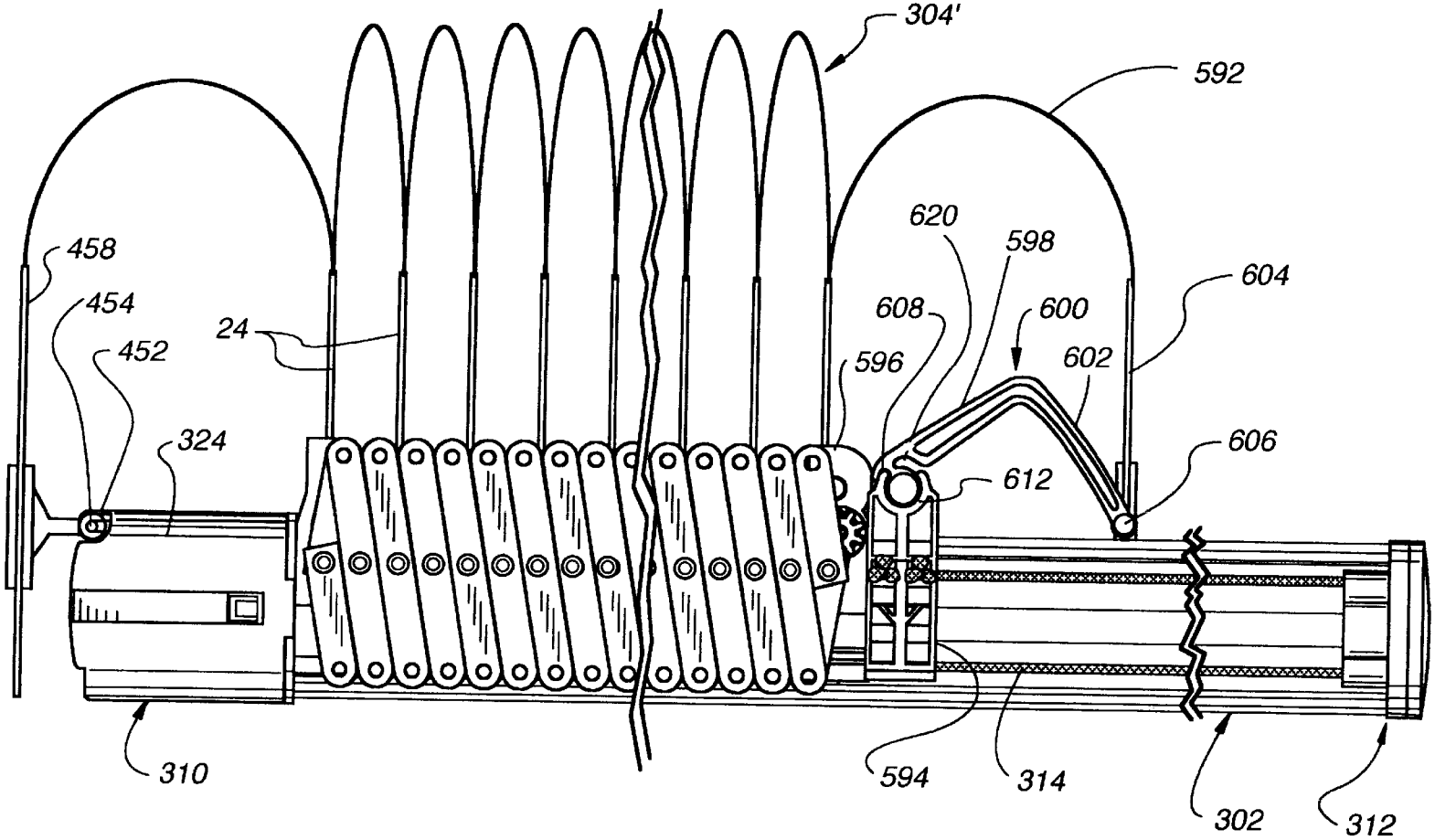
FIG. 110 is similar to FIG. 27 and is a fragmentary, top plan view of the second alternative control system, depicting hardware for controlling the endmost vanes of an architectural covering having a face sheet of material interconnecting the vanes, when the vanes are in a fully retracted configuration.
Figure 111:
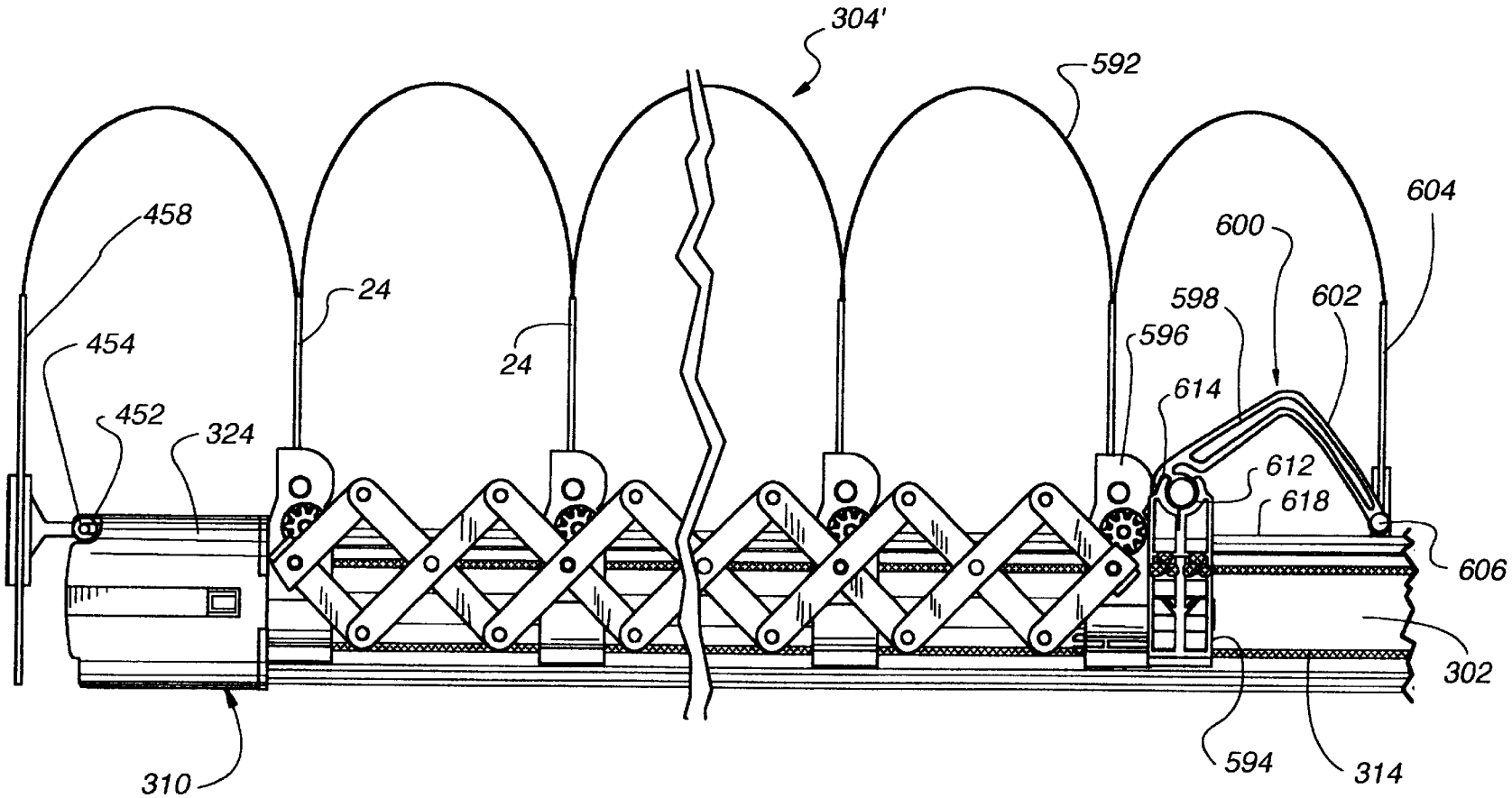
FIG. 111 is a top plan view similar to FIG. 110, but with the vanes in a partially-extended and open configuration.
Figure 112:
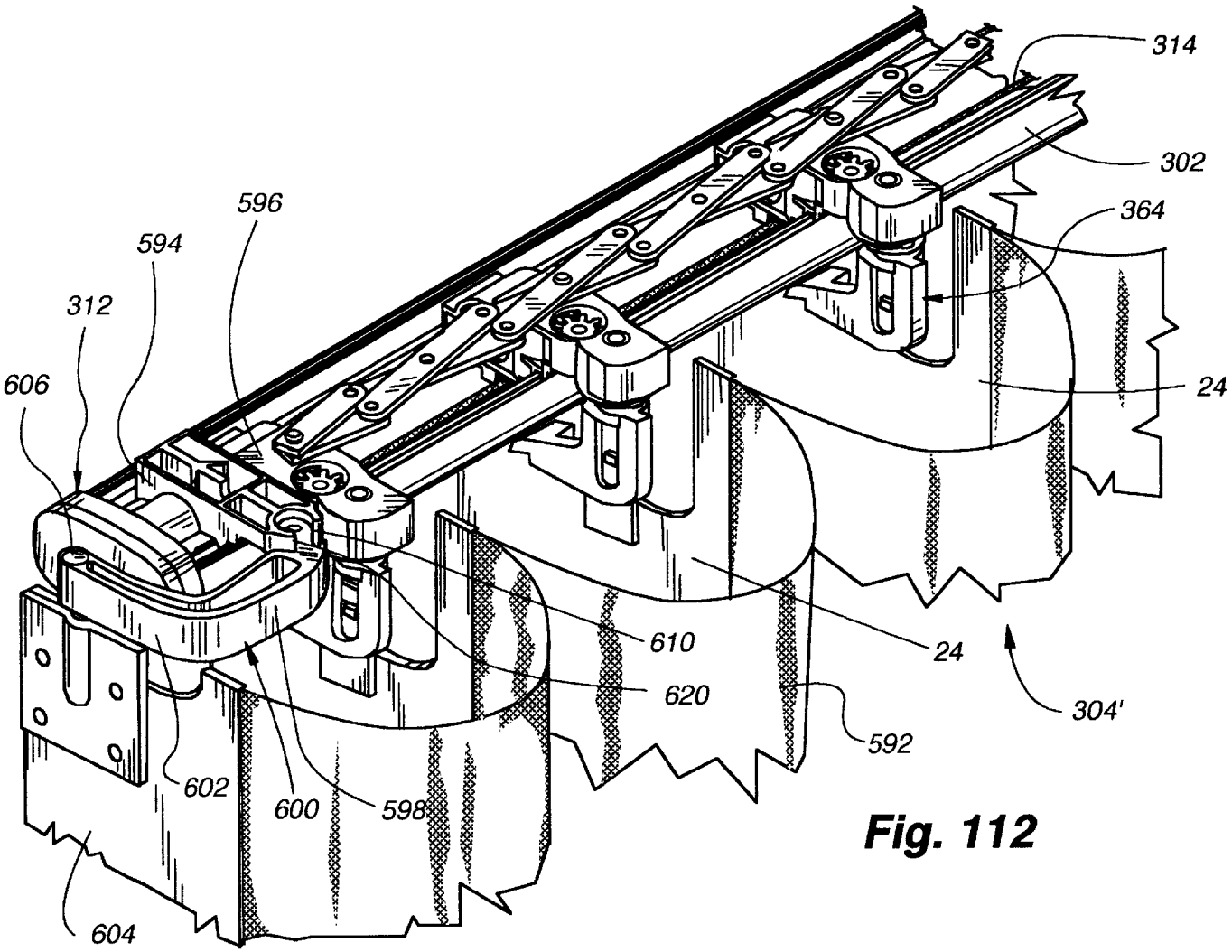
FIG. 112 is a fragmentary, isometric view looking downwardly at the top and front of the head rail with the vanes in a fully-extended and open configuration.
Figure 113:
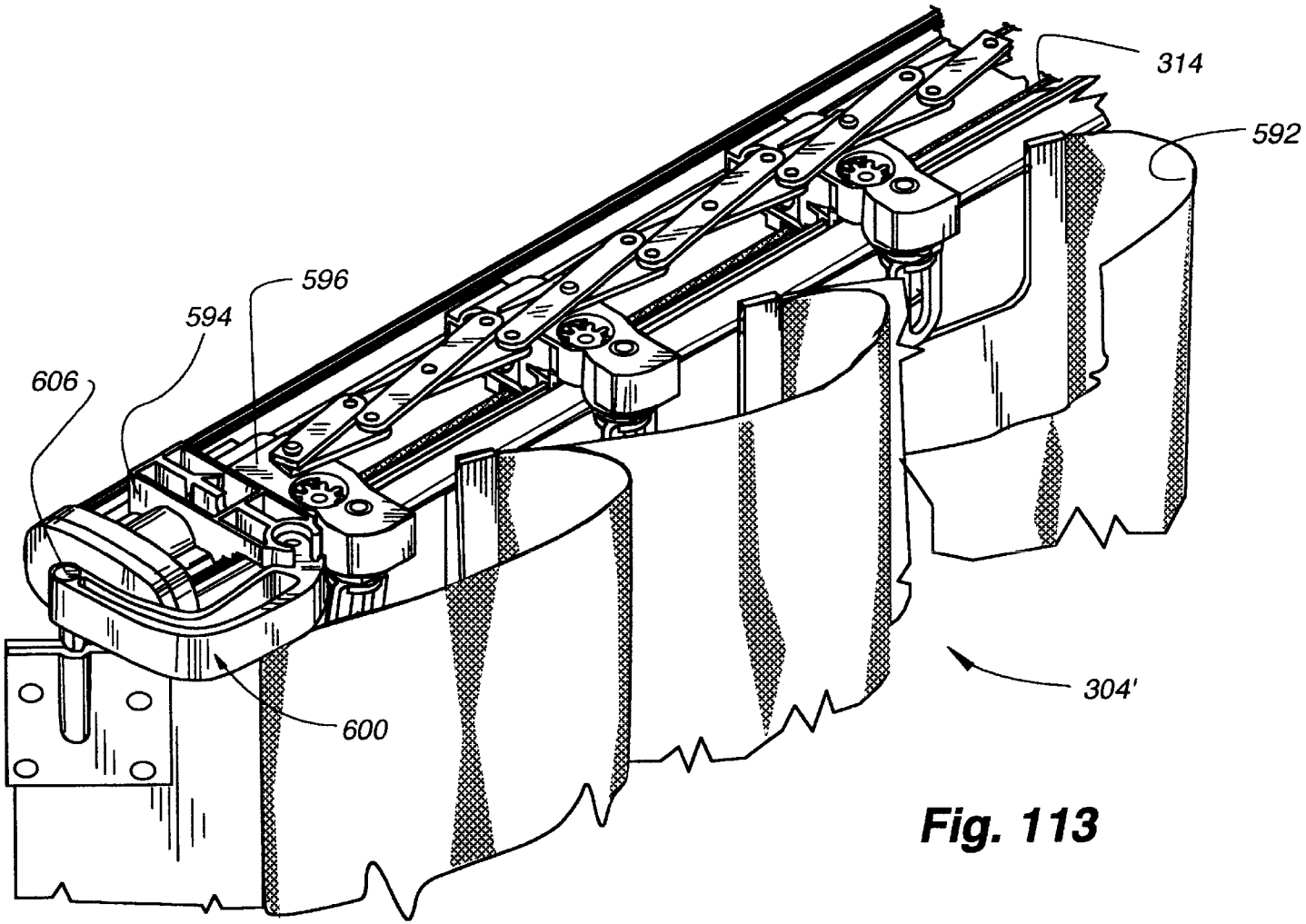
Figure 114:
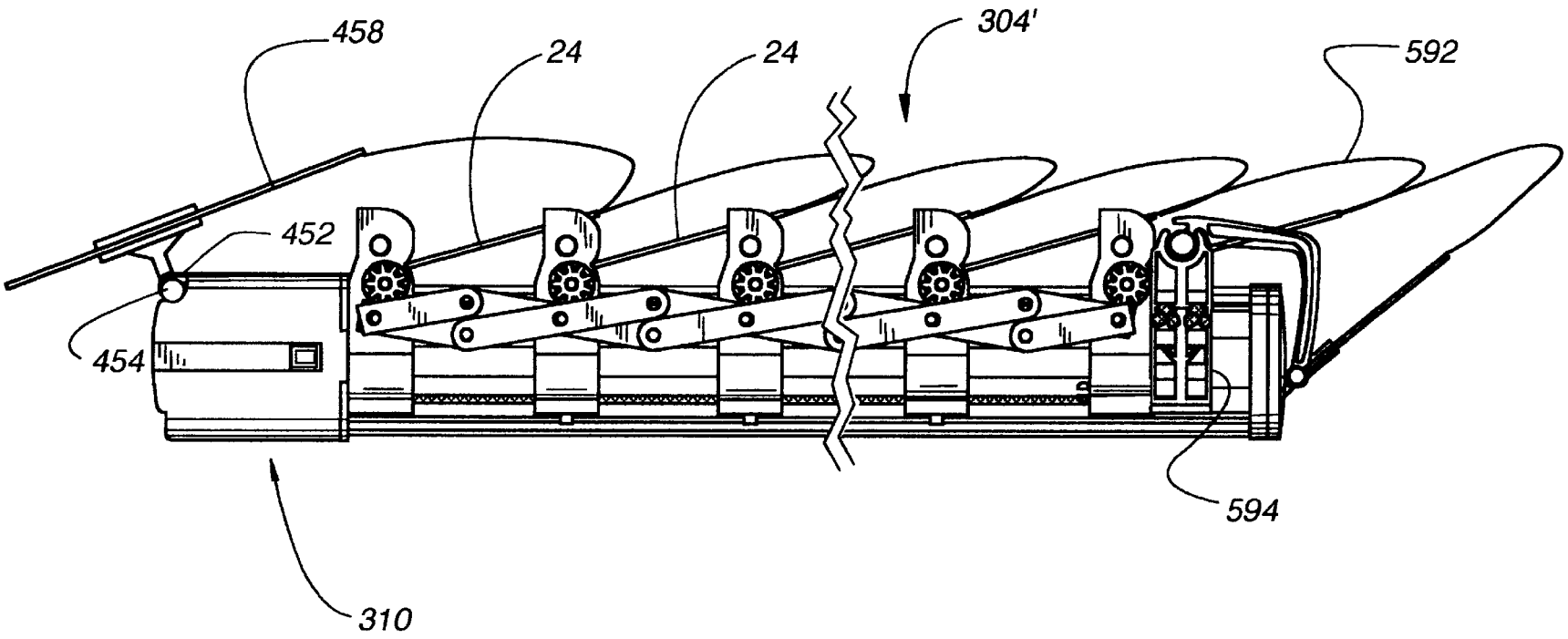
Figure 123A:
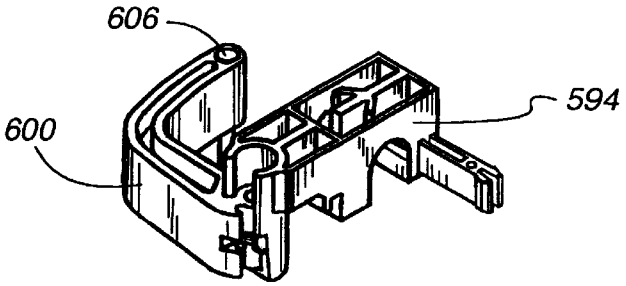
Figure 123B:
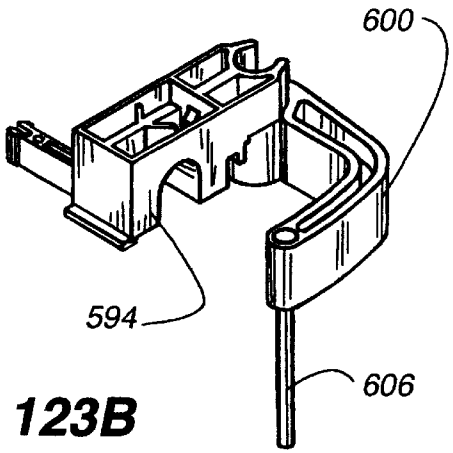
Figure 122:
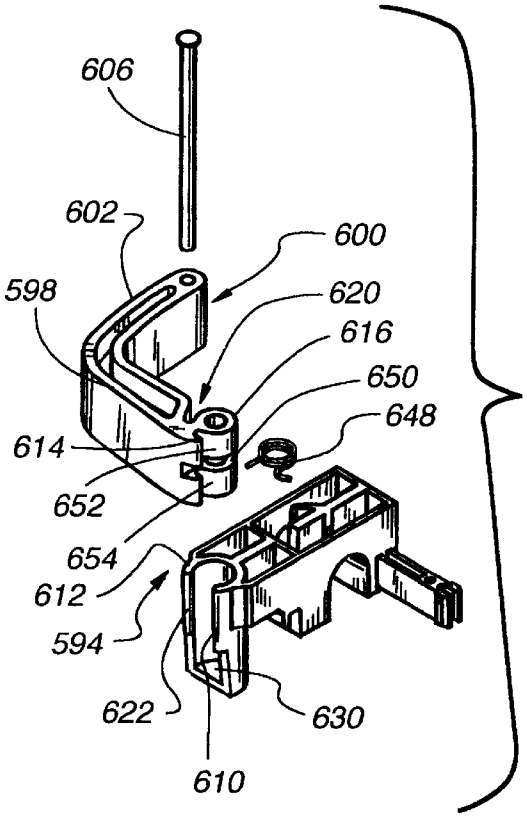
Figure 125:
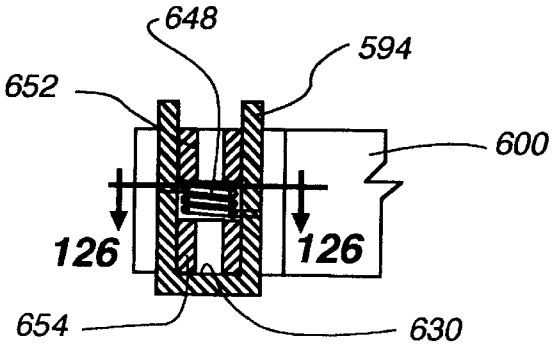
Figure 124:
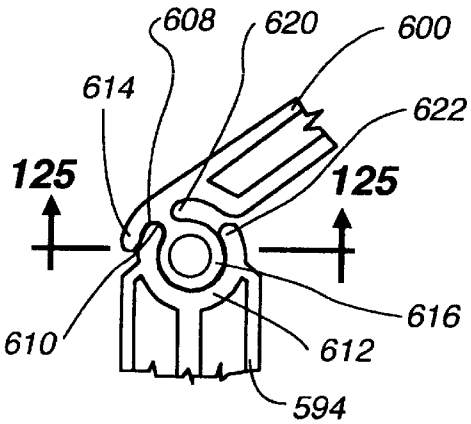
Figure 127:
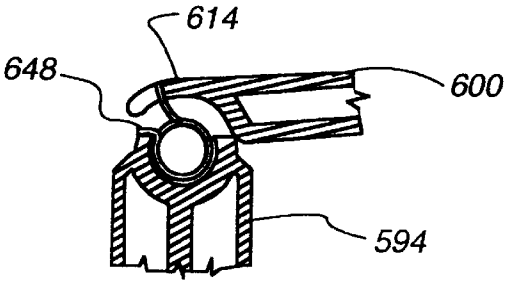
Figure 126:
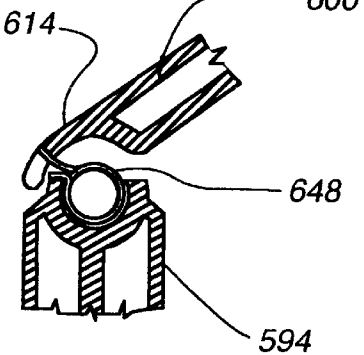
Figure 128:
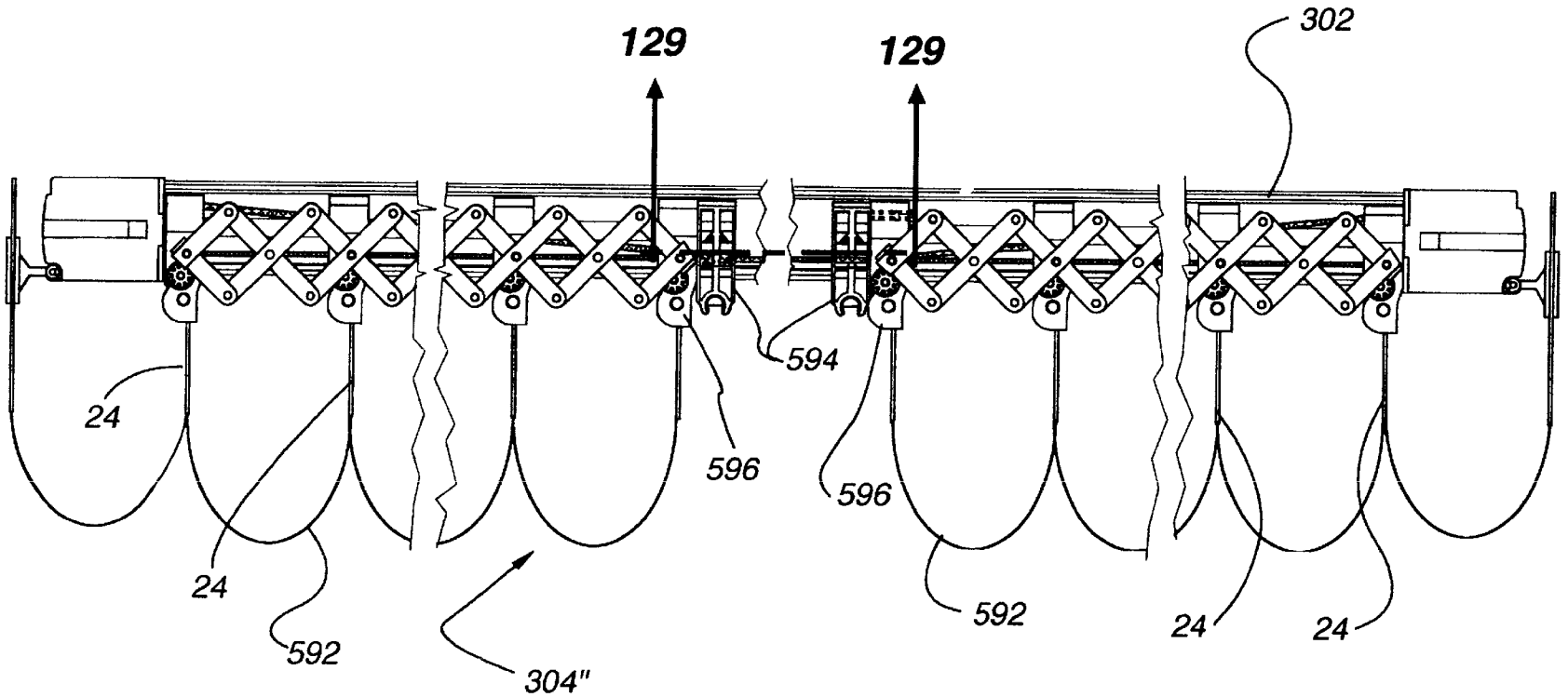
Figure 129:
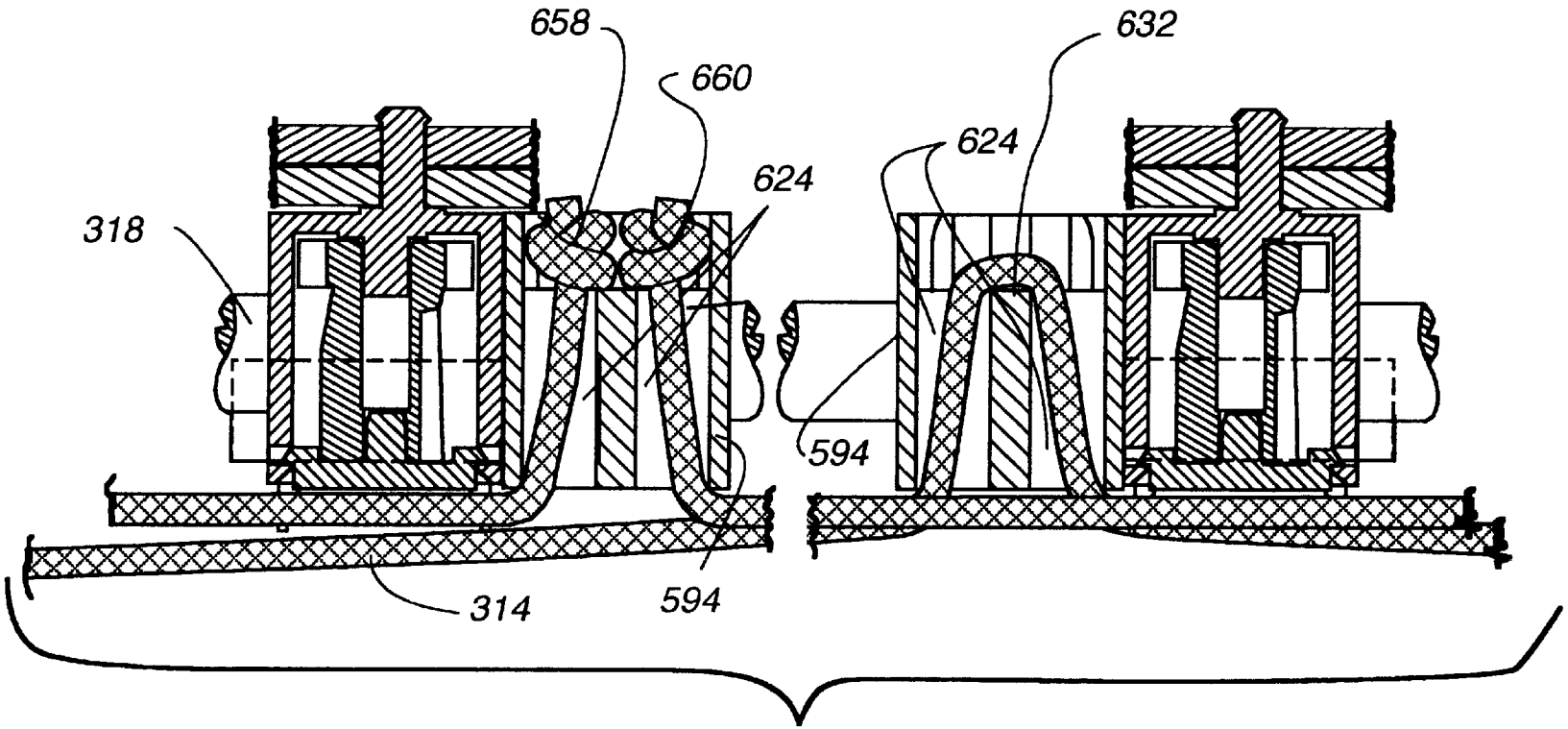
Figure 131:
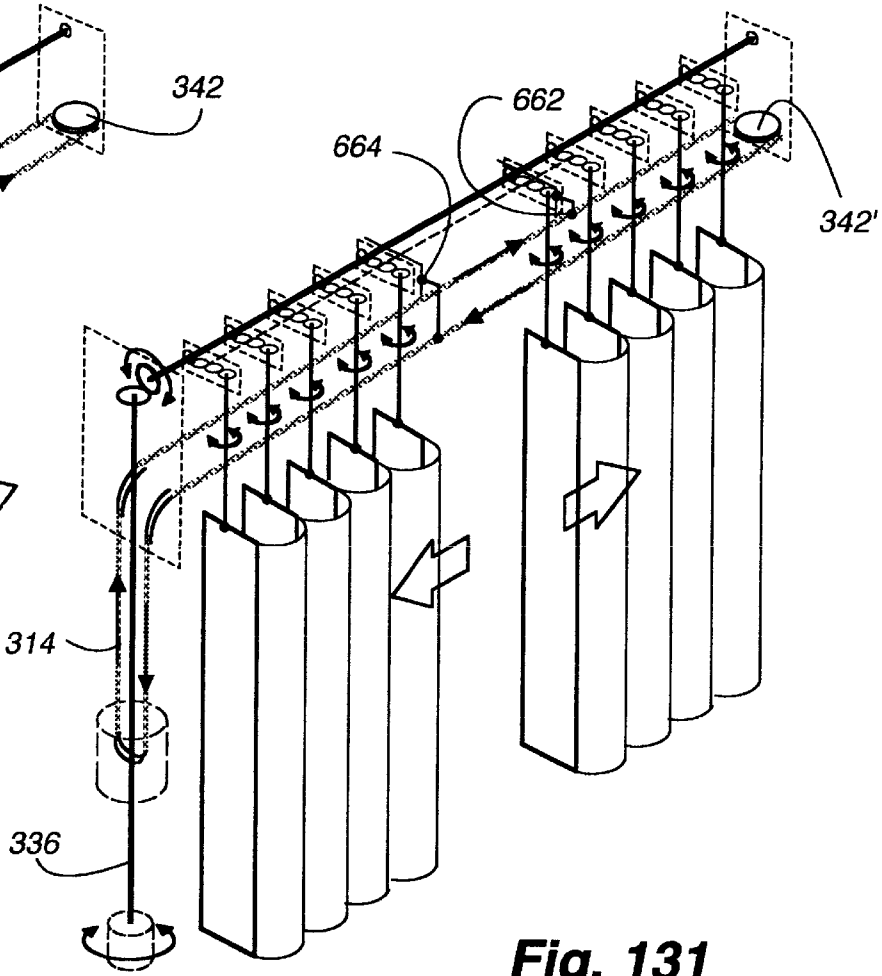
Figure 130:
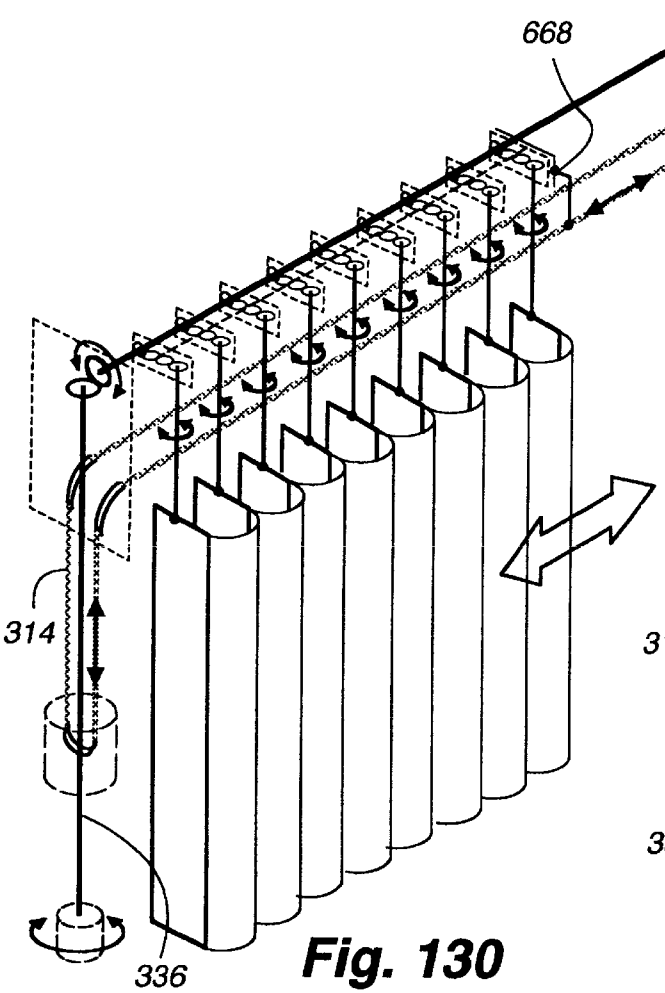

FIG. 122 is an exploded isometric view of hardware for positioning the endmost, free-end vane of a single draw architectural covering;

FIG. 123A is an isometric view of the hardware depicted in FIG. 122 in an assembled condition;

FIG. 123B is the same as FIG. 123A, but depicts the hardware from a different perspective;

FIG. 124 is a fragmentary, top plan view of a portion of the pivot arm and mounting block depicted in FIGS. 122, 123A, and 123B when the covering is fully retracted as shown in FIG. 110 or at an intermediate state of retraction as shown in FIG. 111;

FIG. 125 is a fragmentary, cross-sectional view taken along line 125—125 of FIG. 124;

FIG. 125 is a fragmentary, cross-sectional view taken along line 126—126 of FIG. 125;

FIG. 127 is similar to FIG. 126, but depicts the pivot arm and mounting block in the relative position they assume when the covering is fully extended as shown in FIGS. 112–114;

FIG. 128 is a fragmentary, top plan view of the second alternative control system in a center draw architectural covering application;

FIG. 129 is an enlarged, cross-sectional view taken along line 129—129 of FIG. 128 and depicting traverse cord routing and attachment in the center draw covering of FIG. 128;

FIG. 130 is a schematic, isometric view of traverse cord routing and attachment in a single-draw architectural covering; and FIG. 131 is a schematic, isometric view of traverse cord routing and attachment in a center-draw or dual-draw architectural covering.

DESCRIPTION OF THE PREFERRED EMBODIMENTS

Figure 1:
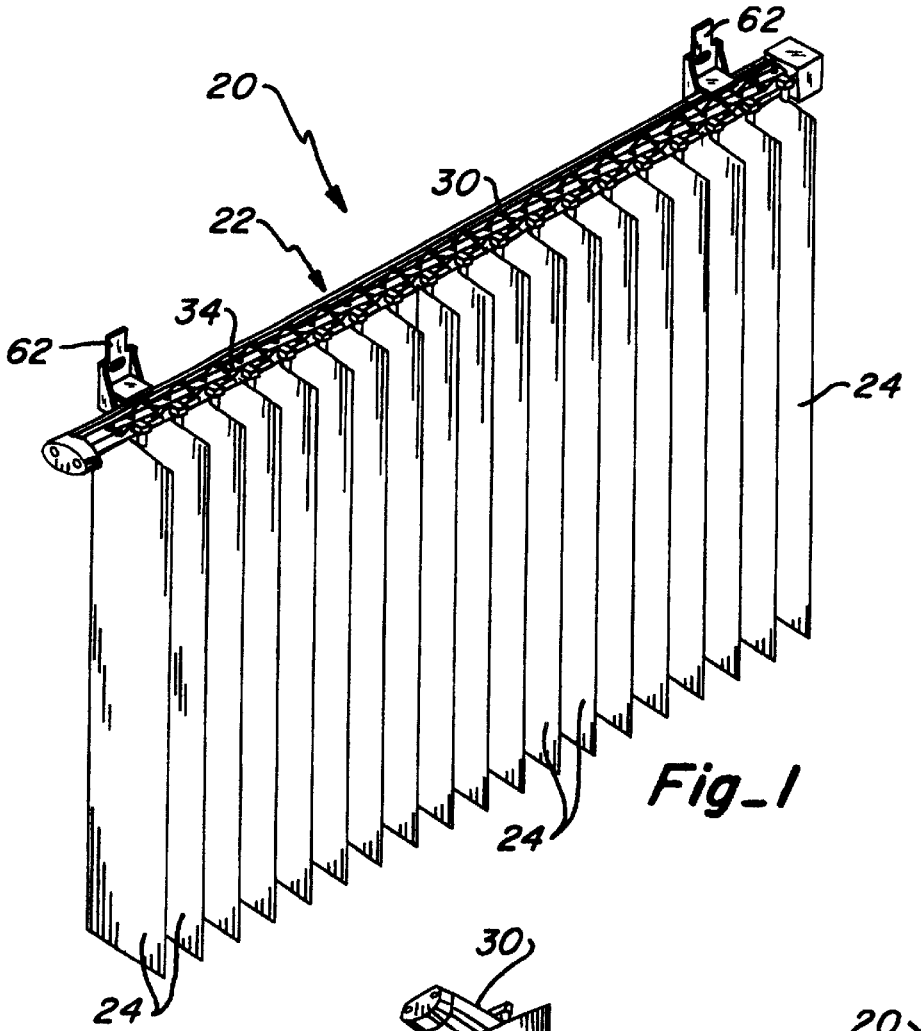
FIG. 1 is an isometric view looking downwardly on the control system of the present invention in use in connection with a covering for an architectural opening.
Figure 2:
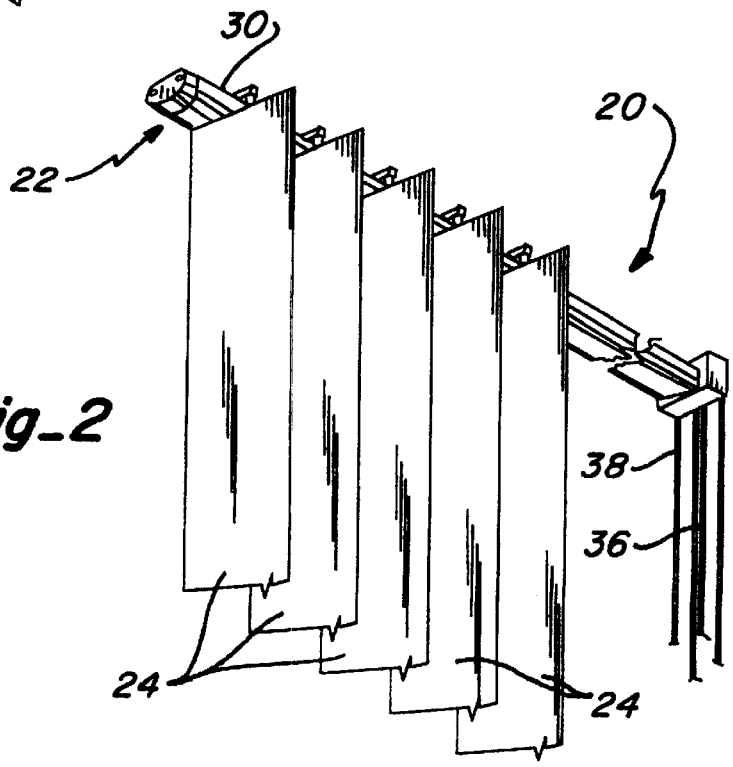
FIG. 2 is a fragmentary isometric view looking upwardly at the covering.

A covering 20 for an architectural opening incorporating the control system 22 of the present invention is seen best in FIGS. 1 and 2 to include not only the control system 22 but also a plurality of vertically suspended side-by-side vanes 24. While such a covering finds numerous uses in various architectural openings such as doors, windows, archways and the like, it will be referred to as a window blind or covering for purposes of the present disclosure.

Vanes 24 used in vertical vane window blinds can take many different forms, but, for purposes of the present disclosure, the vanes are illustrated as being flat planar sheets of rectangular configuration each having a reinforcing tab 26 (FIGS. 7 and 11) of plastic material or the like centrally located along a top edge with the tab projecting upwardly from the top edge and having an opening 28 therethrough to assist in its attachment to the control system.

The control system 22 itself generally includes a headrail 30, a plurality of carriers 32 (FIG. 6) from which the vanes 24 are individually suspended, a linkage 34 interconnecting the carriers and control cords 36 and 38 for manipulating the carriers 32. The carriers are slidably movable along the length of the headrail so as to move the blind between extended (FIG. 1) and retracted (FIG. 5) positions and each individual carrier includes a system for pivotally moving an associated vane between open (FIG. 3) and closed (FIG. 4) positions. In the open position of the vanes, they extend perpendicularly to the architectural opening while in the closed position they extend substantially parallel to the opening and in partially overlapping relationship with each other. In the closed position the vanes substantially block visibility and the passage of light through the opening. The control system 22 can be adapted to move all of the vanes from the extended position to a retracted position adjacent one side of the opening or adjacent complementary control systems can be utilized so that half of the vanes are retracted to one side of the opening while the other half are retracted to the opposite side. The latter result can also be obtained with suitable modifications to a single control system of the type described hereafter as would be apparent to one skilled in the art.

Looking particularly at the headrail 30 as seen best in FIGS. 1, 2, 6A, 7, and 11, it can be seen to be a generally U-shaped trough-like member opening upwardly so as to define, in cross-section, an open top side 40 (FIG. 6A), a bottom wall 42 (FIG. 7), and inner and outer upstanding legs 44 and 46, respectively. The bottom wall 42 is slightly downwardly convex having a downwardly opening groove 48 established at the base of the inner leg 44. Each of the inner and outer legs has an enlarged head 50 and 52, respectively, extending the length of the headrail with an upwardly opening groove 54 and 56, respectively. Intermediate the bottom wall 42 and the head 50 on the inner leg is an internal groove 58 that opens in a direction away from the supporting surface 60 (FIG. 12) on which the headrail 30 is mounted. While the headrail could be made of various materials, it has been found that an extruded aluminum that is painted with a low coefficient of friction paint provides an ideal surface for smooth and quiet operation of the system in a manner to be described later. A paint manufactured by Morton International of Decatur, Ala., and sold under Polyceram Model No. 1400 has been found to be ideally suited for use on the headrail.

Figure 7:
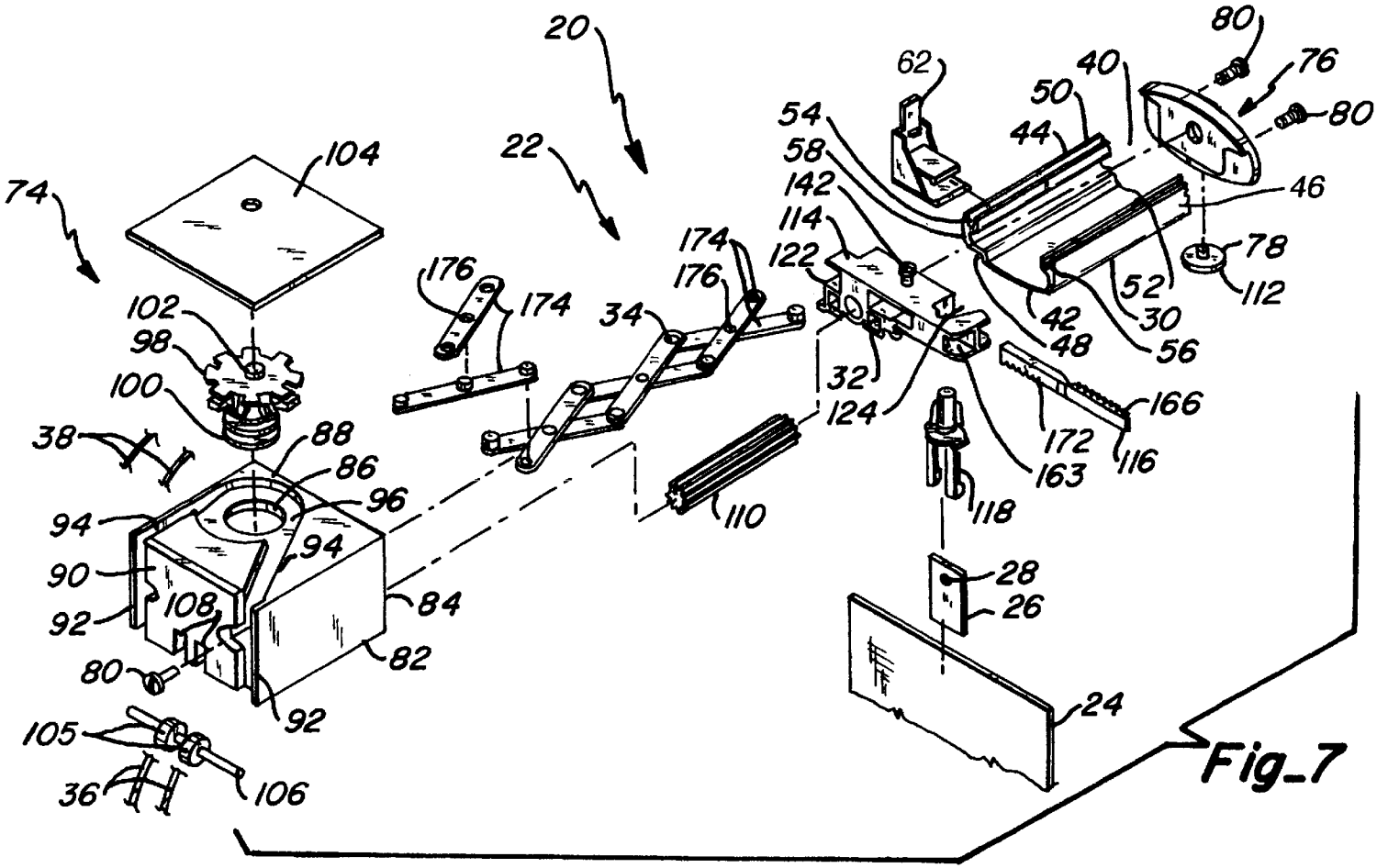
FIG. 7 is a fragmentary exploded isometric showing the various components of the covering of FIG. 1.
Figure 25:
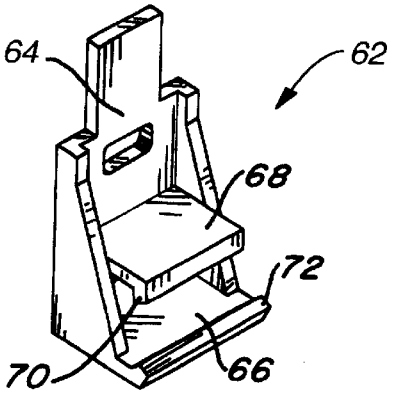
FIG. 25 is an isometric view of a bracket for hanging the headrail on a supporting surface.

The headrail 30 is suspended from the support surface 60 by a plurality of horizontally spaced mounting brackets 62, best seen in FIGS. 1, 7, and 25, secured to the support surface 60 and having a main body portion 64 and upper and lower vertically spaced substantially horizontally disposed plate-like legs 66 and 68, respectively, having in-turned lips 70 and 72, respectively. The lip 72 on the lower leg projects into the groove 48 formed in the bottom wall 42 of the headrail 30, and the lip 70 on the upper leg projects into the upwardly opening groove 54 in the head 50 of the inner leg 44 of the headrail 30. As will be appreciated by reference to FIGS. 1 and 11, the headrail is thereby supported and suspended in a releasable manner by the brackets 62 so as to present a very thin profile into the interior of the room in which the system is mounted and such that the open side 40 of the headrail 30 is directed upwardly.

Primary and secondary end caps 74 and 76, respectively, best seen in FIG. 7, are provided on the ends of the headrail 30 with the primary end cap 74 including pulley systems for operative engagement with the traverse cord 36 and the tilt cord 38 for manual manipulation by an operator of the system. The secondary end cap 76 is a substantially hollow body having an idler pulley 78 disposed therein for operative engagement with the traverse cord as will be described in more detail hereafter. The primary and secondary end caps are secured to the ends of the headrail in any suitable manner such as by screw type fasteners 80 as seen best in FIG. 7.

The primary end cap 74 consists of a block 82 of plastic or other suitable material having a large recess (not seen) in an inner side 84 facing the headrail 30. A vertical bore 86 passes downwardly from a top wall 88 of the block into communication with the large recess. An outer wall 90 on the opposite side of the block from the headrail has a pair of parallel, vertical grooves 92 which define channels in which the tilt cord 38 is disposed. The vertical grooves 92 are continuous with a pair of convergent grooves 94 in the top wall 88 of the block 82, which are in turn continuous with an arcuate groove 96 passing around the vertical bore 86 in the block. Rotatably disposed within the vertical bore in the block is a positive-grip pulley 98 having a worm gear 100 integrally depending therefrom. An integral vertical shaft 102 extends above the pulley 98 and below the worm gear 100. The shaft is journaled at a lower end within the large recess and at the upper end in a top cover plate 104 to permit reversible rotative movement of the pulley 98 and worm gear 1 00. The pulley is positioned adjacent the top wall 88 of the block and in alignment with the grooves 94 and 96 for the tilt cord 38 so that the tilt cord can pass around the pulley in gripping engagement therewith whereby movement of the tilt cord in either direction causes a corresponding rotative movement of the positive-grip pulley. The ends of the tilt cord hang from the primary end cap and may be secured together to form an endless loop for ease of operation.

Mounted within the large recess in the block are a pair of vertically oriented pulleys 105 (FIG. 7) rotatably mounted on opposite ends of a horizontal shaft 106. The pulleys are aligned with a pair of openings 108 in the outer wall 90 of the block so that the traverse cord 36 passing through the openings in the outer wall can extend across the pulleys as will be explained in more detail later.

The large recess in the primary end cap 74 further includes a journaled bearing (not seen) for supporting one end of a tilt rod 110 having longitudinally extending circumferentially spaced teeth that mesh with the worm gear 100. The tilt rod extends the length of the headrail 30 with the opposite end of the tilt rod being journaled and supported in the secondary end cap 76 at the opposite end of the headrail. The secondary end cap further has mounted interiorly thereof on a vertical shaft a horizontally disposed rotatable pulley 112 (FIG. 7) around which the traverse cord 36 extends before returning to the primary end cap 74.

Figure 6:
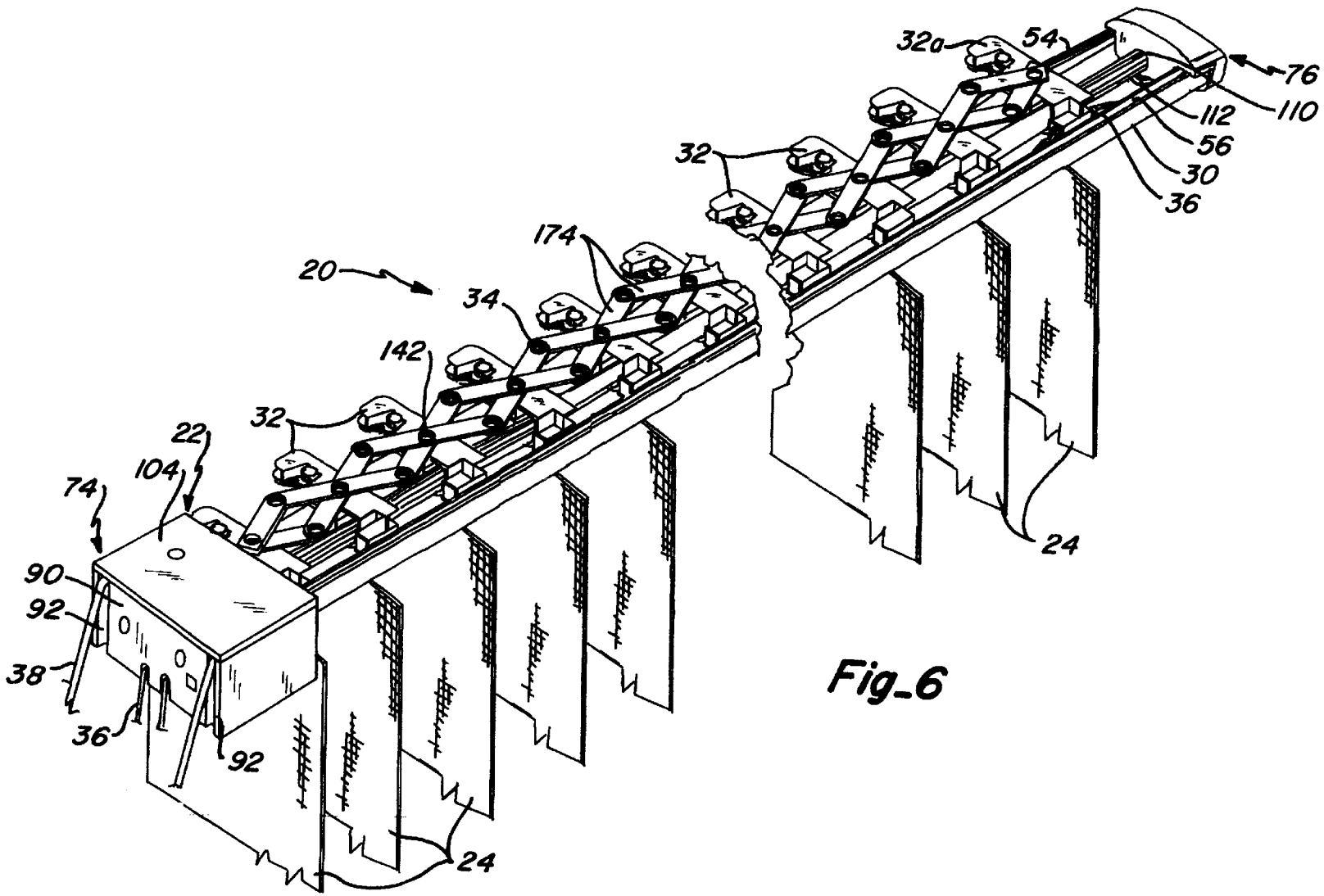
FIG. 6 is an enlarged fragmentary isometric similar to FIG. 1 looking downwardly on the covering.
Figure 6A:
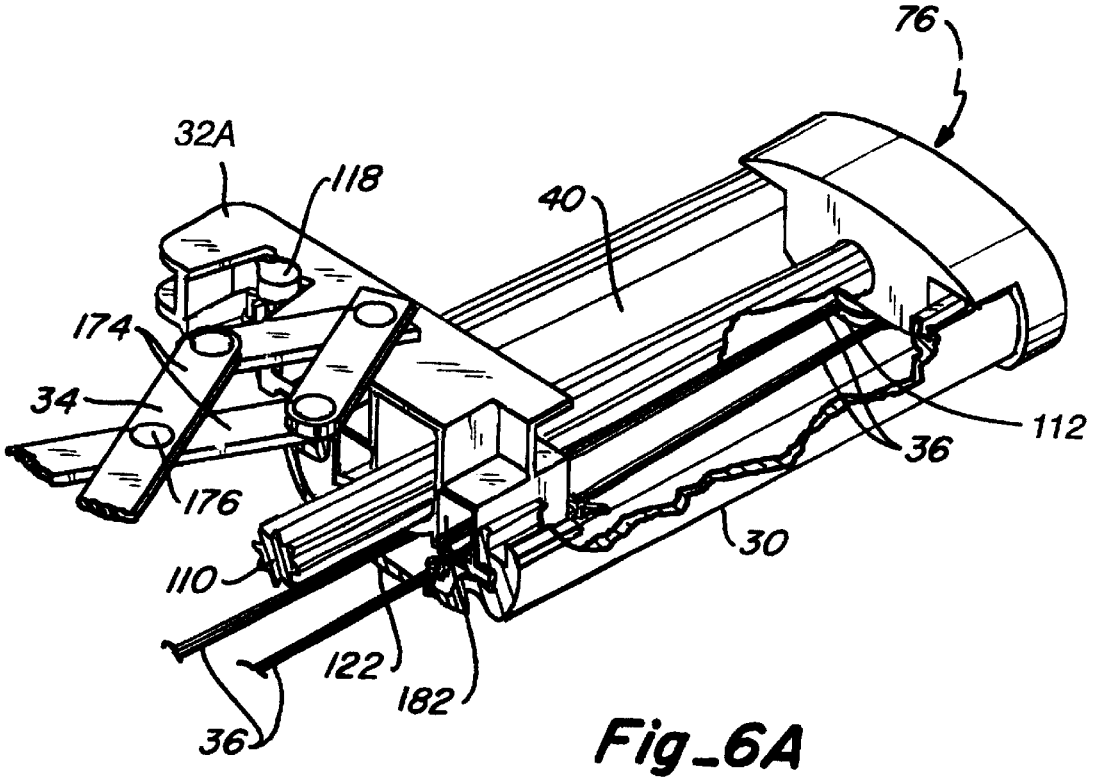
FIG. 6A is an enlarged fragmentary isometric of the end of the headrail having the secondary end cap.

As best seen in FIG. 6A, the traverse cord 36 is an elongated length of cable or cord which has a first end inserted into one of the openings 108 (FIG. 7) in the outer wall 90 of the primary end cap 74 and is extended along the length of the headrail 30 to the secondary end cap 76 where it is passed around the pulley 112 and returned to the headrail 30. The end of the cord 36 is ultimately secured to a lead carrier 32A (FIG. 6A) as will be described later. The opposite end of the traverse cord 36 is fed into the second opening 108 in the outer face 90 of the primary end cap and subsequently into the headrail where it too is secured to the lead carrier 32A. It will be appreciated that the traverse cord thereby forms an endless loop with the lead carrier integrated therein such that movement of the cord in either direction causes the lead carrier to slide along the length of the headrail 30.

Figure 20:
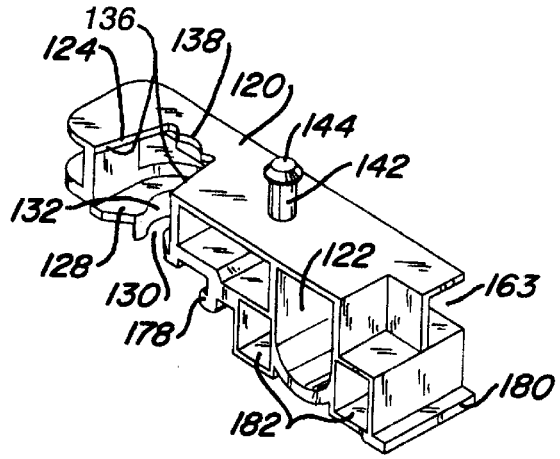
FIG. 20 is an isometric view of a carrier body looking downwardly on the body.
Figure 21:
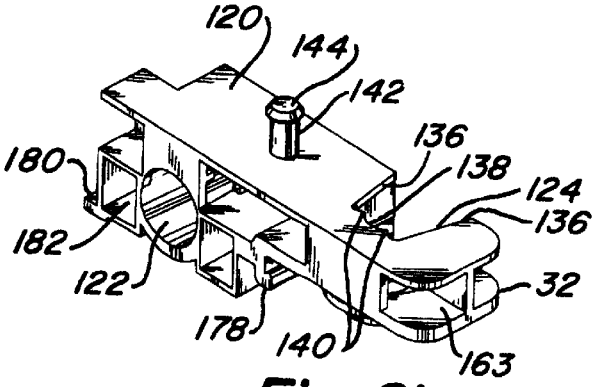
FIG. 21 is an isometric view similar to FIG. 20 looking downwardly on the carrier body from a different direction.
Figure 22:
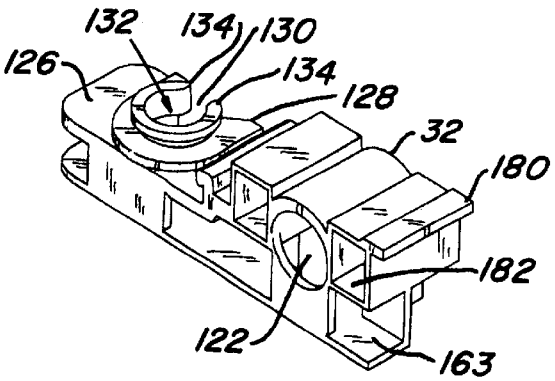
FIG. 22 is an isometric view similar to FIG. 20 looking at the carrier body from the bottom.

Each of the carriers 32, as best seen in FIGS. 7, 11, 13, and 20–24, are identically formed and configured and include a carrier body 114, a rack 116, and a hanger pin 118. The carrier body, which is probably best seen in FIGS. 20–22, is preferably injection molded from a low coefficient of friction plastic material such as Celcon® manufactured by Hoechst Celanese Corporation of Chatham, N.J., and has a relatively flat top wall 120 underneath which are formed a number of passages or notches between various walls or partitions. At one end of the body 114 adjacent a lower portion thereof is a transverse passage 122 of substantially cylindrical configuration. The passage is slightly larger in diameter than the tilt rod 110 and is adapted to rotatably receive the tilt rod. The opposite end of the body 114 has a laterally opening notch 124 formed therein with the notch being defined between the top wall 120 of the carrier body and a bottom wall 126. The bottom wall has a generally U-shaped integral flange 128 in underlying relationship to the notch formed in the bottom wall with the flange 128 having a relatively narrow neck portion 130 and a larger interior portion 132. Legs 134 defined on the flange at the neck portion 130 will yield to temporarily permit enlargement of the neck portion. The opening in the top wall 120 defined by the notch has a pair of convergent edges 136 and an end edge 138. The end edge is scalloped so as to define a pair of horizontally spaced stops 140. The stops perform a function which will be described later in connection with the description of the hanger pin.

The top wall 120 further has a centrally located upstanding cylindrical pin 142 with an enlarged frusto-conical head 144 adapted to connect the carrier body 114 to the linkage system 34 as will be described later.

Figure 23:
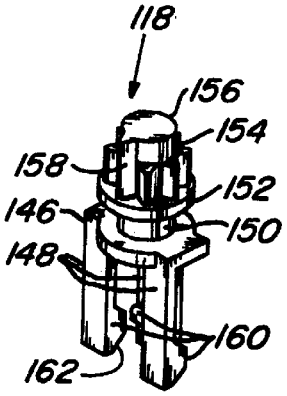
FIG. 23 is an isometric view of a hanger pin placeable in the carrier body of FIG. 20.

As best seen in FIG. 23, the hanger pin 118 has a horizontal plate portion 146, three confronting pins 148 depending from the plate portion defining a slot therebetween, and a cylindrical body 150 above the plate portion which supports thereabove on an enlarged disc-like portion 152 a pinion gear 154. Above the pinion gear, an integral cylindrical body 156 protrudes upwardly having a radial abutment finger 158 adapted to cooperate with the stops 140 on the top wall of the carrier body 114 as will be described later.

The hanger pin 118 is releasably connected to the carrier body 114 so as to be pivotal about a vertical axis. The cylindrical body 150 of the hanger pin is of slightly larger diameter than the neck portion 130 in the flange 128 on the main body, but as mentioned previously, the legs on the flange are resilient so as to allow the cylindrical body of the hanger pin to be forced through the neck into the enlarged interior portion 132 of the flange. Once so positioned, the neck portion releasably retains the hanger pin on the carrier body. The enlarged interior portion 132 of the flange is larger than the cylindrical body 150 of the hanger pin to permit free pivotal movement of the hanger pin. When appropriately positioned in the carrier body, the abutment finger 158 on the top of the hanger pin limits pivotal movement of the hanger pin by abutting one stop 140 or the other on the top wall of the carrier body so that the hanger pin, without being forcefully displaced, is only permitted to pivot through slightly more than 180°.

The three confronting pins 148 that depend from the plate portion 146 of the hanger pin are elongated vertical pins and are somewhat flexible. Each pin has an enlarged head 160 near its lower end and a lower beveled surface 162 so that the reinforcing tab 26 on the top of a vane 24 can be inserted vertically between the three confronting pins until the enlarged head 160 on the center one of the three pins 148 protrudes into the opening 28 in the reinforcement tab. The enlarged heads 160 on the other two pins press into the vane reinforcing tab 26 from the opposite side and thereby hold the head on the center pin in the opening 28 to releasably secure the vane 24 in a depending manner from the hanger pin 118.

Figure 16:
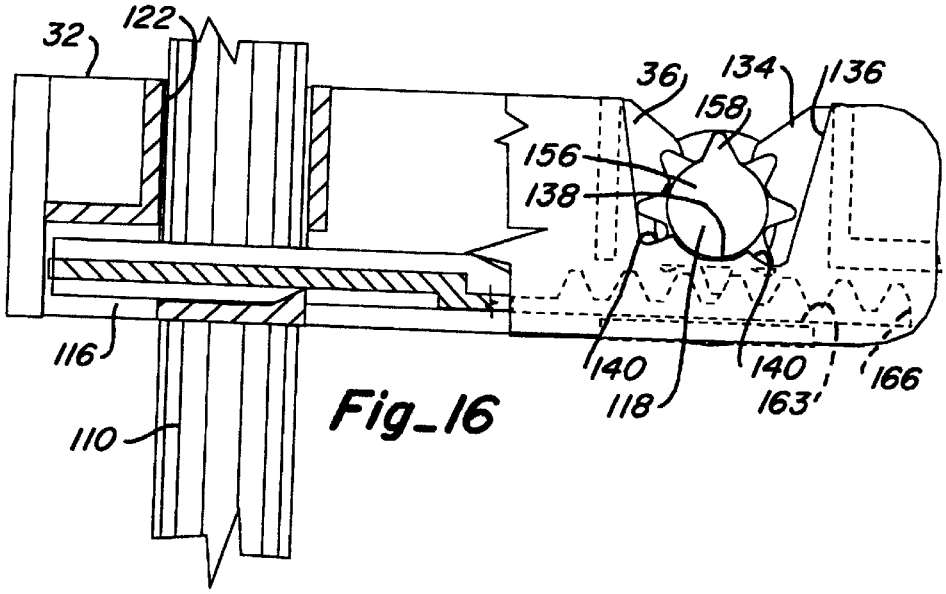
FIG. 16 is an enlarged fragmentary section taken along line 16—16 of FIG. 11.
Figure 17:
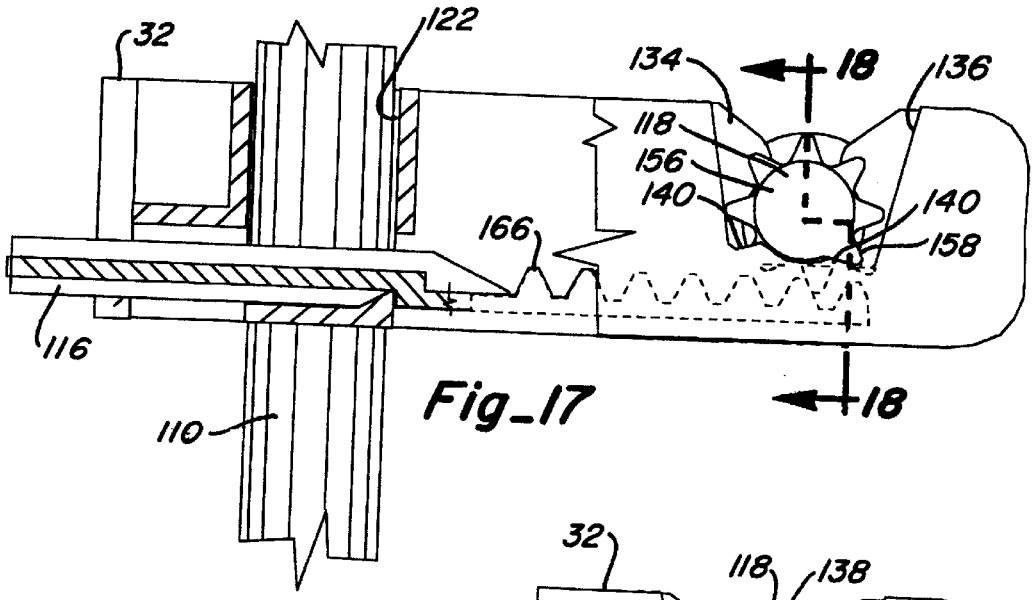
FIG. 17 is an enlarged fragmentary section taken along line 17—17 of FIG. 12.
Figure 18:
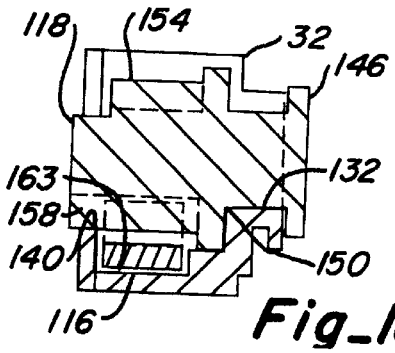
FIG. 18 is a section taken along line 18—18 of FIG. 17.
Figure 24:
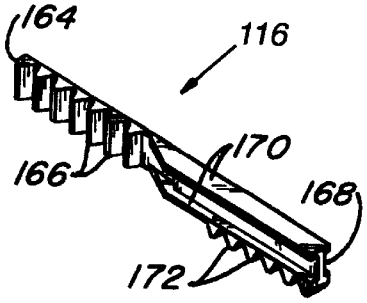
FIG. 24 is an isometric view of a rack positionable in the carrier body of FIG. 20.

The vertical axis of the hanger pin is slightly offset from a horizontal longitudinal channel 163 defined through the carrier body by a plurality of wall members. The channel is probably best seen in FIGS. 12, 17, 18, 20 and 22. The teeth on the pinion gear 154 of the hanger pin 118 protrude into the horizontal channel 163. The channel slidably receives the rack 116 as best seen in FIGS. 16 and 17. One end 164 of the rack as best seen in FIG. 24 is plate-like and positioned adjacent to the pinion gear. The plate-like end 164 has a set of teeth 166 on a side wall thereof which mesh with the teeth on the pinion gear 154. The opposite end 168 of the rack is of generally I-shaped cross-section having reinforcing upper and lower beam sections 170 for rigidification and a second set of teeth 172 formed along the lower surface thereof.

Figure 11:
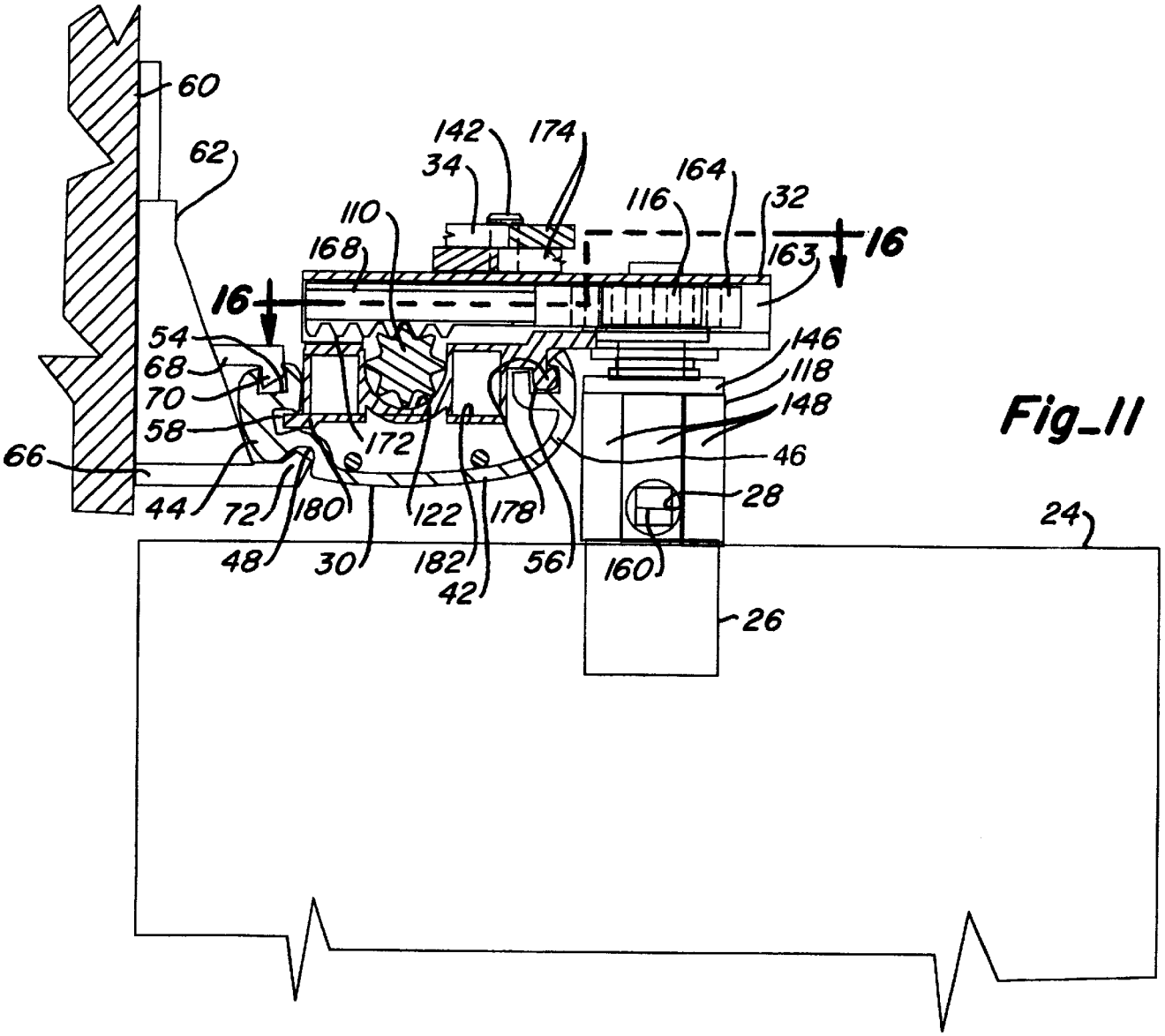
FIG. 11 is an enlarged fragmentary section taken along line 11—11 of FIG. 3.
Figure 12:
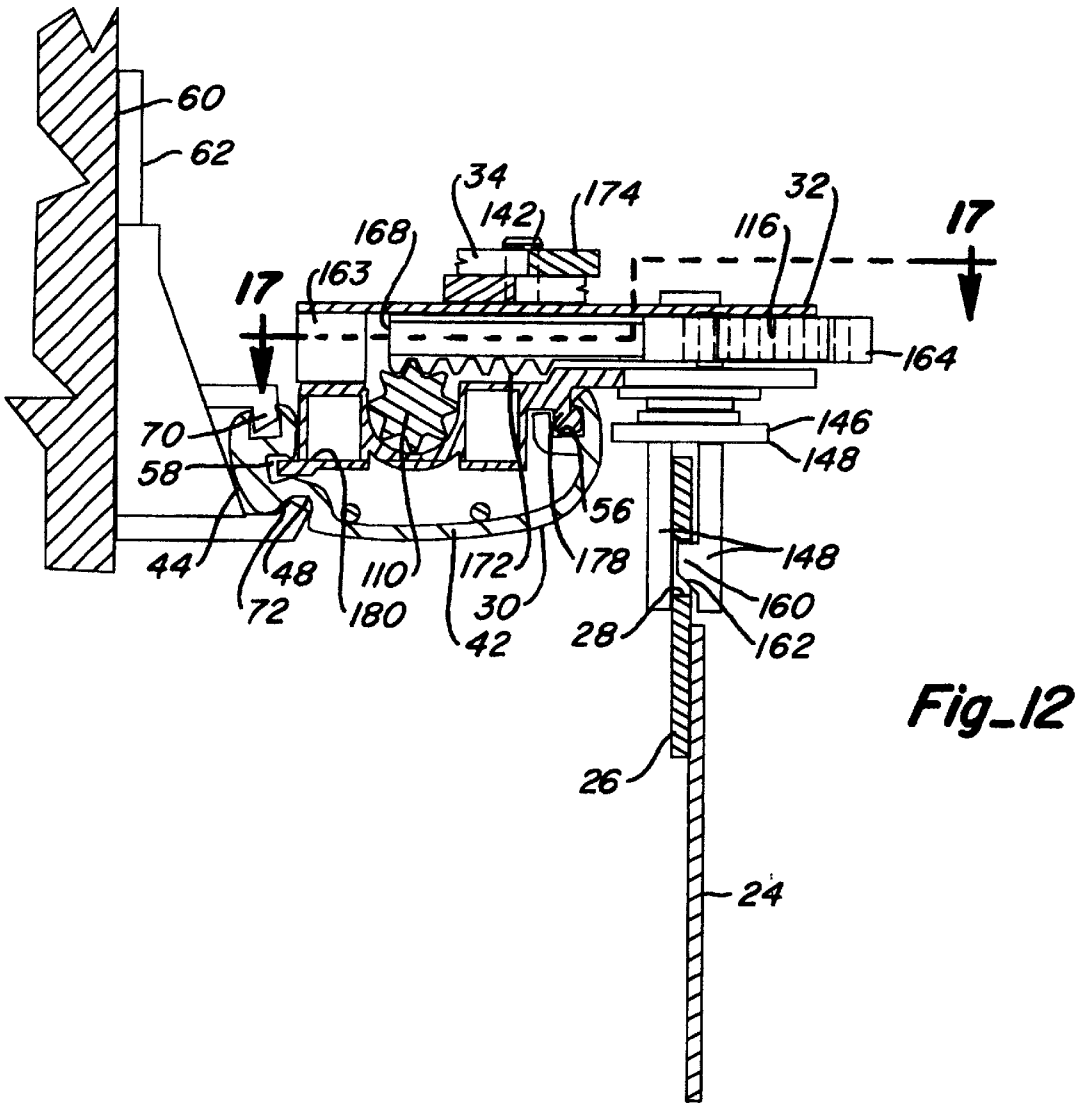
FIG. 12 is an enlarged fragmentary section taken along line 12—12 of FIG. 4.

The channel 163 through the carrier body 114 that receives the rack 116 also communicates with the substantially cylindrical passage 122 in the carrier body that receives the tilt rod 110 (FIGS. 11 and 12). In fact, the second set of teeth 172 on the rack protrude into the cylindrical passage 122 and mesh with the teeth on the tilt rod 110. It will therefore be appreciated that rotation of the tilt rod 110 causes the rack 116 to be translated or moved linearly and longitudinally of the carrier body, and as a consequence, the first set of teeth 166 on the rack 116 which are engaged with the pinion gear 154 on the hanger pin 118 pivot the hanger pin in a direction dependent upon the direction of linear movement of the rack.

Figure 8:
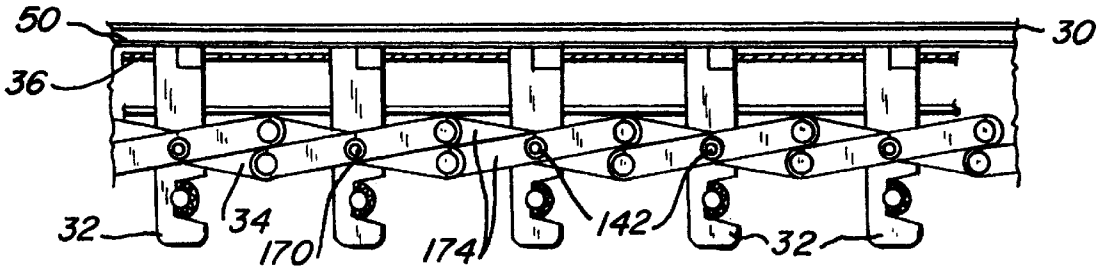
FIG. 8 is a fragmentary top plan of the control system of the present invention with the linkage fully extended.
Figure 9:
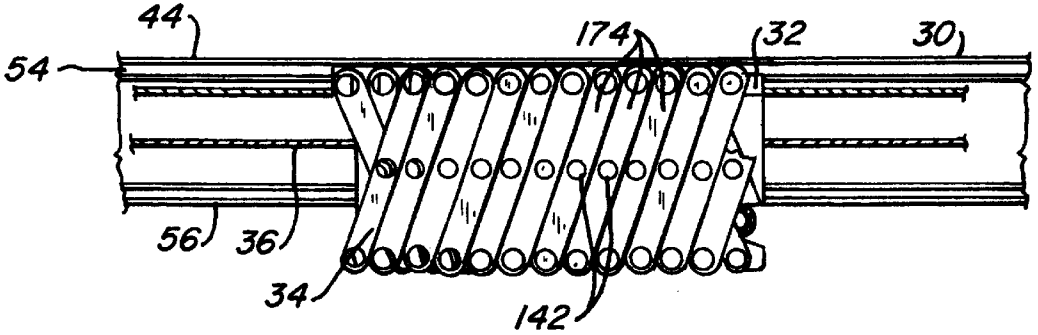
FIG. 9 is a fragmentary top plan similar to FIG. 8 with the linkage fully retracted.
Figure 10:
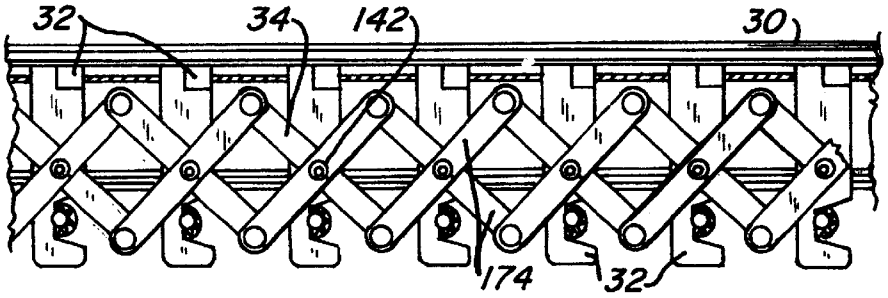
FIG. 10 is a fragmentary top plan similar to FIG. 8 with the linkage in an intermediate position.

The carriers 32 are interconnected to each other and connected to the primary end cap 74 by the linkage 34 in the form of a pantograph otherwise known as scissors-type linkage. As best appreciated by reference to FIGS. 7–10, the linkage includes a plurality of interconnected links 174 wherein two associated links form a pair and are pivotally interconnected at a mid-point. The ends of each link 174 in a pair are pivotally connected to associated ends of links in an adjacent pair. The scissors-type linkage is, therefore, adapted to be extended to a maximum length (FIG. 8), which is predetermined by the number of interconnected link pairs, or retracted into a compact position as seen in FIG. 9, wherein corresponding links on adjacent pairs of links are positioned contiguous with each other.

Figure 5:
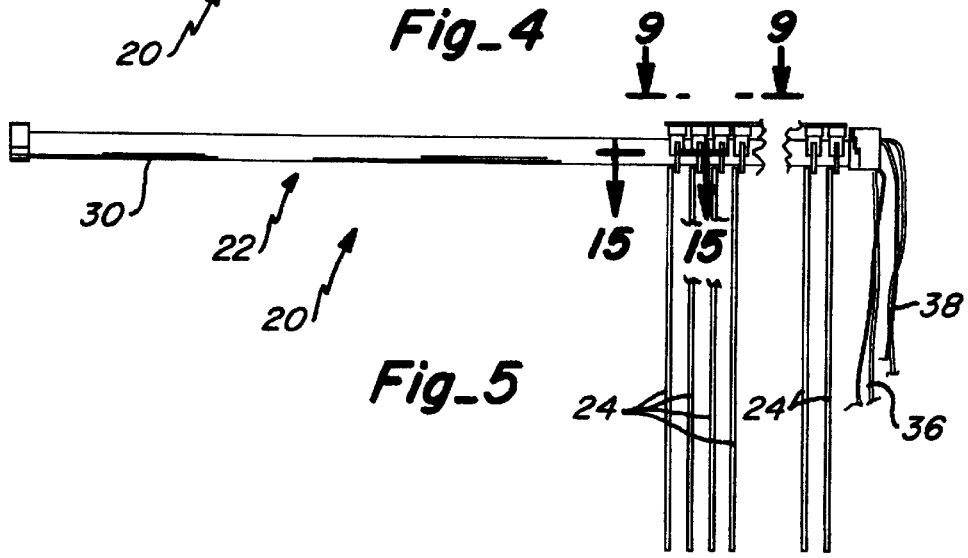
FIG. 5 is a front elevation similar to FIG. 3 with the vanes in a retracted and open position.

The scissors-type linkage 34 is interconnected with the carriers 32 through the upstanding pin 142 on the top wall 120 of the carriers. The pin 142 is made of a somewhat resilient material, for example Celcon®, and is forced through an opening 176 (FIG. 7) in the pivoted joint intermediate the ends of two links 174 in a pair. Each pair of links is thereby associated with an individual carrier and pivotally confined between the head 144 on the pin and the top wall of the carrier body. It will, therefore, be appreciated that extension or retraction of the scissors-type linkage causes the connected carriers to move accordingly so that the carriers are likewise moved between a fully extended equally spaced position as shown in FIGS. 1 and 8, and a closely adjacent retracted or horizontally stacked relationship as shown in FIGS. 5 and 9.

The carriers 32 are confined in their movement through their interrelationship with the headrail 30 as is probably best appreciated by reference to FIG. 11. Each carrier body at a location approximately at its mid-point on an undersurface thereof has a depending transversely extending bead 178 (see also FIGS. 20 and 21), which is releasably confined within the upwardly opening groove 56 in the outermost leg 46 of the headrail 30. A plate-like extension 180 on the lower surface of the carrier body 114 adjacent the innermost end of the body protrudes into the inwardly opening groove 58 on the inner leg 44 of the headrail 30. By inserting the carrier into the ends of the headrail so that the bead 178 and the platelike extension 180 are received within the corresponding grooves, it will be seen that the carrier cannot be laterally or vertically displaced from the headrail and will be guided in sliding movement along the headrail by the two grooves. As mentioned previously, when the carrier body is made of a low coefficient of friction material such as Celcon® and is minimally engaged with the painted aluminum headrail as described, the sliding movement is very smooth and quiet, which are both desirable characteristics of a control system for a window blind. The carriers can also be seen to extend beyond the front side of the headrail so that the vanes 24 are suspended from a location offset from the longitudinal center line of the headrail.

From the above-noted description, it will be appreciated that extension and retraction of the scissors-type linkage 34 will cause the carriers 32 to slidingly move longitudinally of the headrail 30. The movement of the carriers and consequently the expansion and contraction of the scissors-type linkage 34 is effected by the traverse cord 36, which as mentioned previously forms an endless loop through the headrail and includes a connection to the lead carrier 32A. The lead carrier may be but does not necessarily have to be the carrier furthest displaced from the primary end cap 74. The previously mentioned connection of the two ends of the traverse cord to the lead carrier is accomplished by passing the to ends of the cord in reverse directions through a square shaped channel 182 (see FIGS. 20–22) formed adjacent to the bottom of the carrier on the tilt rod side and subsequently passing the ends around the carrier and tying them to themselves so that the lead carrier is integrated into the traverse cord and is forced to move in synchronism with the traverse cord. It will, therefore, be seen that movement of the traverse cord in one direction will cause the lead carrier to move in a first direction along the length of the headrail and movement of the traverse cord in the opposite direction will cause the lead carrier to move in the opposite direction along the headrail. Of course, movement of the lead carrier causes the remaining or follower carriers 32 to move accordingly so that when the lead carrier is moved as far as it can be moved toward the primary end cap 74, it will effect a stacking of the carriers (FIG. 9) adjacent the primary end cap 74 and in adjacent relationship with each other. Movement of the lead carrier in the opposite direction will simultaneously equally separate the carriers and maintain a uniform but growing separation until the lead carrier is moved to its fullest extent (FIG. 8) at which time the suspended vanes will be equally spaced across the window opening as desired.

Figure 3:
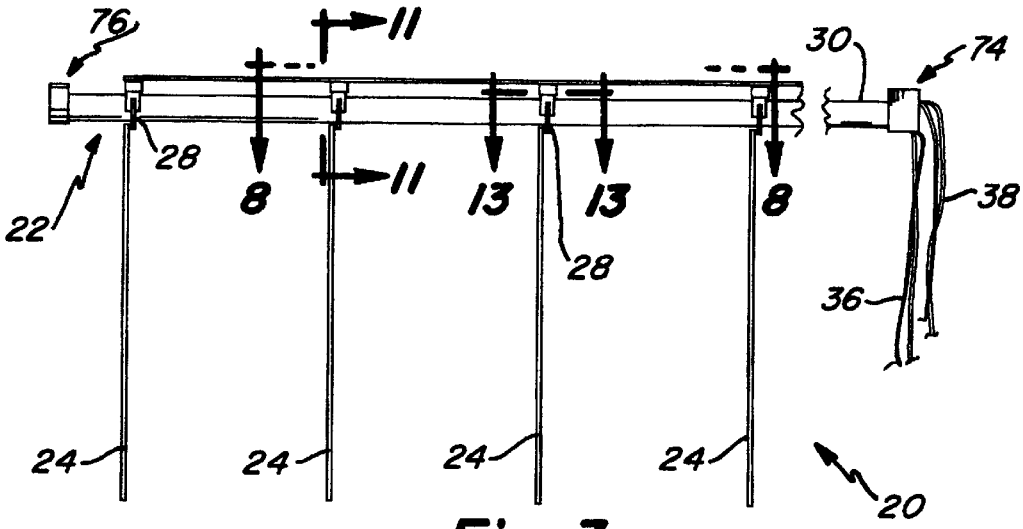
FIG. 3 is a fragmentary front elevation of the covering of FIG. 1 with the vanes extended and in an open position.
Figure 4:
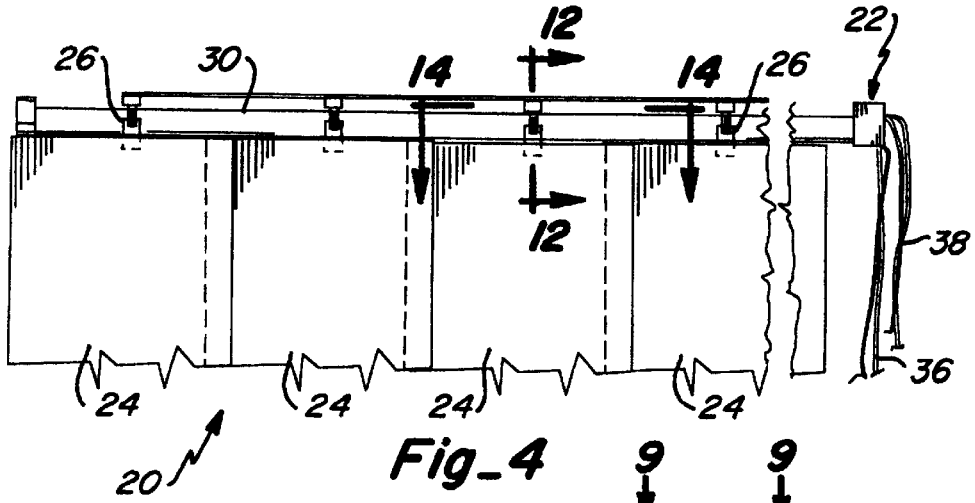
FIG. 4 is a fragmentary front elevation similar to FIG. 3 with the vanes in an expanded and closed position.
Figure 13:
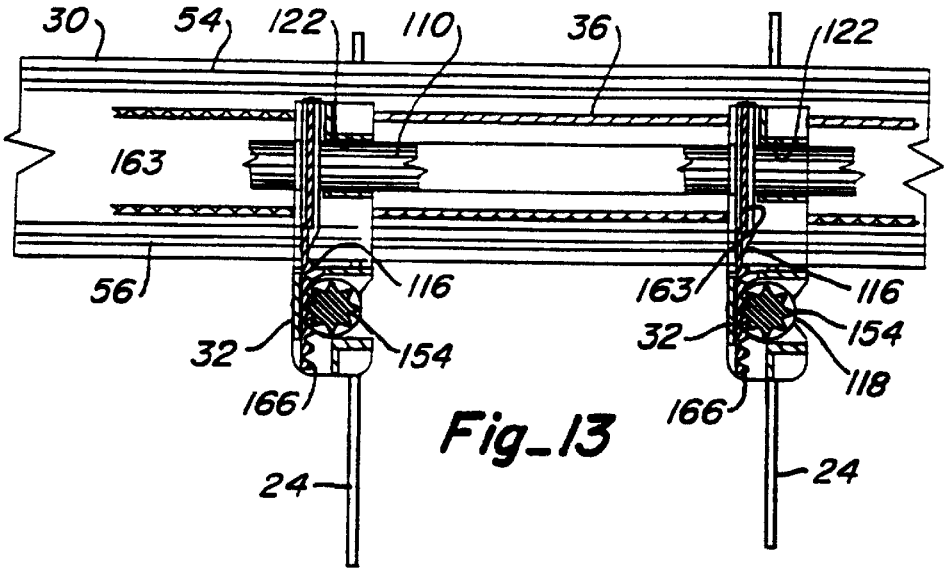
FIG. 13 is an enlarged fragmentary section taken along line 13—13 of FIG. 3.
Figure 14:
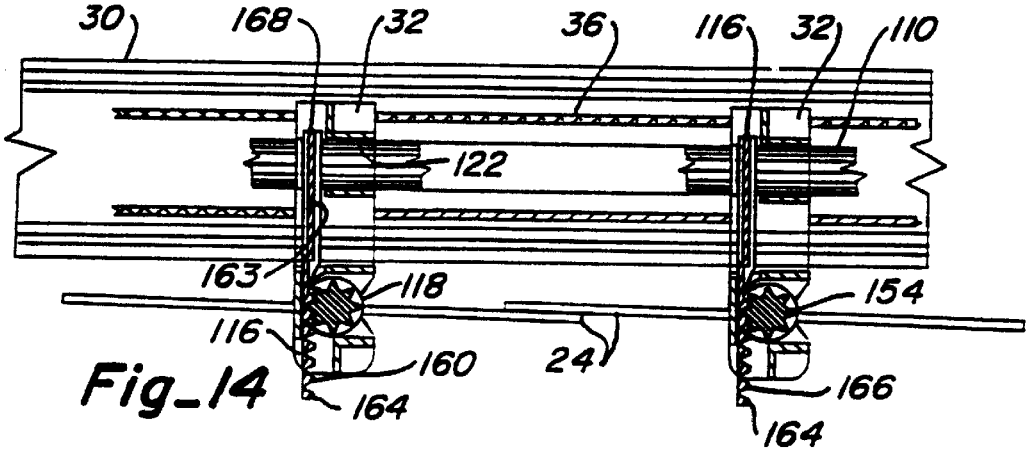
FIG. 14 is an enlarged fragmentary section taken along line 14—14 of FIG. 4.
Figure 15:
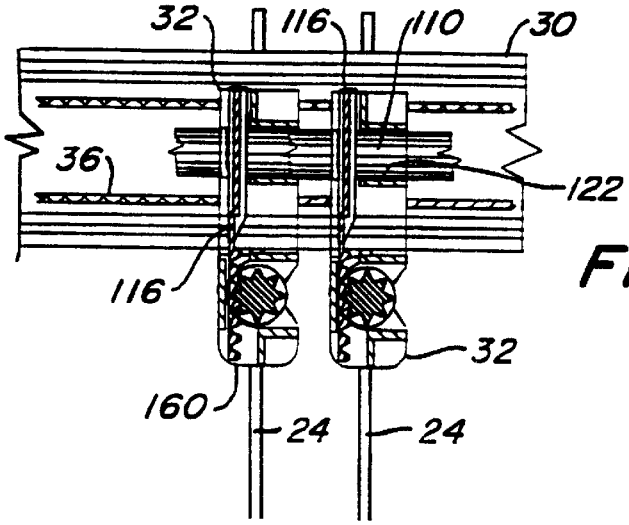
FIG. 15 is an enlarged fragmentary section taken along line 15—15 of FIG. 5.
Figure 19:
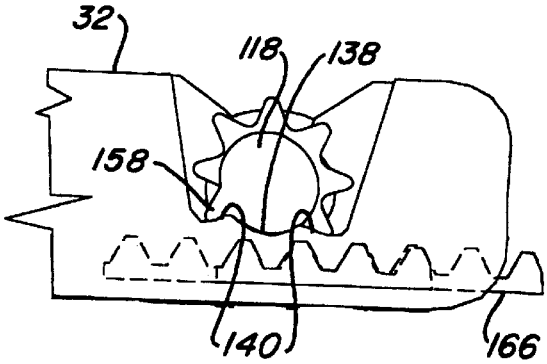
FIG. 19 is a fragmentary top plan showing a portion of FIG. 17 with the carrier pin in an approximately 180° rotated position.

Regardless of the position of the vanes 24 along the length of the headrail 30, motion of the tilt cord 38, which affects rotation of the tilt rod 110, will pivot the vanes 24 through the interaction between the first set of teeth 166 on the rack 116 and the pinion gear 154 on the hanger pins 118. As mentioned previously, however, this motion is limited either by the vanes abutting themselves or by the abutment finger 158 on the top of each hanger pin 118, which when rotated in one direction ultimately abuts one of the stops 140 (FIG. 17) and when rotated in the opposite direction abuts the other stop 140 (FIG. 19). As will be appreciated, and as mentioned previously, this pivotal movement is slightly greater than 180° so that the vanes suspended from the hanger pins are movable through an angle of slightly greater than 180°. The extreme positions of the hanger pins are predetermined relative to the rack so that the vanes are in a closed substantially co-planar overlapping relationship with each other in either extreme position. Movement of the hanger pins 118 through approximately 90°(FIG. 16) from either extreme moves the vanes into their open position as seen in FIGS. 1, 3, and 13 and continued rotation through another 90° causes the abutment finger 158 to engage the opposite stop 140 and again place the vanes in a co-planar overlapping relationship but in a reverse direction.

It should be appreciated from the aforenoted description that the control system is very low in profile with the headrail itself having a dimension no greater than 0.6 inches and the extension of the carrier above the headrail being no more than 0.6 inches. Accordingly, the overall height of the control system is no more than 1.2 inches. In addition, there are no visible slots or openings in the headrail since the only opening faces upwardly and is therefore not visible from the interior of the room in which the system is mounted. Accordingly, a control system has been described which is aesthetically attractive and which provides dependable, smooth, and quiet operation.

Figure 26:
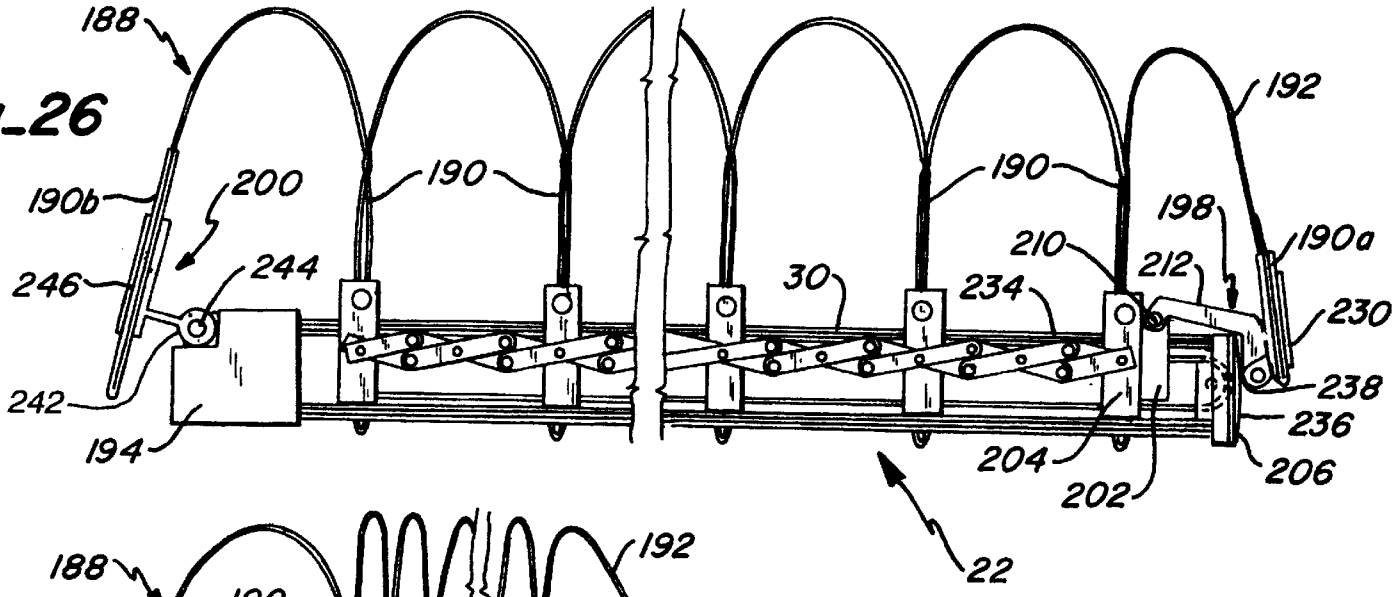
FIG. 26 is a top plan view with portions broken away of the control system of the present invention with hardware for controlling the endmost vanes of a achitectural covering with the covering in an extended and open position.
Figure 27:
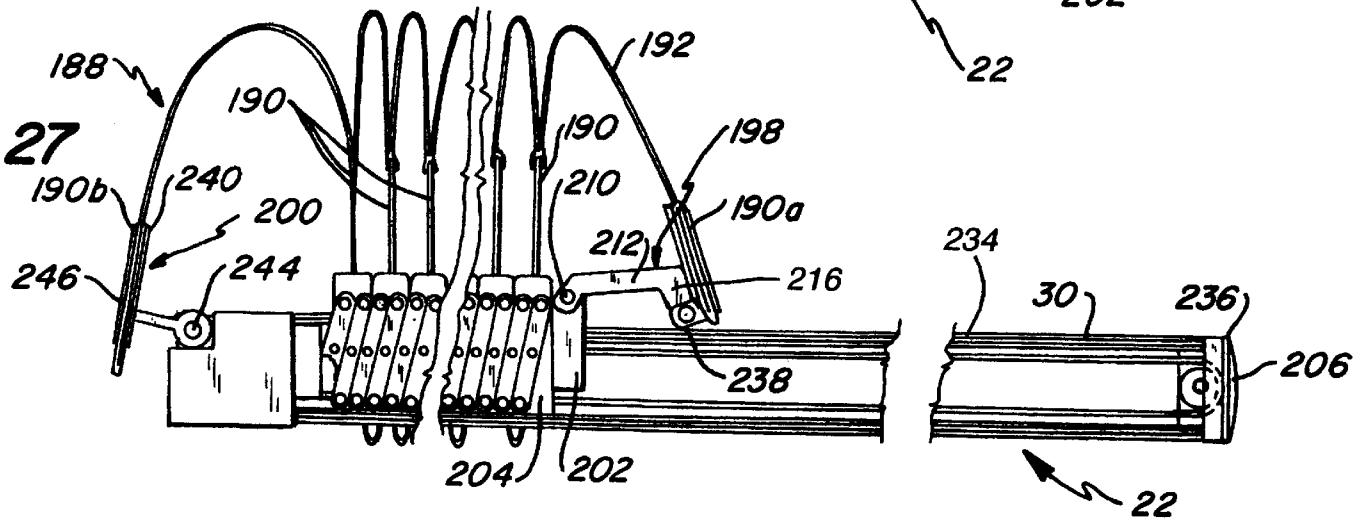
FIG. 27 is a top plan view similar to FIG. 26 with the vanes in a retracted but open position.
Figure 28:
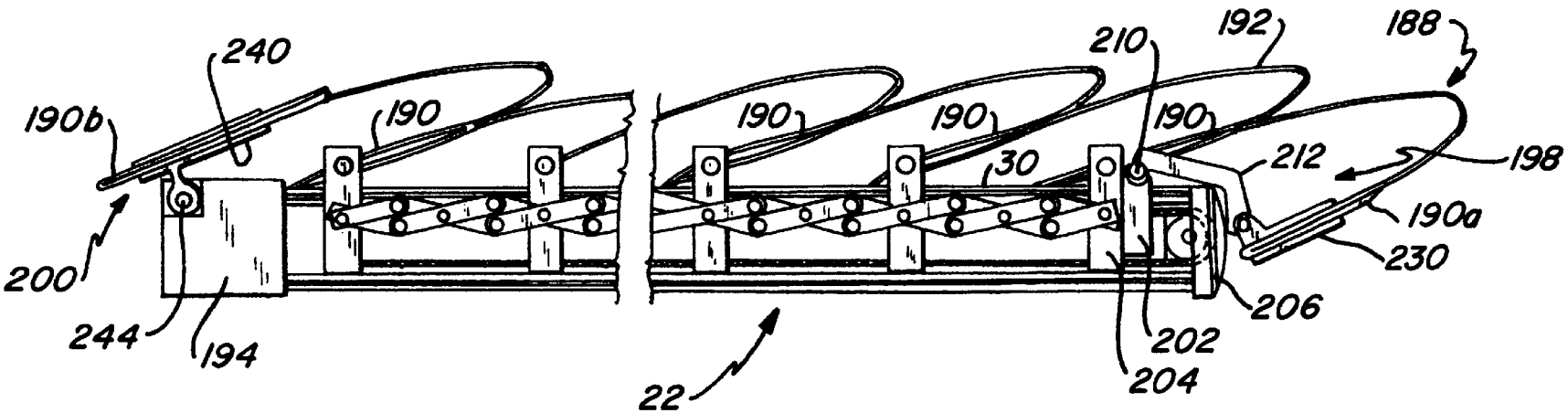
FIG. 28 is a top plan view similar to FIG. 26 with the vanes in an extended but closed position.

FIGS. 26–34 illustrate a control system of the present invention with the addition of auxiliary control elements operatively connected to the endmost vanes in the illustrated window covering 188 and also including a tilt wand 189 (FIG. 33) in place of the previously described tilt cord 38. Further, the window covering 188 is modified relative to that described previously in that the vanes 190 are connected to a continuous face sheet of material 192 such as in accordance with the disclosure in U.S. patent application Ser. No. 08/639,906, filed Apr. 24, 1996 and entitled An Improved Fabric For An Architectural Covering And Method And Apparatus of Manufacturing Same, now U.S. Pat. No. 5,876,545. That patent is commonly owned with the present application and is incorporated herein by reference. It will be appreciated that in accordance with the disclosure in the aforenoted '545 patent and as shown in FIG. 28, there are vanes 190*a* and 190*b* provided at each end of the window covering. These vanes could be full width vanes, equivalent in width to the other vanes used in the covering, or might be narrower if desired. It should also be appreciated that window coverings can be single draw or center draw. Single draw coverings utilize one continuous covering that covers an architectural opening with a free end vane that is moved from one side of the opening to the opposite side. A center draw system has a pair of coverings wherein the free end vanes move toward each other when extending the covering so that they meet at a centered location of the opening and move in opposite directions toward opposite ends of the control system when retracting the covering.

It will be appreciated with the description that follows that the mounting of a fixed end vane 190*b* on the primary end cap 194, where a traverse cord 191 and the tilt wand 189 for the system are located (FIG. 33), would be the same regardless of whether the system is a single draw or center draw. The mounting for the free end vane 190*a*, however, on the moving end of the covering to be described hereafter, is used only in a single draw system.

With specific reference to FIGS. 26–28, it will be appreciated that many of the primary operative components of the modified control system are identical to that previously described in connection with the control system 22 with the exception of the primary end cap wherein the control system has been modified to utilize the tilt wand 189 (FIG. 33) in place of the tilt cord 38. Before describing the systems for mounting the endmost vanes, the modified primary end cap 194 will be described.

Figure 35:
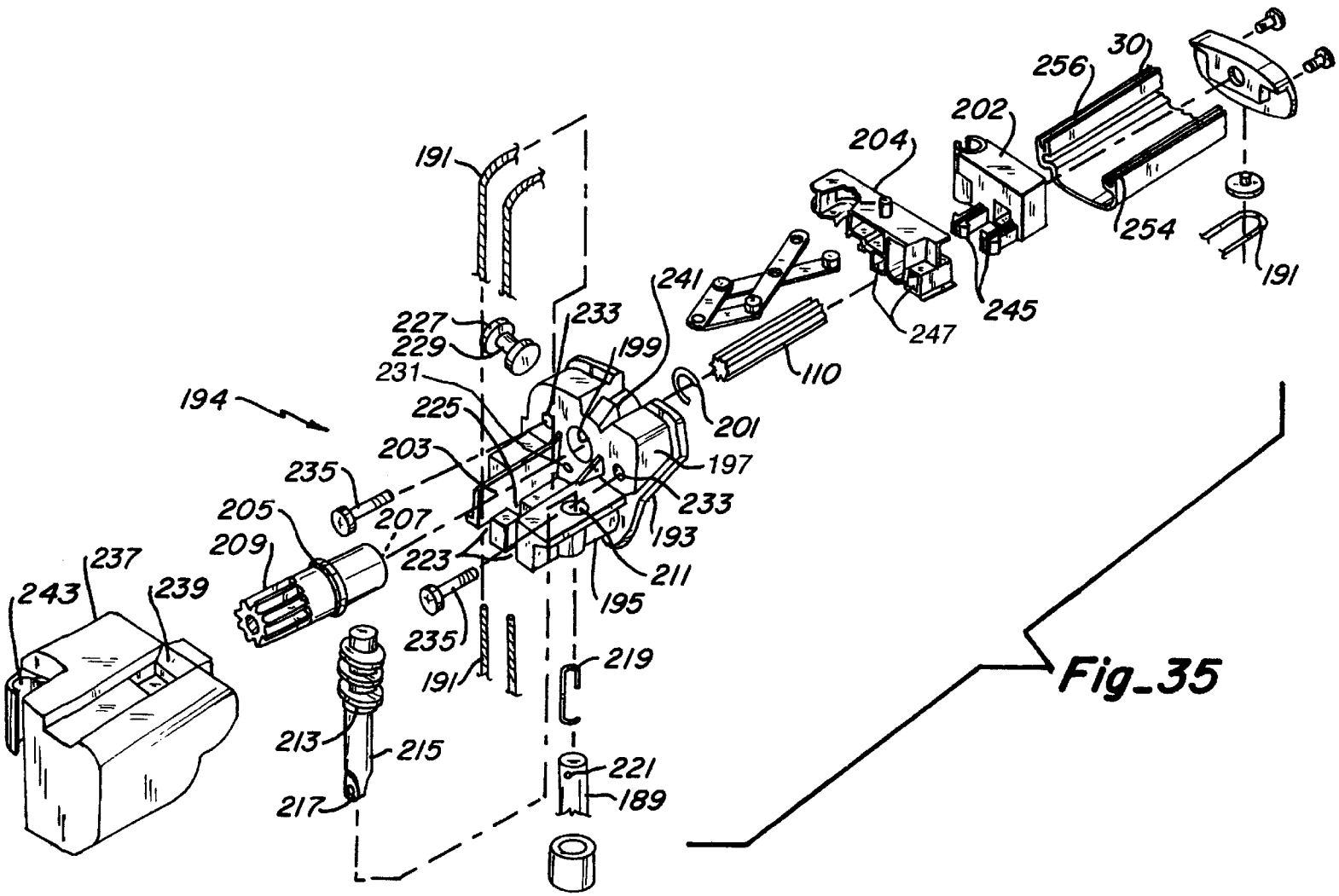
FIG. 35 is an exploded isometric of a first alternative control system having a different primary end cap.
Figure 36:
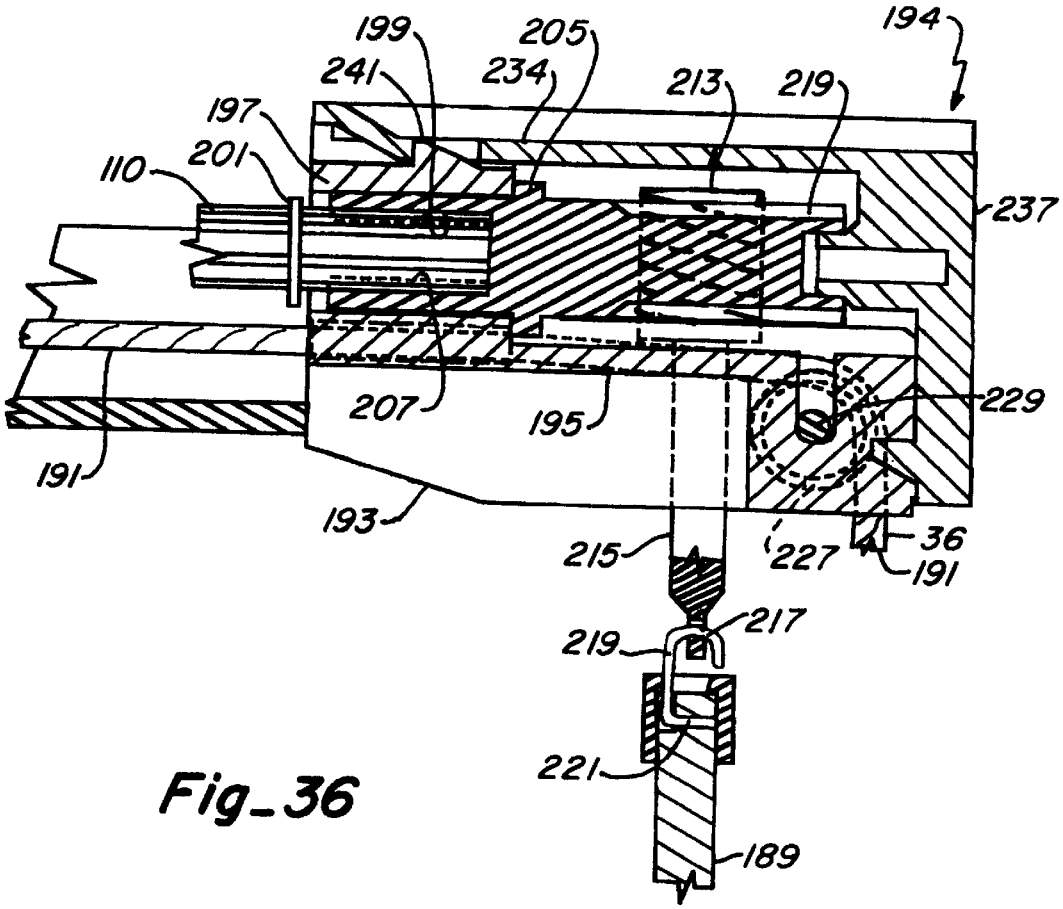
FIG. 36 is an enlarged fragmentary vertical section taken through the primary end cap shown in FIG. 35.

As probably best seen in FIGS. 35 and 36, the primary end cap 194 can be seen to include a main body 193 having a horizontally extending base portion 195 and a vertically extending end plate 197. The end plate has a horizontal passage 199 of cylindrical configuration extending therethrough adapted to rotatably receive and support the end of the tilt rod 110. A C-clip 201 is used in a conventional manner to retain the tilt rod 110 in the cylindrical passage 199.

The base portion 195 of the main body 193 has an upwardly opening horizontal channel 203 defined in alignment with the passage 199 in the end plate that is adapted to rotatably receive and seat a drive collar 205 having a socket 207 in one end with internal teeth. The socket 207 is adapted to receive the associated end of the tilt rod 110 such that the longitudinal teeth on the tilt rod mesh with the internal teeth in the socket. The opposite end of the drive collar 205 defines a pinion gear 209. Immediately adjacent to the channel 203, a vertical passage 211 is provided through the base portion 195 that is adapted to receive a worm gear 213 such that the worm gear operatively engages the pinion gear 209 to transfer rotative motion about the vertical axis of the worm gear to vertical rotative motion of the pinion gear about a horizontal axis. The worm gear 213 is supported in the base portion 195 for rotative movement while retaining alignment of the worm gear with the pinion gear 209. The worm gear has a depending shaft 215 with a transverse connection opening 217 therethrough that is adapted to receive a C-shaped connector pin 219. The opposite end of the connector pin is received in a transverse passage 221 in the upper end of the conventional tilt wand 189 so that rotation of the tilt wand affects rotation of the worm gear 213 and consequently the pinion gear 209 and the tilt rod 110 through their operative connections.

The base portion 195 of the main body 193 further defines a pair of vertical slots 223 in a rear surface thereof and a transverse channel 225 interconnecting the slots for receipt of a pair of pulleys 227 mounted on opposite ends of a support shaft 229. The support shaft is rotatably seated in the transverse channel 225 with the pulleys disposed in their respective slots 223. A traverse cord 191 of the type previously described in connection with the control system 22 (see 36 in FIG. 7) passes over the pulleys 227 and through cord passages 231 provided in the end plate 197. From these passages the traverse cord connects to the operative components of the headrail as previously described in connection with the control system 22.

The end plate 197 also has a pair of fastener openings 233 adapted to slidably receive bolt type fasteners 235 which extend through the openings 233 and are threaded into the ends of the upwardly opening grooves 254 and 256 of the headrail 30. In this manner, the main body of the primary end cap is positively secured to the headrail 30.

A shell 237 having an internal cavity conformed to receive the various components of the main body 193 is adapted to be snapped onto the main body for releasable connection thereto. A snap arm 239 on the shell releasably grabs a catch 241 on the main body to retain the shell in position to thereby cover the working components of the primary end cap.

The primary end cap also has a vertical channel 243 for mounting the fixed end vane 190*b* as will be described in more detail later.

The free end vane 190*a* is connected to the control system with a free end vane mounting system 198 (FIGS. 26 and 27). The opposite end vane or the fixed end vane 190*b* is mounted on the primary end cap 194 with a fixed vane mounting system 200. FIG. 26 shows the window covering with the end vane mounting systems when the covering is both extended and open, while FIG. 27 shows the same window covering in a retracted but open position. FIG. 28 is similar to FIG. 26 but shows the covering in an extended and closed position.

Looking first at the free end mounting system 198 as best seen in FIGS. 29–32 and 35, it will be appreciated that a mounting block 202 has been secured to the endmost carrier 204 of the control system 22. The endmost carrier and mounting block are shown disposed adjacent to the secondary end cap 206 of the headrail which, as will be appreciated with the description that follows, cooperates with the free end vane mounting system to move the free end vane 190*a* from a position in front of the headrail 30, like the remaining vanes 190 in the covering, to a position at the secondary end of the headrail and in longitudinal alignment therewith when the window covering is fully extended.

The mounting block 202 is connected to the endmost carrier 204 by two pairs of snap fingers 245 (FIG. 35) on the mounting block 202 that are releasably received in associated channels 247 formed in the endmost carrier 204. The mounting block 202 has a vertical substantially C-shaped channel 208 (FIG. 29) formed in the front edge thereof defining a bearing which receives a hollow pivot shaft 210 on the end of a pivot arm 212. The C-shaped configuration of the channel retains the pivot shaft of the pivot arm for pivotal movement within the channel. The pivot arm is substantially J-shaped in cross section having a base leg 214, an end leg 216, and an upstanding lip 218 (FIG. 31) which defines the pivot shaft. The end leg 216 has a pair of vertically extending pivot pins 220 (FIG. 29) that project upwardly and downwardly from the top and bottom edges thereof with the pivot pins pivotally receiving corresponding sleeves 222 on the back face of a vane mounting plate 224.

Figure 29:
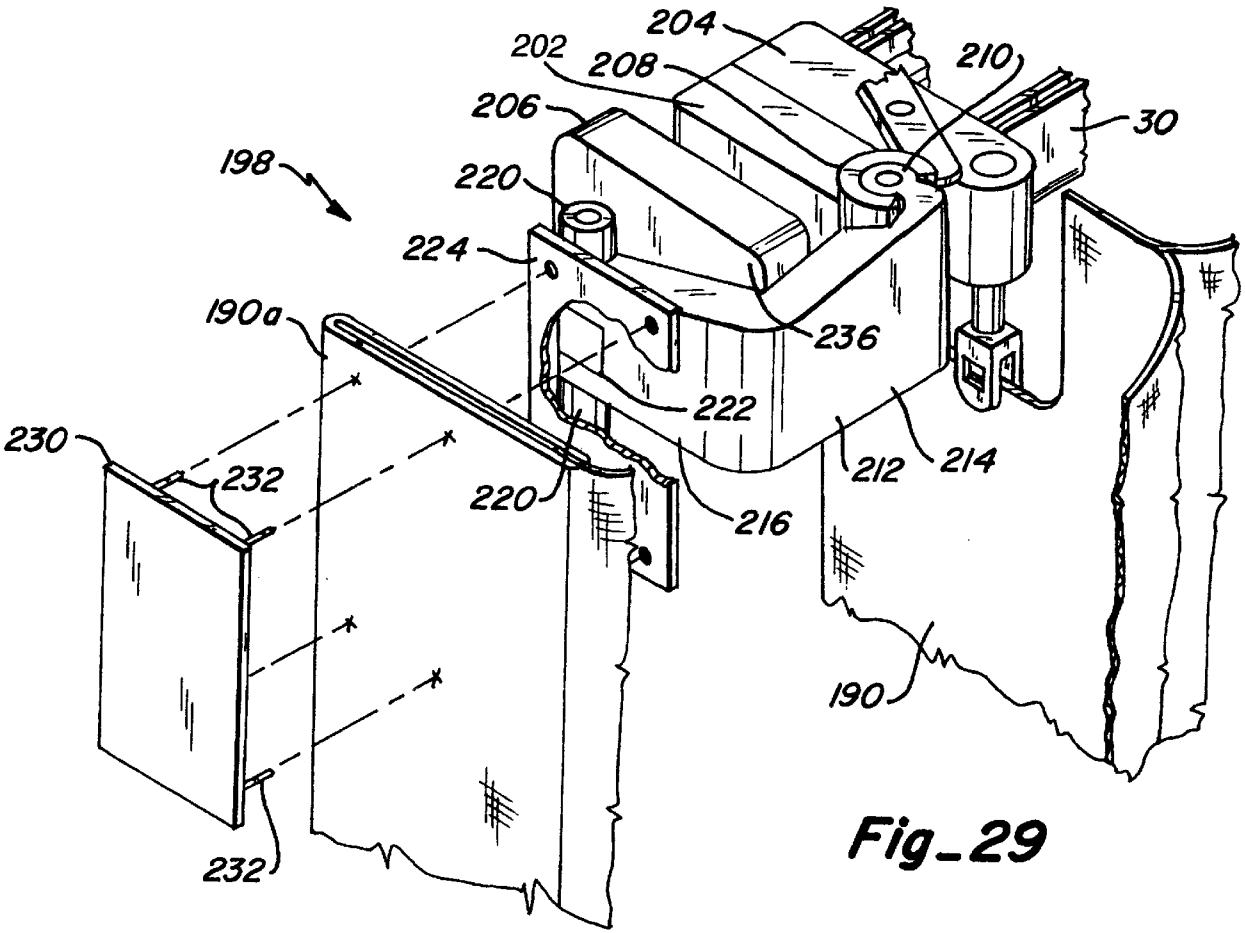
FIG. 29 is an enlarged fragmentary partially exploded isometric showing the end vane hardware for the free end of a single draw covering.
Figure 30:
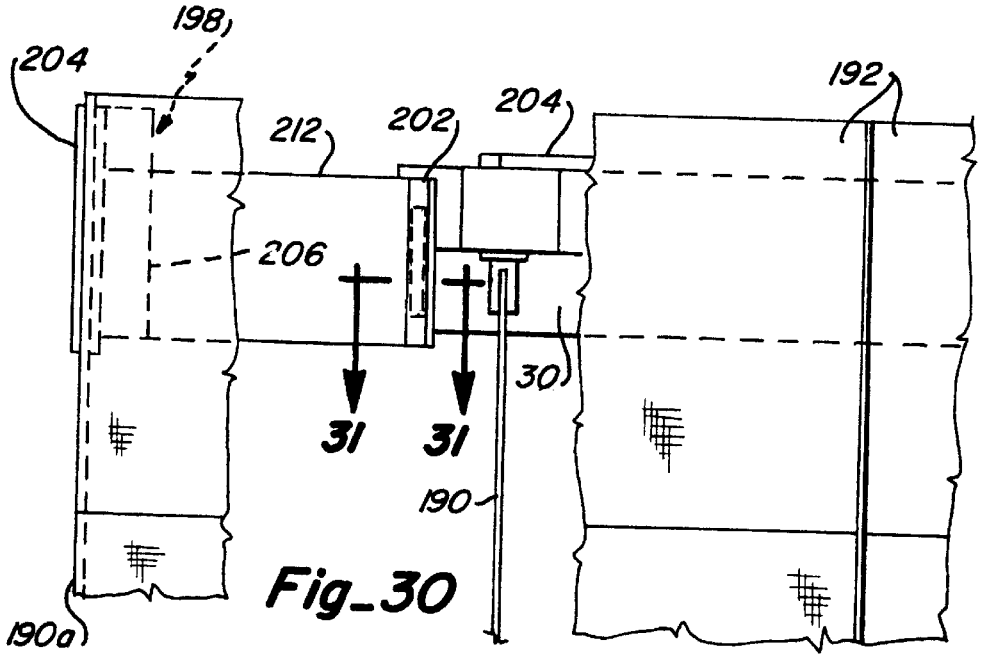
FIG. 30 is a fragmentary front elevation with portions removed of the hardware shown in FIG. 29.
Figure 31:
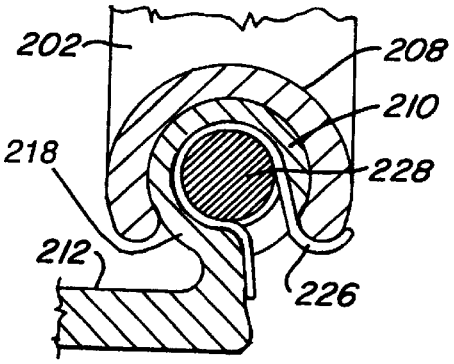
FIG. 31 is an enlarged section taken along line 31—31 of FIG. 30.
Figure 32:
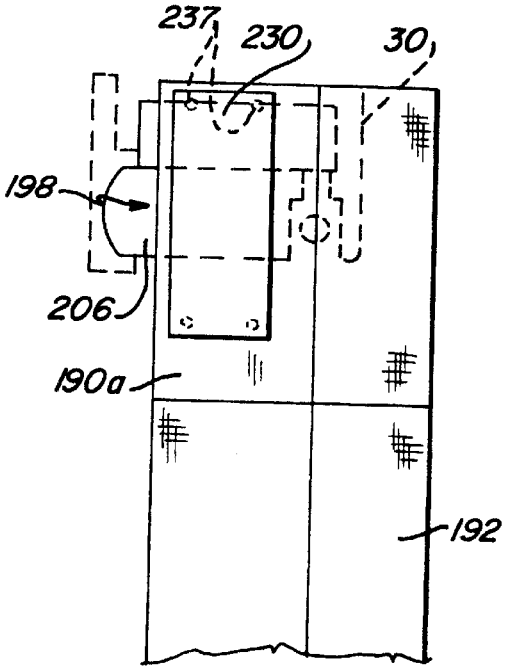
FIG. 32 is a left end elevation of the system as shown in FIG. 30.
Figure 33:
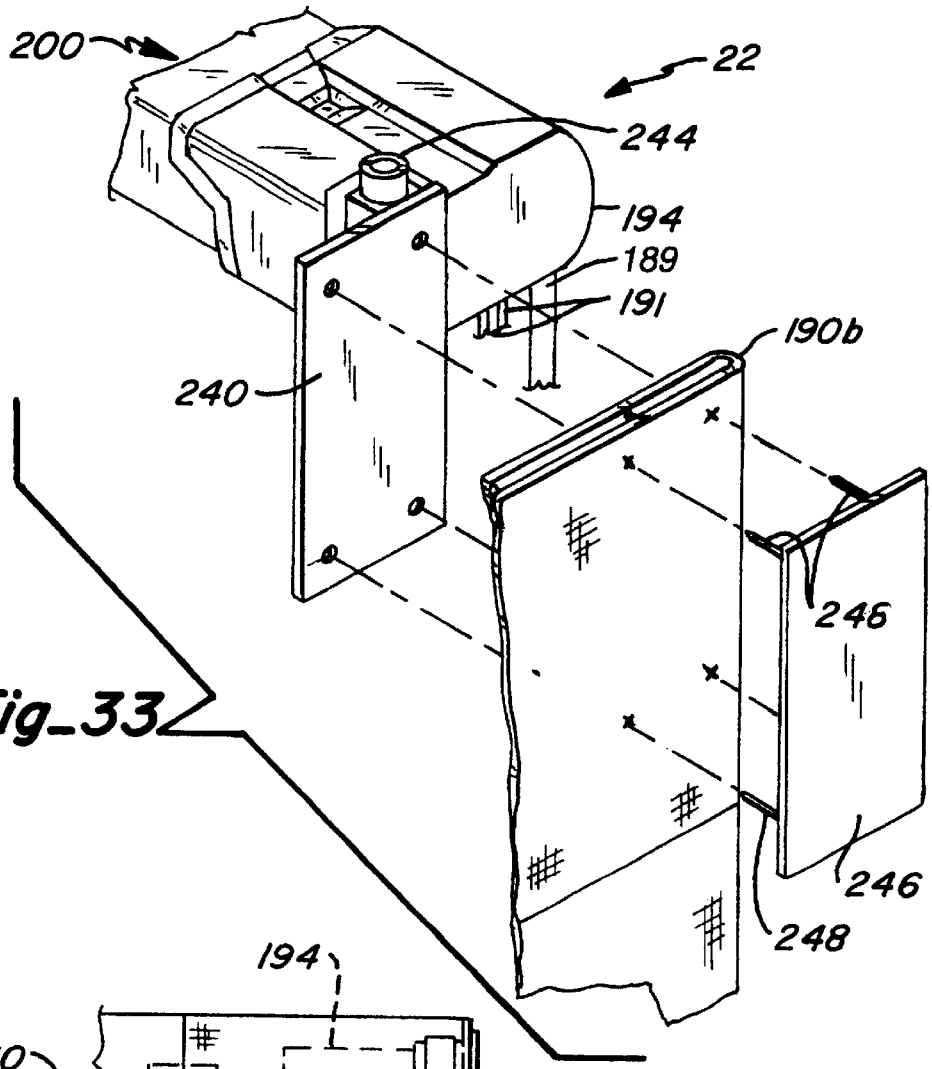
FIG. 33 is an enlarged fragmentary partially exploded isometric showing the control end of the control system showing the system for mounting the endmost vane.
Figure 34:
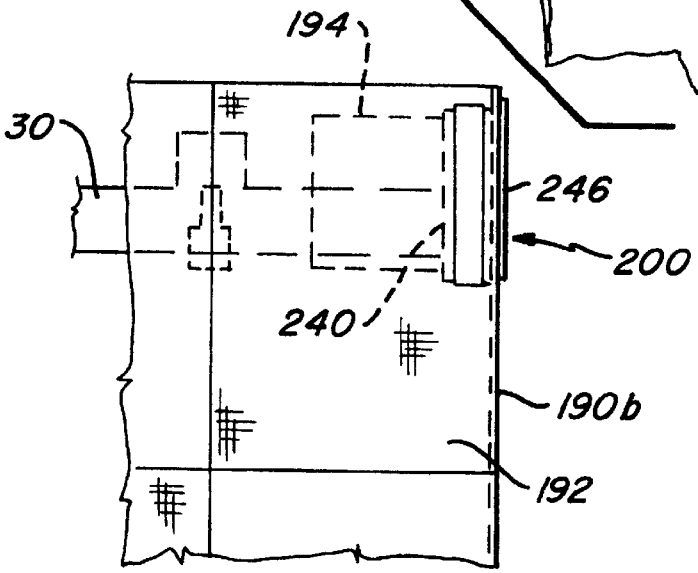
FIG. 34 is a fragmentary front elevation of the control system as shown in FIG. 33.

The pivot arm 212 is biased in a clockwise direction, as viewed in FIGS. 29 and 31, by a torsion spring 226 (FIG. 31) that partially circumscribes a pivot pin 228 within the hollow pivot shaft 210 of the pivot arm. One end of the torsion spring engages the mounting block 202 and the opposite end engages the pivot arm 212.

The vane mounting plate 224 cooperates with an attachment plate 230 to secure the free end vane 190*a* therebetween. The attachment plate 230 has a plurality of connectors in the form of sharpened prongs 232 that are adapted to penetrate the vane and subsequently be riveted or otherwise secured to the vane mounting plate 224 to secure the vane between the plates.

In operation, as probably best illustrated by reference to FIGS. 26 and 27, when the covering 188 is retracted adjacent to the primary end cap 194, the end leg 216 of the pivot arm 212 is biased against the front 234 of the headrail 30 by the torsion spring 226, thereby holding the free end vane 190*a* adjacent the front of the headrail. When the covering is being extended, the free end vane is moved toward a secondary end cap 206 at the opposite end of the headrail. The end leg 216 of the pivot arm 212 has a guide surface 238 on the terminal end thereof which slides along the front of the headrail until it reaches the secondary end cap at which time the end leg of the pivot arm is urged around the secondary end cap 206 by the torsion spring 226 into the position illustrated in FIG. 26. It will be appreciated in the extended position of the covering 188, that the free end vane 190*a* is pulled around the end of the headrail 30 in longitudinal alignment therewith to help conceal the headrail and provide an aesthetically attractive end of the covering, which also establishes privacy.

When the covering 188 is moved toward its retracted position from its extended position of FIG. 26, the guide surface 238 on the end leg 216 of the pivot arm 212 is cammed by and rides along the secondary end cap 206 against the bias of the torsion spring 226 until the guide surface engages and is pulled onto the front 234 of the headrail so that the covering can be moved to the retracted position of FIG. 27.

The control end of the control system, at the primary end cap 194, as best illustrated in FIGS. 26–28 and 33–36, has a fixed vane mounting plate 240 with a pair of vertically spaced sleeves 242 pivotally mounted on the upper and lower ends of a pivot shaft 244 received in the vertical channel 243 defined in the shell 237 of the primary end cap 194. The pivot shaft 244 thereby pivotally supports the mounting plate 240 for movement about a vertical axis. An attachment plate 246, having connectors in the form of sharpened prongs 248 adapted to pierce the fixed end vane 190*b*, is operatively connected to the mounting plate 240 as by riveting, sonically welding, or otherwise so as to positively secure the fixed end vane between the plates 240 and 246.

The fixed vane mounting plate 240 is freely pivotal on the pivot shaft 244 so as to be movable under the influence of the face sheet material 192 which is connected to the fixed end vane 190*b*.

With specific reference to FIGS. 26 and 28, it will be appreciated in FIG. 26 that when the vanes 190 are in an open position, i.e., perpendicular to the headrail 30, the face sheet material 192 that is connected to the vanes is looped in a direction also perpendicular to the headrail thereby forcing the fixed end vane 190*b* to pivot about its pivotal connection to the primary end cap 194 into a position where it overlies the end of the primary end cap in longitudinal alignment with the headrail and extends substantially perpendicularly to the headrail. However, when the vanes are moved from their open to their closed position illustrated in FIG. 28, the face sheet material 192 pulls the fixed end vane forcing it to pivot about its pivotal connection so that the vane lies somewhat parallel to the front of the headrail in parallel alignment with the other vanes in the covering.

It will therefore be appreciated from the above description that by providing mounting systems as described for the endmost vanes in the covering that the ends of the headrail can be covered when desired and the endmost vanes are also pivotally mounted for movement with the remainder of the vanes in the covering. The system thereby provides an aesthetically attractive way of connecting the endmost vanes to the operating system in a relatively inexpensive but efficient manner while also establishing privacy at the ends of the covering.

Figure 37:
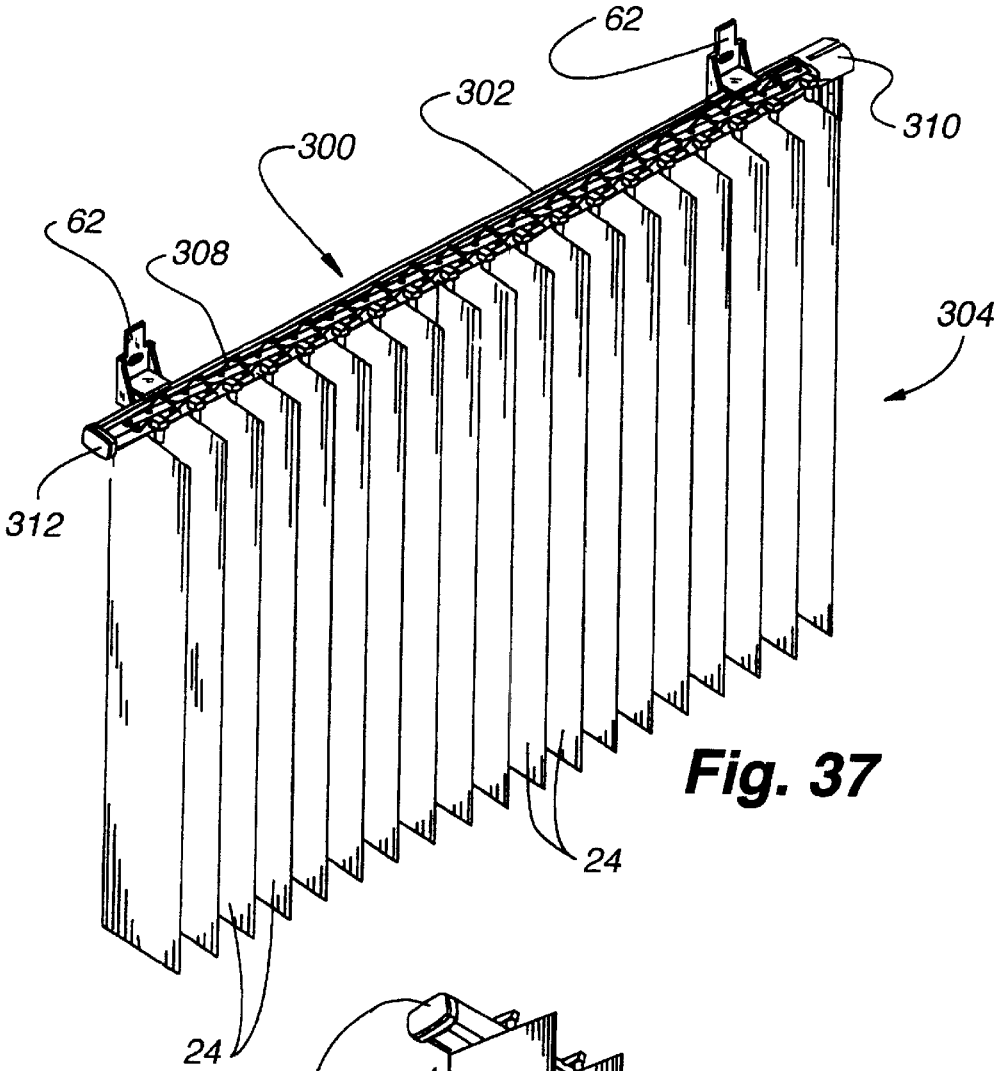
FIG. 37 is most similar to FIG. 1 and is an isometric view looking downwardly on a second alternative control system of the present invention, having a secondary end cap according to a first embodiment.

FIGS. 37–131 relate to a second alternative control system 300 according to the present invention, including a variety of different components for controlling the longitudinal position of the vanes 24 along the headrail 302 as well as the angular orientation of the vanes 24 about their longitudinal vertical axes. Although this alternative control system 300 is described primarily in connection with a single draw covering (e.g., FIG. 37), it could also be used in connection with a double draw covering as described more fully below in connection with FIGS. 128, 129, and 131.

Figure 38:
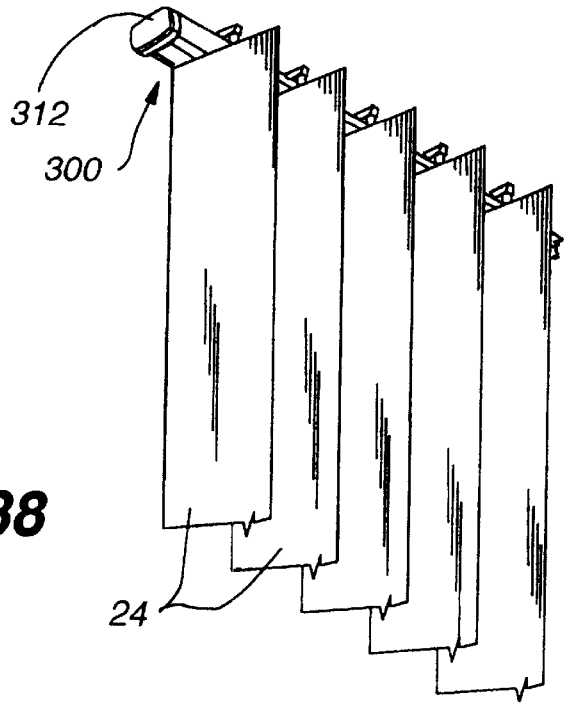
FIG. 38 is most similar to FIG. 2 and is a fragmentary isometric view looking upwardly at the covering and showing the first embodiment of the secondary end cap in the second alternative control system of the present invention.
Figure 37A:
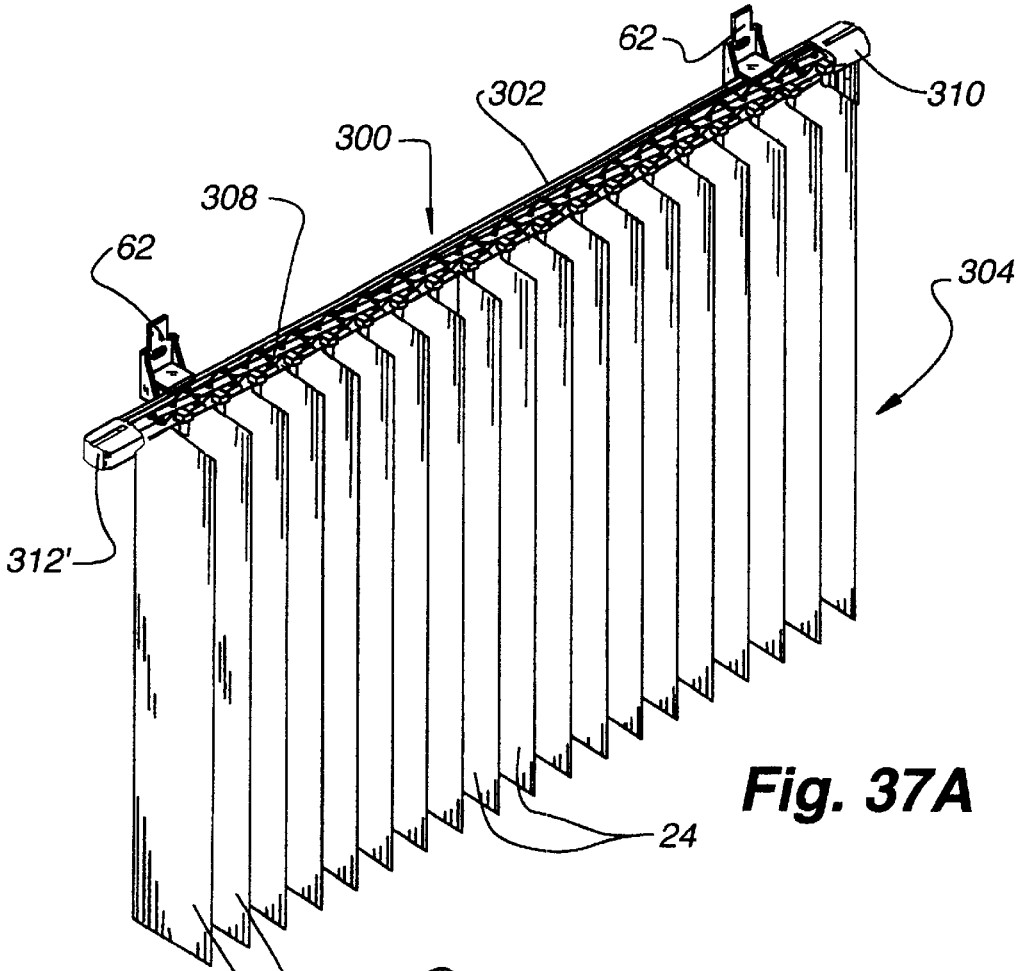
FIG. 37A is similar to FIG. 37, but depicts a secondary end cap according to a second embodiment.
Figure 38A:
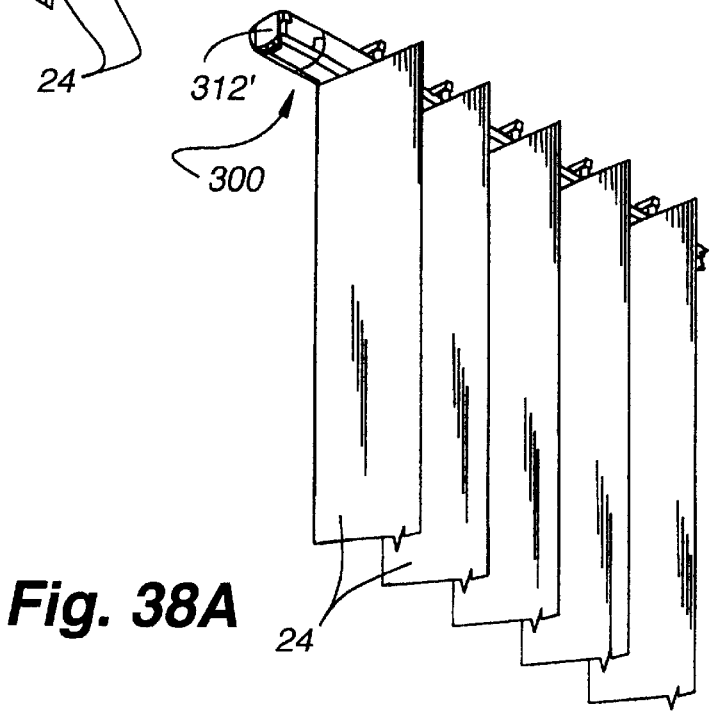
FIG. 38A is similar to FIG. 38, but depicts the second embodiment of the secondary end cap that is also depicted in FIG. 37A.

FIGS. 37, 37A, 38, and 38A are most similar to FIGS. 1 and 2. FIG. 37 is an isometric view looking downwardly at a covering 304 for an architectural opening including the second alternative control system 300. In FIG. 37, mounting brackets 62 like those shown in FIG. 1 are used to attach the headrail 302 to a mounting or supporting surface 306 (e.g., FIG. 75). The control system 300 includes a linkage or pantograph 308 that is operatively connected to a plurality of vertical vanes 24. As disclosed previously in connection with the other embodiments, the control system 300 allows adjustment of the longitudinal position of the vanes 24 along the headrail 302 as well as the angular position of the vanes 24 about their longitudinal, vertical axes 377 (FIG. 44) or a parallel axis adjacent thereto (e.g., 376 in FIG. 44). In the embodiment depicted in FIGS. 37 and 38, the primary end cap 310 is shown connected to the right-hand end of the headrail 302. At the left end of the headrail 302 is the secondary end cap 312 according to a first form. The first form of the secondary end cap 312 is described further below in connection FIGS. 120A, 120B, and 121. FIG. 38 is a fragmentary isometric view of the covering 304 depicted in FIG. 37 looking upwardly at the end of the covering 304 to which the secondary end cap 312 is attached. FIG. 37A corresponds to FIG. 37, and FIG. 38A corresponds to FIG. 38. In FIGS. 37A and 38A, however, the secondary end cap 312' is shown in a second preferred form. As will be discussed further below in connection with FIG. 40A, the components that make up the primary end cap 310 may be configured to serve as the secondary end cap 312' in its second preferred form.

Figure 39:
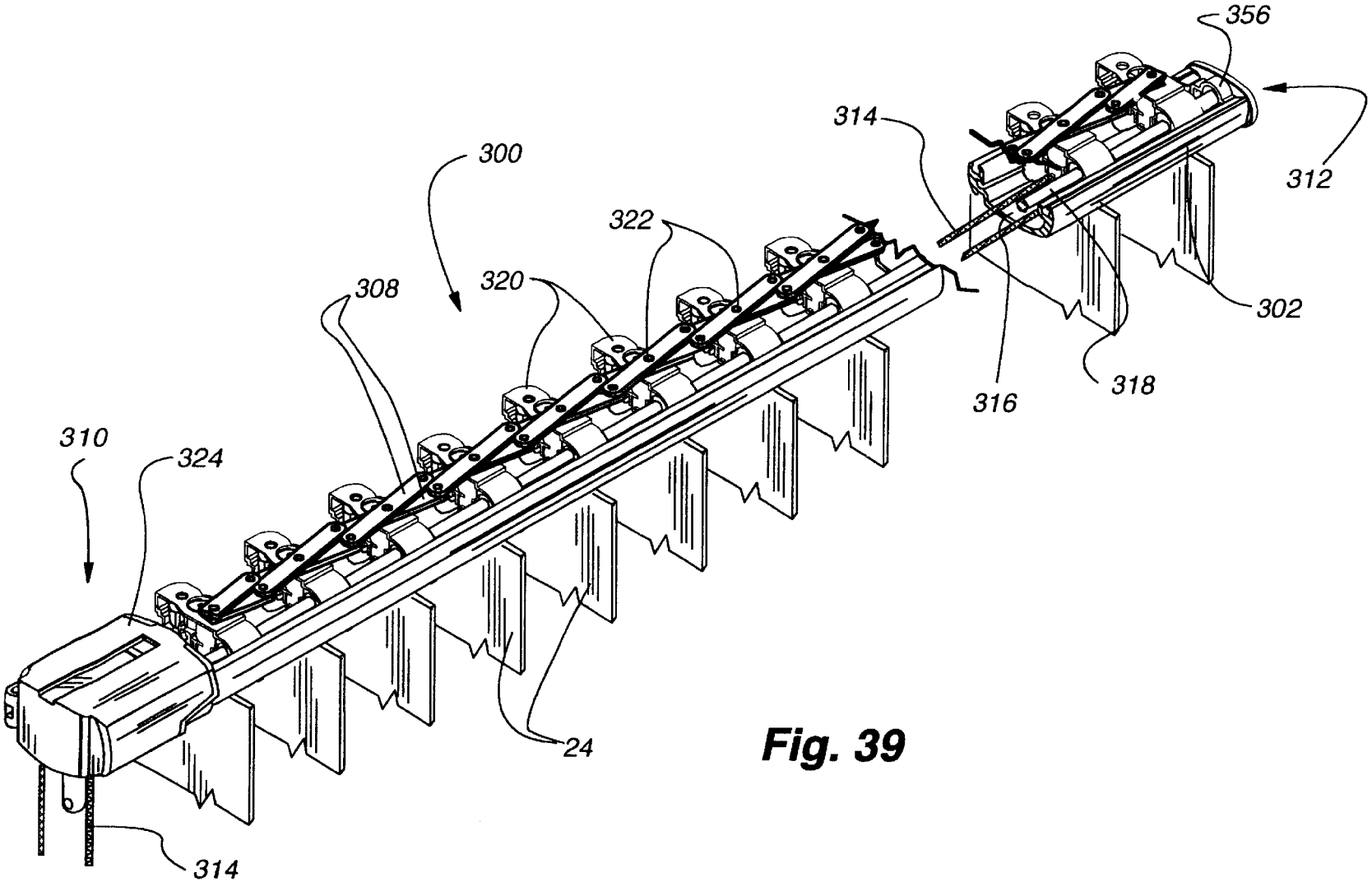
FIG. 39 is an enlarged isometric, fragmentary view of the control system depicted in FIGS. 37 and 38 from a rear side of the window covering.
Figure 39A:
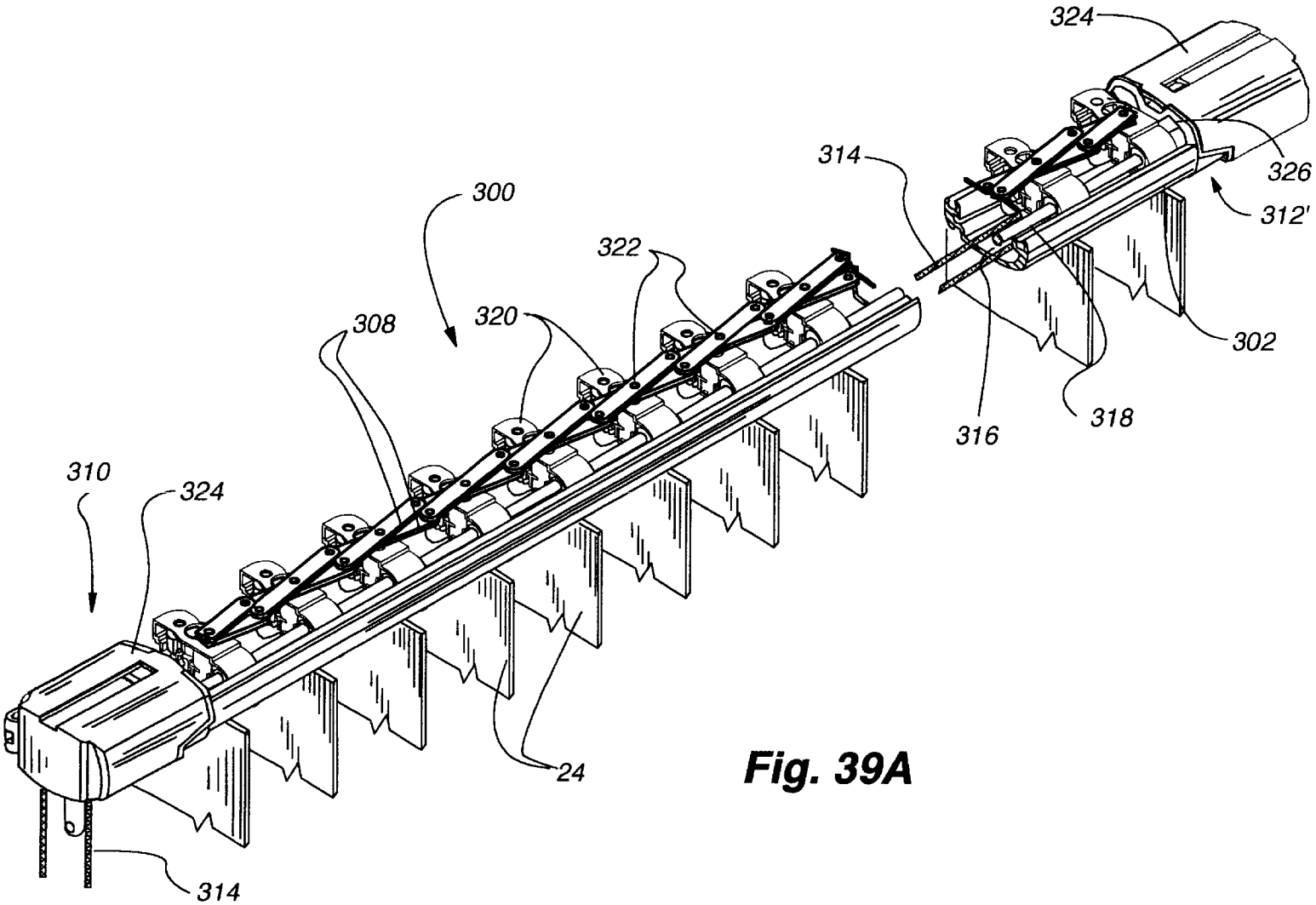
FIG. 39A is an enlarged isometric, fragmentary view of the control system depicted in FIGS. 37A and 38A from a rear side of the window covering.

FIGS. 39 and 39A compare most directly with FIG. 6 of the first preferred embodiment. FIG. 39 is an enlarged, fragmentary, isometric view of the covering depicted in FIGS. 37 and 38. As shown in FIG. 39, traverse cords 314 are routed through the primary end cap 310 and along a bottom surface 316 of the headrail 302 while straddling a tilt rod 318. The path that the traverse cord 314 takes through the primary end cap 310 will be described further below, for example, in connection with FIGS. 52–60A. As was the case with the embodiment shown in FIG. 6, carriers 320 are longitudinally distributed along the headrail 302 by interconnected links 308, which are attached to centrally-located upstanding cylindrical pins 322 extending from the top of the carriers 320. FIG. 39A corresponds to FIG. 39, but depicts the secondary end cap 312' in its second form, which is a modified version of a primary end cap 310.

Figure 40:
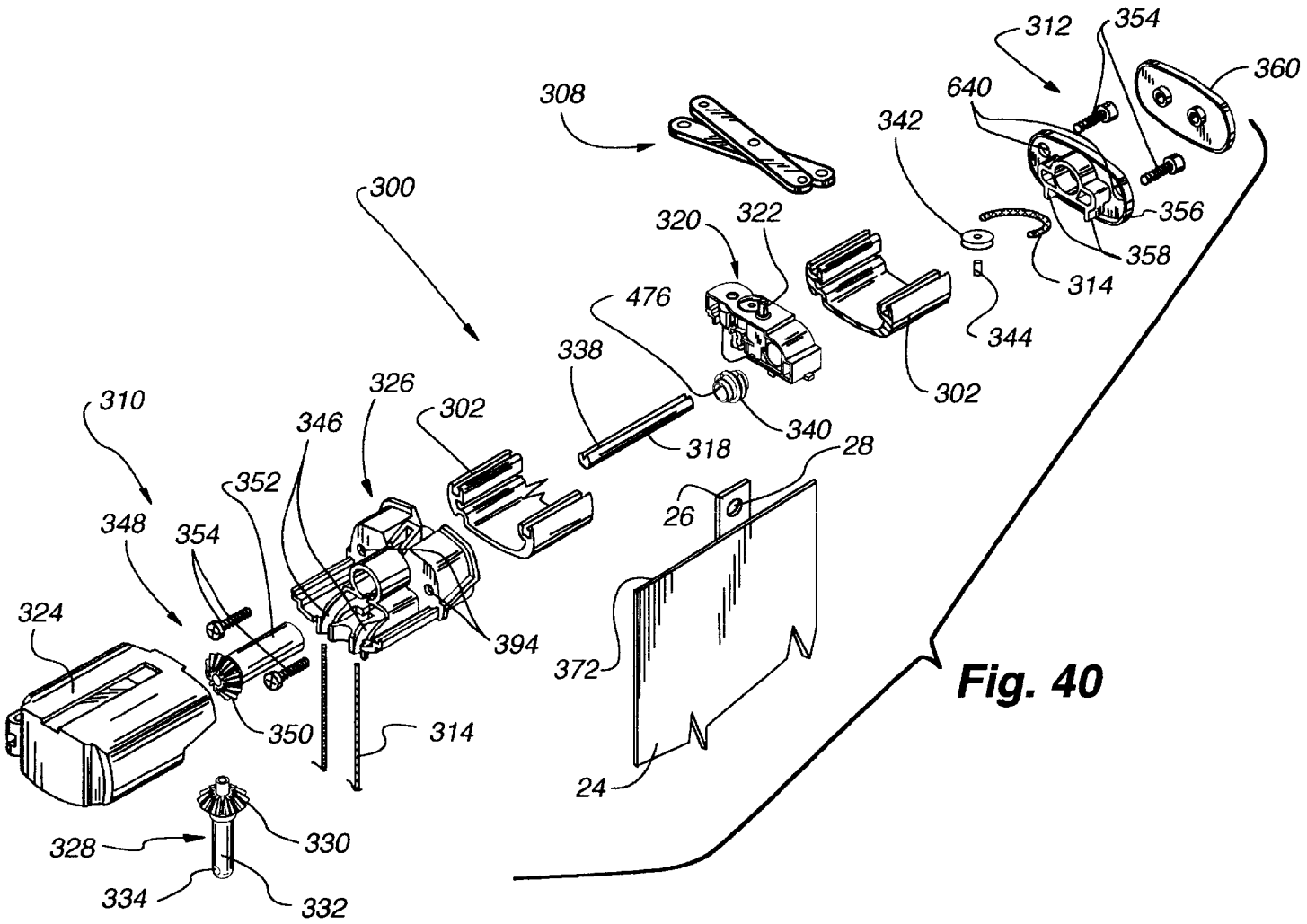
FIG. 40 is similar to FIGS. 7 and 35, and is a fragmentary, explode isometric view depicting various components of the control system depicted in FIG. 39.
Figure 40A:
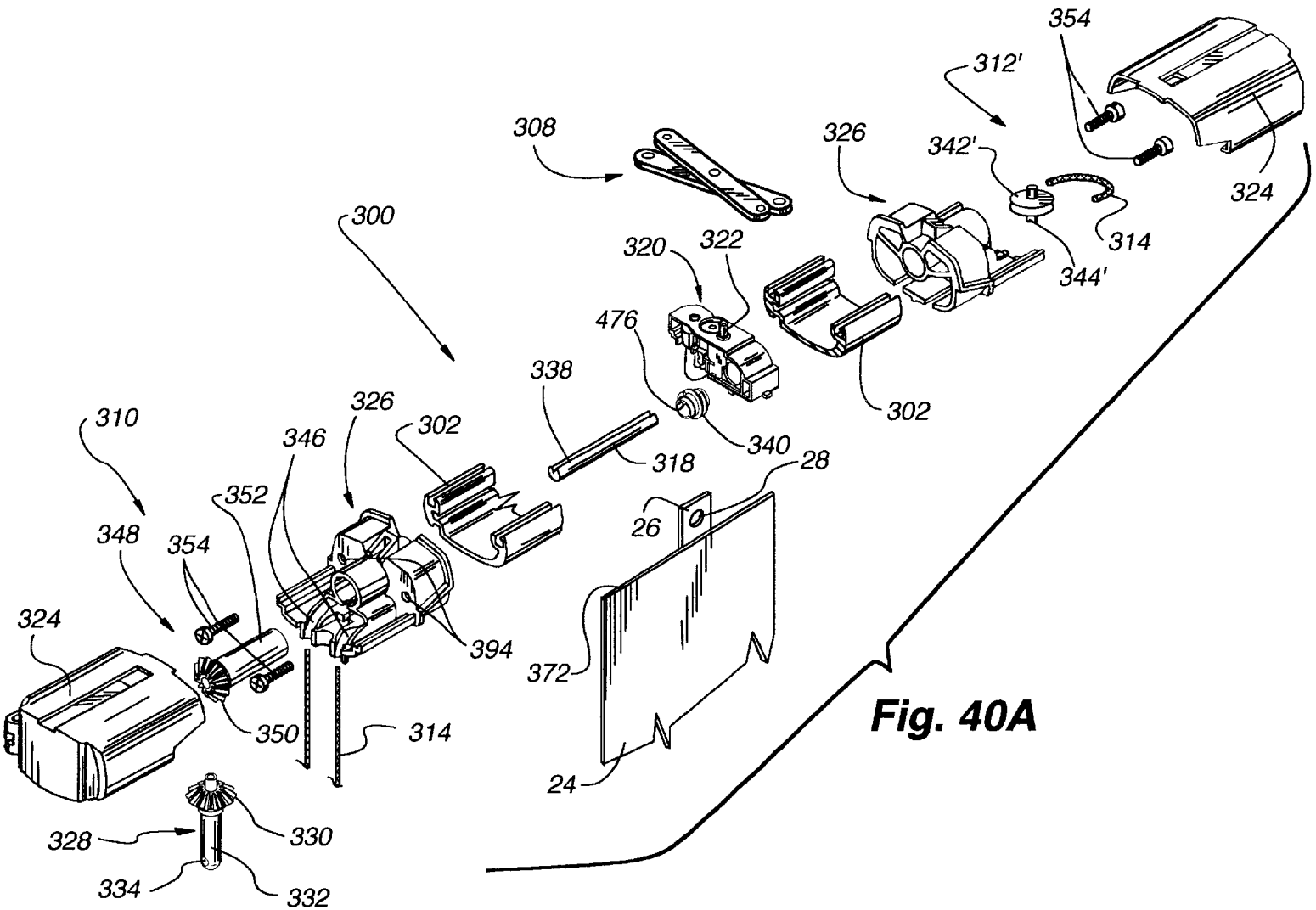
FIG. 40A is similar to FIGS. 7 and 35, and is a fragmentary, exploded isometric view depicting various components of the control system depicted in FIG. 39.

FIGS. 40 and 40A correspond most directly with FIG. 7, which is the first preferred embodiment of the control system 22 according to the present invention, and FIG. 35, which is a first alternative control system according to the present invention. FIG. 40 is an exploded, fragmentary, isometric view of several components comprising part of the second alternative control system 300. The shell 324 for the primary end cap 310, depicted in the lower left portion of FIG. 40 is similar to the shell 237 depicted in FIG. 35. The main body 326 for the primary end cap 310 depicted in FIG. 40 is, however, different from the main body 193 depicted in FIG. 35. For example, comparing the main body 326 of FIG. 40 to the main body 193 of FIG. 35, the main body 326 has been simplified by adding a pair of arcuate cord troughs 346, making the pulleys 227 (FIG. 35) obsolete. Details concerning the new main body 326 are described further below in connection with FIGS. 52–60A.

Also, the drive system housed within the primary end cap 310 for rotating the tilt rod 318 has also been changed. In particular, the tilt rod drive system of the second alternative control system 300 includes a tilt wand drive gear 328 (FIG. 40), having a first bevel gear 330 and a depending drive shaft 332 interconnected therewith, and a tilt rod drive gear 348, having a second bevel gear 350 and a cylindrical drive collar 352 interconnected therewith. At the lowest distal end of the depending drive shaft 332 is a transverse connection opening 334 similar to the transverse connection opening 217 depicted in FIG. 35. As will be described farther below in connection with FIGS. 50 and 50A, the transverse connection opening 334 in the depending drive shaft 332 is used to removably affix a tilt wand 336 (e.g., FIGS. 44 and 50) to the tilt wand drive gear 328. The main body 326 is removably affixed to the headrail 302 by a pair of screw-type fasteners 354 (FIG. 40).

Moving rightward in FIG. 40, the headrail 302 in the second alternative control system 300 has also been improved. These improvements will be described more fully in the discussion of FIGS. 75 and 76. The tilt rod 110 depicted in FIGS. 7 and 35 has been replaced with the new, simplified tilt rod 318, a portion of which is depicted in FIG. 40. The new tilt rod 318, which may still be maintained in position by a C-clip 201 (FIG. 35), includes a single longitudinal groove 338 that interconnects the tilt rod drive system in the primary end cap 310 with the vane drive system described more fully below. The improved tilt rod 318 and vane drive system combination more evenly distributes the twisting load on the tilt rod 318 across its length or longitudinal axis. This provides a mechanical advantage since angular distortion of the tilt rod 318 along its longitudinal axis is reduced, making it easier to ensure that the angular position of the vanes 24 is consistent across the covering 304. Rather than twisting the tilt rod 318 from one end, the tilt rod 318 is effectively twisted or rotated at each carrier 320. A worm gear 340 that is slid onto the tilt rod 318 and snapped into a carrier 320 is shown in FIG. 40. This worm gear 340 is shown to better advantage in FIG. 79 and will be described further below in connection with FIGS. 75, 76, 78, and 79. The vane 24 has the reinforcing tab 26 and opening 28 as before.

Also depicted in FIG. 40 is an idler pulley 342 and its mounting pin 344. The traverse cord 314 passes around this idler pulley 342 before returning to the primary end cap 310. Mounting of the idler pulley 342 in the first form of the secondary end cap 312 is described farther below in connection with FIGS. 120A, 120B, and 121. The main body 356 of the secondary end cap 312 includes a pair of traverse cord alignment plates 358 and is removably affixed to the headrail 302 by more screw-type fasteners 354. Finally, a cover plate 360 is snappingly and removably attached to the main body 356 of the secondary end cap 312 as described below in connection with FIGS. 120A, 120B, and 121.

FIG. 40A is the same as 40 except for the secondary end cap. In FIG. 40A, the second form of the secondary end cap 312' according to the second alternative control system 300 is depicted in exploded form. In this configuration, an idler pulley 342' is mounted on a mounting pin 344' in a pulley pocket 362 (e.g., FIGS. 53 and 56) in the outside end of the main body 326 that is being used as part of the secondary end cap 312' in this form. The pulley pocket 362, which receives and retains the idler pulley 342' in this configuration, is described below. The remaining discussion of the second alternative control system 300 according to the present invention focuses on the embodiment depicted in FIGS. 37, 38, 39, and 40, as opposed to the embodiment depicted in FIGS. 37A, 38A, 39A, and 40A.

Figure 41:
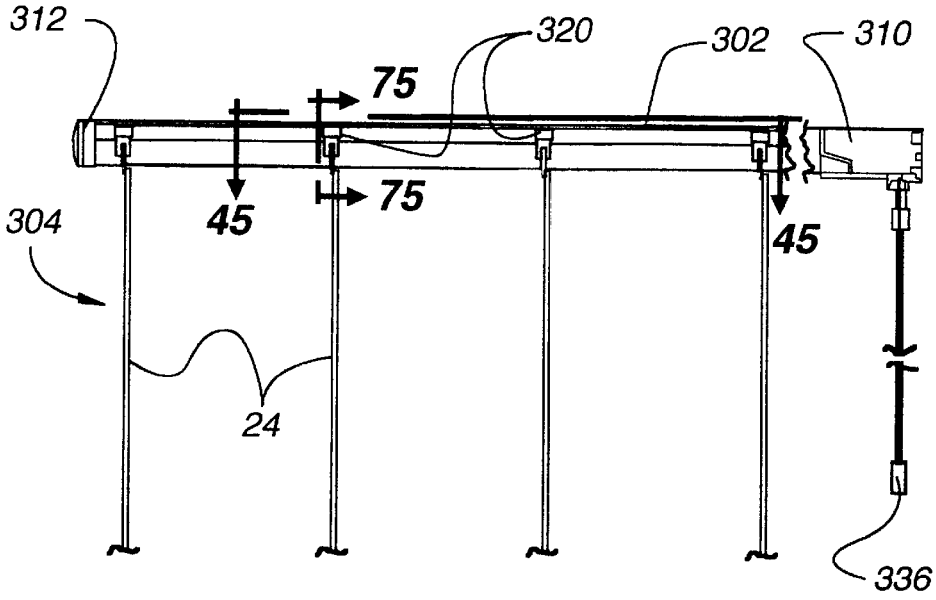
FIG. 41 is a schematic view similar to FIG. 3 and is a fragmentary front elevation of the covering of FIG. 37 with the vanes extended and in an open position.
Figure 42:
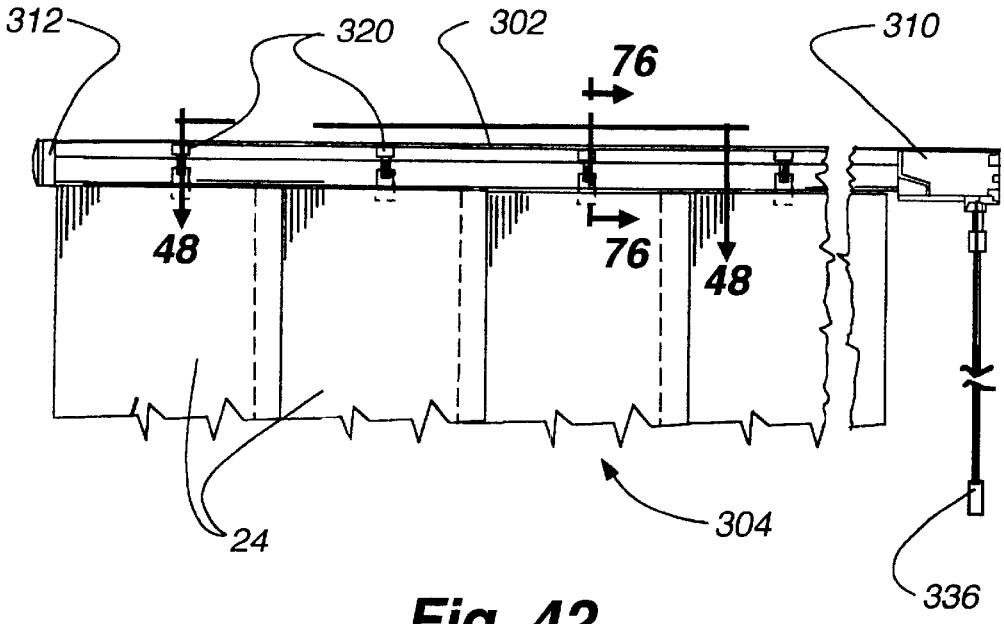
FIG. 42 is a schematic view similar to FIG. 4 and is a fragmentary front elevation of the covering depicted in FIG. 41 with the vanes in an extended and closed configuration.
Figure 43:
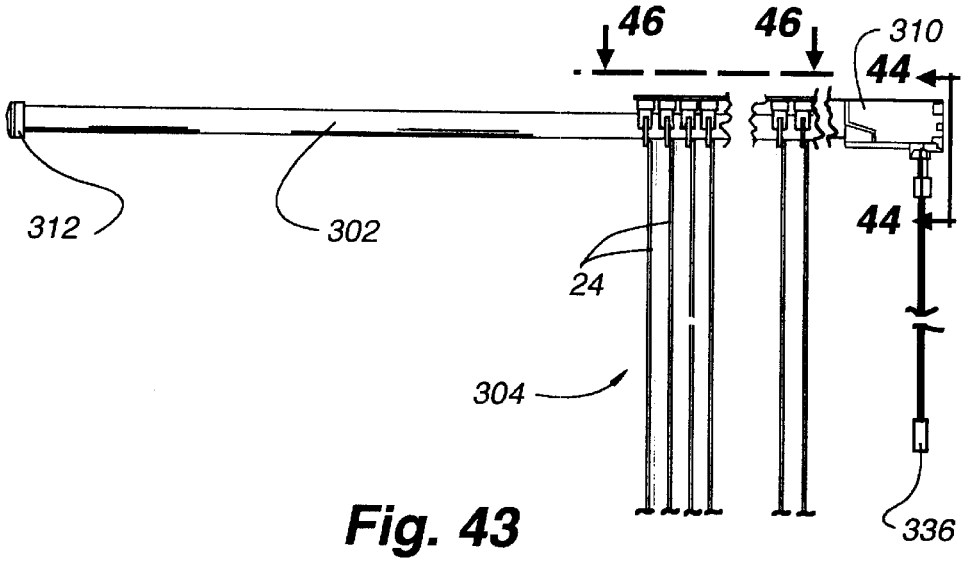
FIG. 43 is a schematic view similar to FIG. 5 and is a fragmentary elevation of the covering depicted in FIGS. 41 and 42 with the vanes in a retracted and open configuration.

FIGS. 41–43 are schematic representations of the covering 304 in three different configurations. FIG. 41 depicts the covering 304 in an extended and open configuration. The covering 304 is extended since the carriers 320 are evenly distributed longitudinally along the headrail 302. The covering 304 is open since the vanes 24 are angularly arranged so as to present the narrow edges of the vanes. In FIG. 42, the covering 304 is extended and closed. In this configuration, the vanes 24 have been rotated approximately 90° about their longitudinal vertical axes from the configuration depicted in FIG. 41, and are slightly overlapping. Thus, the configuration depicted in FIG. 42 provides the maximum amount of light, air, and vision blockage. In FIG. 43, the covering 304 is fully retracted and open. FIG. 41 most directly corresponds to FIG. 3 of the first preferred embodiment, and FIG. 42 similarly corresponds to FIG. 4, and FIG. 43 similarly corresponds to FIG. 5.

Figure 44:
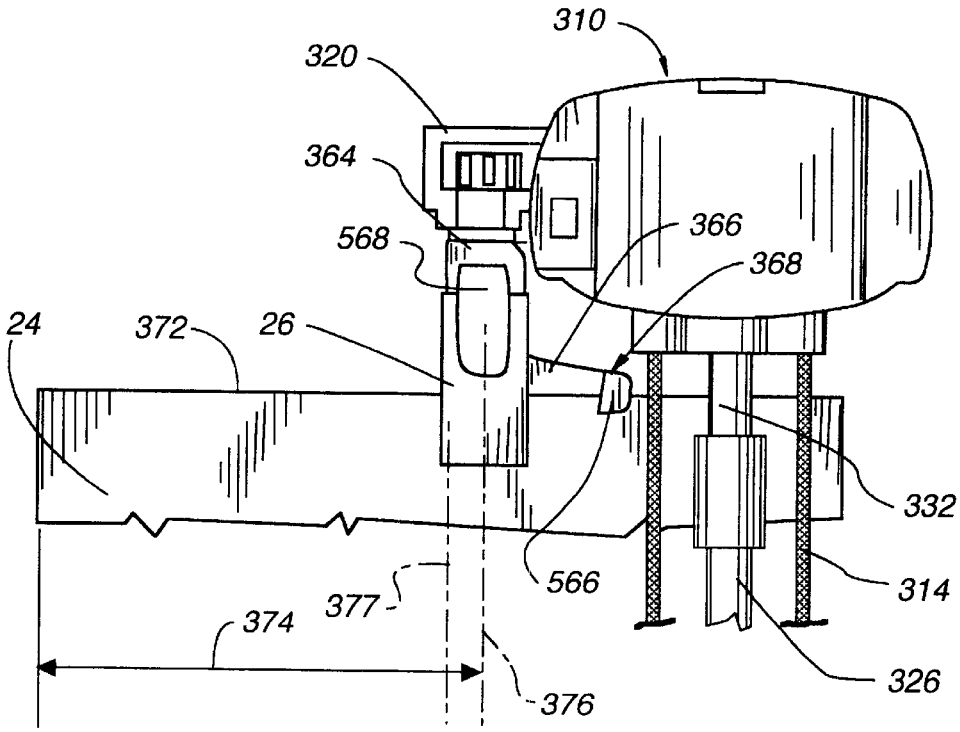
FIG. 44 is an enlarged fragmentary end view taken along line 44—44 of FIG. 43.

FIG. 44 is an enlarged fragmentary end view along line 44—44 of FIG. 43. As shown to good advantage in FIG. 44 and as described further below in connection with, for example, FIGS. 79–88, the improved hanger pin 364, 364' includes a boot-shaped web member 366 having a thickened toe 368 on one end. The thickened toe 368 defines an abutment surface 370 (FIG. 81) against which an upper edge 372 of the vane 24 rests in the assembled covering 304. In the preferred embodiment depicted in FIG. 44, distance 374 comprises approximately 60% of the entire width of the vane 24. Thus, since the vertical centerline 376 of the hangar pin 364 does not overlap the vertical centerline 377 of the vane 24, the vane 24 tries to rotate counter-clockwise as depicted in FIG. 44. This tendency to rotate counter-clockwise (as depicted in FIG. 44), drives the upper edge 372 of the vane 24 into the abutment surface 370 (FIG. 81) of the hanger pin 364.

Figure 45:
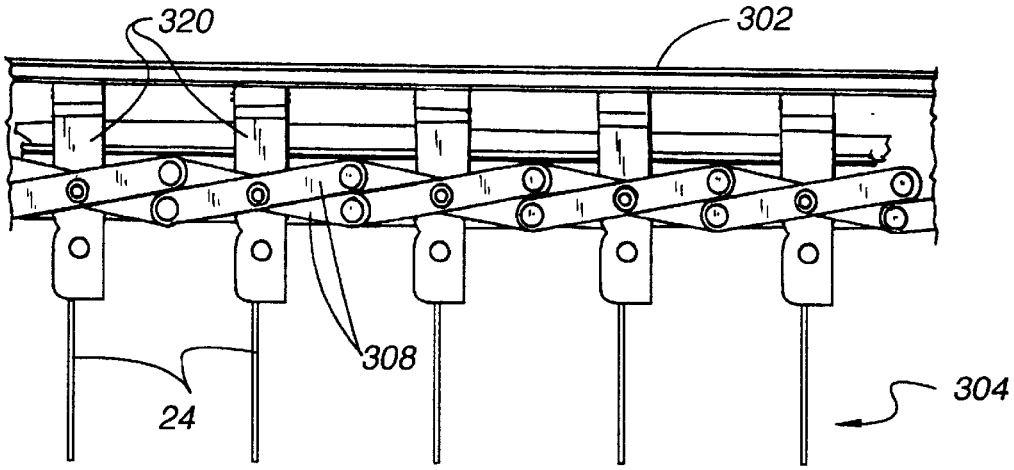
FIG. 45 is similar to FIG. 8 and is a fragmentary top plan view of the second alternative control system of the present invention taken along line 45—45 of FIG. 4 with the linkage fully extended and the vanes in an open configuration.
Figure 46:
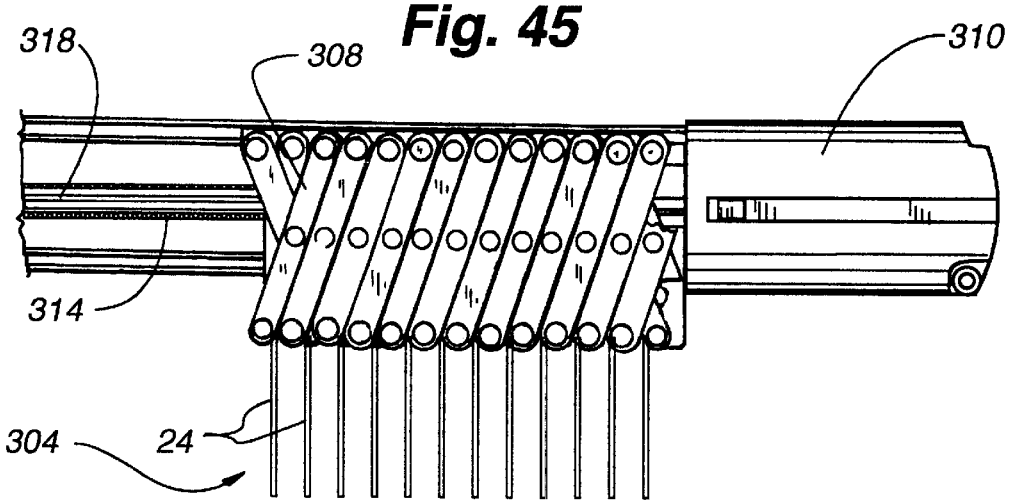
FIG. 46 is similar to FIG. 9 and is a fragmentary top plan view of the control system depicted in FIG. 45, but taken along line 46—46 of FIG. 43 with the linkage fully retracted adjacent to the primary end cap and the vanes in an open configuration.
Figure 47:
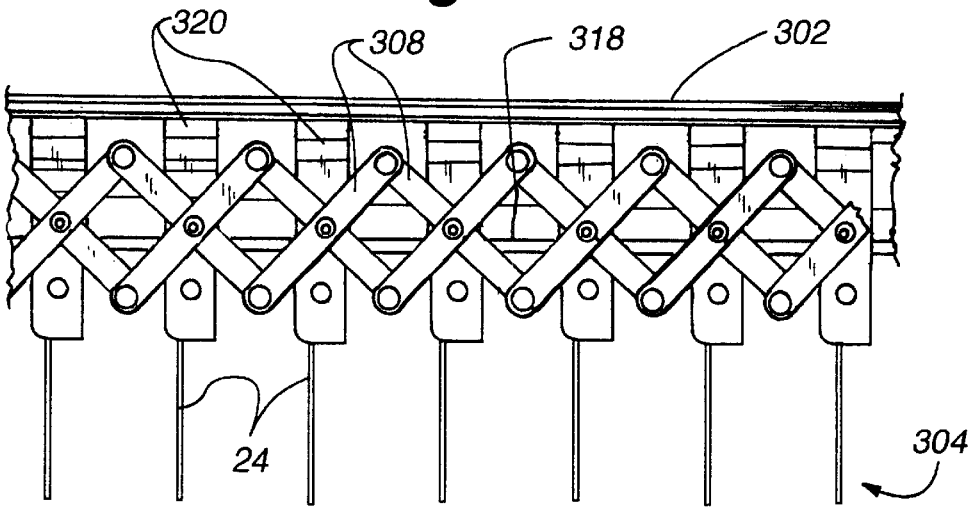
FIG. 47 is similar to FIG. 10 and is a fragmentary top plan view of the control system depicted in FIG. 45 with the linkage in an intermediate position and the vanes in an open configuration.
Figure 48:
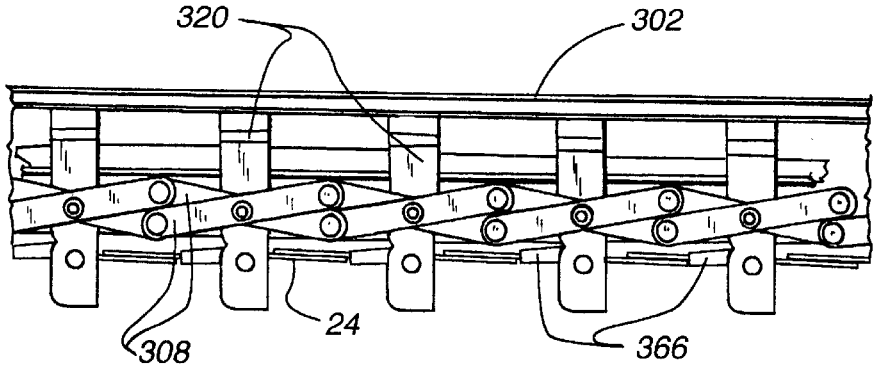
FIG. 48 is similar to FIG. 45, but taken along line 48—48 of FIG. 42 with the linkage fully extended and the vanes in a fully closed configuration.

FIGS. 45–48 are fragmentary, top plan views of the covering 304 in four different configurations. FIG. 45 is a top plan view along line 45—45 of FIG. 41, and depicts the covering 304 in its extended and open configuration. FIG. 46 is a top plan view along line 46—46 of FIG. 43 and depicts the covering 304 in its retracted and open configuration. FIG. 47 is a fragmentary top plan view of the covering 304 in an intermediate configuration, between fully extended and fully retracted. FIG. 48 is a top plan view along line 48—48 of FIG. 42 and depicts the covering 304 in its extended and closed configuration. As clearly shown in FIGS. 42 and 48, the vanes 24 overlap slightly when the covering 304 is in its extended and closed configuration.

Figure 49:
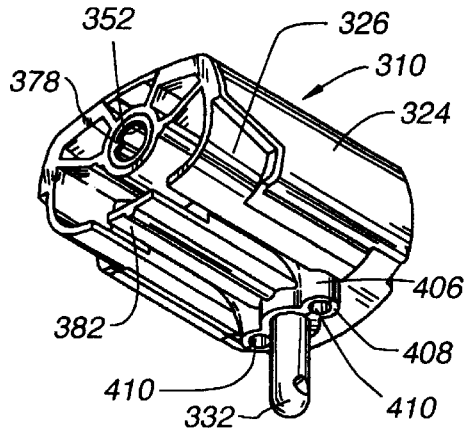
FIG. 49 is an isometric view looking upwardly at the primary end cap of the second alternative control system.
Figure 50:
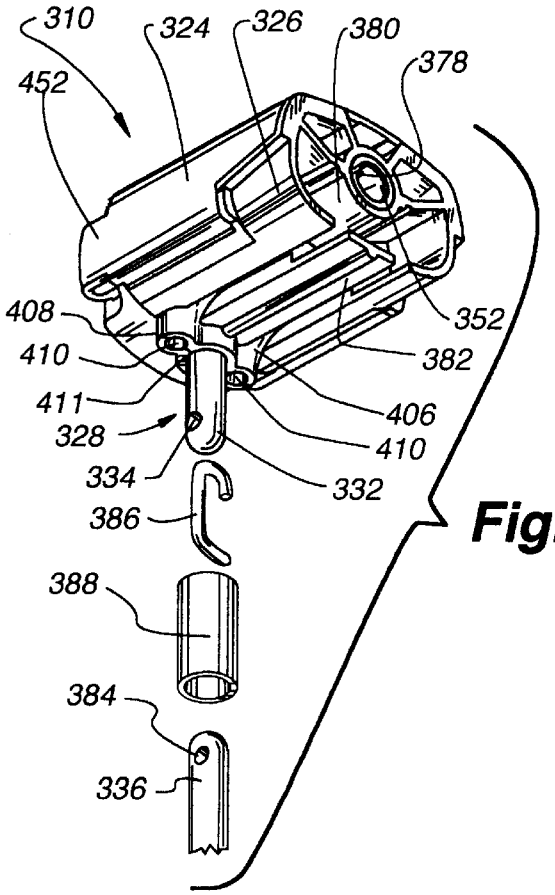
FIG. 50 is an alternative isometric view of the primary end cap depicted in FIG. 49, and includes an exploded view of the hardware for connecting a tilt wand to a tilt wand drive gear.
Figure 50A:
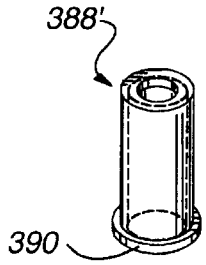
FIG. 50A is an isometric view of an alternative tilt rod over-sleeve.

Referring next to FIGS. 49, 50, and 50A, various details of the primary end cap 310 will be described next. FIG. 49 is an isometric view looking upwardly at the primary end cap 310 of the second alternative control system 300. FIG. 50 is an alternative isometric view of the primary end cap 310, and includes an exploded view of the hardware for connecting the tilt wand 336 to the tilt wand drive gear 328. Also shown in FIG. 50 is the cylindrical drive collar 352 of the tilt rod drive gear 348 (FIG. 40) and the depending drive shaft 332 of the tilt wand drive gear 328 (FIG. 40). Extending radially inwardly from the inner surface of the cylindrical drive collar is a longitudinal drive ridge 378. This ridge 378, rides in the longitudinal groove 338 (FIG. 40) of the tilt rod 318 in the assembled covering. As shown in FIG. 50, the cylindrical drive collar 352 rides in a bearing socket 380 comprising part of the main body 326 of the primary end cap 310. When the cylindrical drive collar 352 is seated in the bearing socket 380, a bearing ring 381 (FIG. 51) comprising part of the tilt rod drive gear 348 rides against a longitudinal end of the bearing socket 380. Also visible is a mounting tongue 382 which will be described further below in connection with, for example, FIG. 57. The mounting tongue 382 helps stabilize the main body 326 of the primary end cap 310 on the end of the headrail 302.

As previously described, at the distal end of the depending drive shaft 332 is a transverse connection opening 334. A similar opening 384 is located at the top of the tilt wand 336. A connector 386 is used to connect the depending shaft 332 of the tilt wand drive gear 328 to the tilt wand 336. Then, an over-sleeve 388 is used to cover the connector 386 and keep it in position. The over-sleeve 388, therefore, must be made of a resilient material that permits the over-sleeve 388 to snugly slip over the connector 386. FIG. 50A depicts an alternative over-sleeve 388' that includes an annular lip 390 that may be used to position the over-sleeve 388' on the connector 386.

Figure 51:
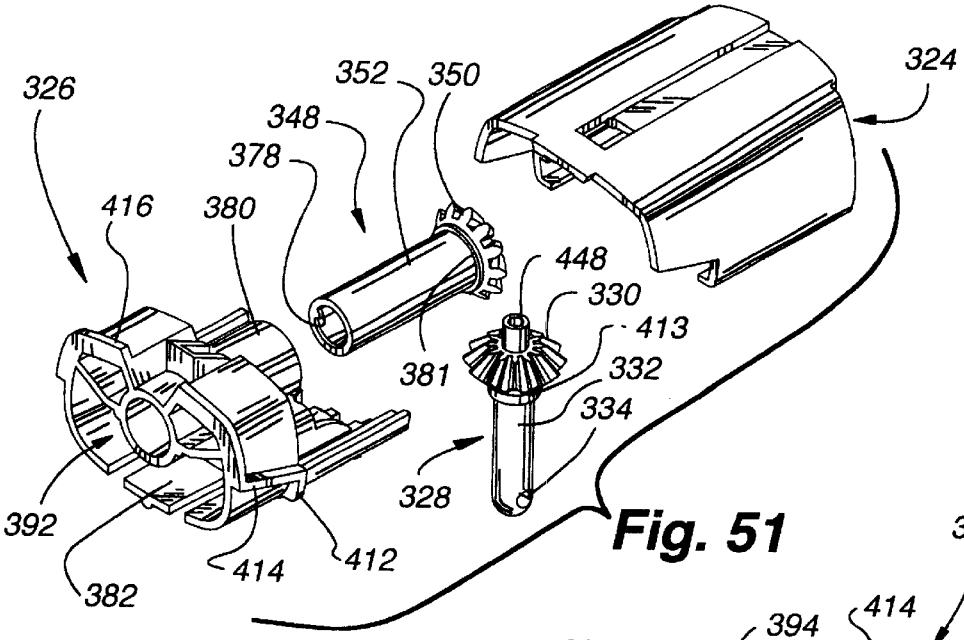
FIG. 51 is an exploded isometric view looking downwardly at the primary end cap components depicted in their assembled form in FIG. 49.

FIG. 51 is an exploded view of the assembly depicted in FIG. 49. The first and second beveled gears 330, 350, respectively, comprising part of the tilt wand drive system, may have constant gear angles, or, alternatively, the teeth on these two beveled gears 330, 350 may vary to reduce the friction between them. In other words, rather than designing the bevel gears 330, 350 so that they fully mesh, they may be designed so that only a portion of the gear surfaces on the first bevel gear 330 meshes with a portion of the gear surfaces on the second beveled gear 350. Also, when the secondary end cap 312' is in its second form (see FIG. 40A), made from a main body 326 and shell 324 of a primary end cap 310, the bearing socket 380 rotatably supports the tilt rod 318 rather than the cylindrical drive collar 352 of the tilt rod drive gear 348.

Referring next to FIGS. 51–62, a first form of the main body 326 for use in the second alternative control system 300 according to the present invention is described next. As shown to best advantage in FIGS. 51 and 54, the main body 326 forms a headrail pocket 392 on one end. This pocket 392 is designed to accommodate an end of the headrail 302, which is snugly retained in the pocket 392 as shown to good advantage in FIG. 39A. The right-hand end of FIG. 39A depicts the second form of the secondary end cap 312, wherein a main body 326 generally used for a primary end cap 310 is used as part of the secondary end cap 312'. The main body 326, whether used for a primary end cap 310 or a secondary end cap 312', is held on the headrail 302, partly by frictional pressure applied by the mounting tongue 382. Once the main body 326 is in position on the headrail 302, the screws or other fasteners 354 (FIG. 40) are inserted through the fastener openings 394 (FIGS. 54 and 56) from the side of the main body 326 depicted in FIG. 56, and one is screwed into each of the upwardly opening grooves 396, 398 (FIGS. 75 and 76) of the inner and outer headrail legs 400, 402 as was done, for example, in the embodiment depicted in FIG. 35. As previously mentioned, the main body 326 also forms the bearing socket 380 into which the cylindrical drive collar 352 of the tilt wand drive gear 348 is inserted during assembly of the primary end cap 310. As shown to good advantage in FIGS. 54 and 56, two traverse cord passages 404 extend through a lower portion of the main body 326. As shown to good advantage in FIG. 60, which is a cross-sectional view taken along line 60—60 of FIG. 56, the traverse cord passages 404 open into the headrail pocket 392 on one end and lead to the arcuate cord troughs 346 on the other end.

Figure 66:
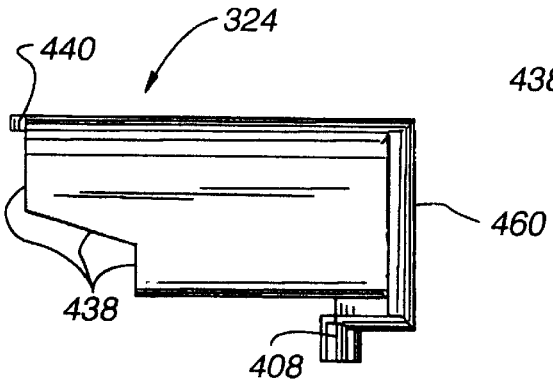
FIG. 66 is an elevation depicting a side of the shell depicted in FIGS. 63–65.
Figure 67:
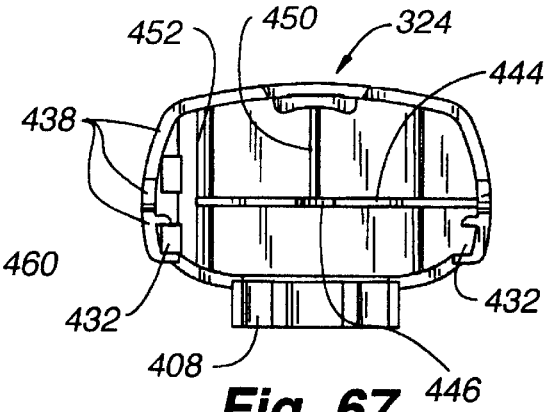
FIG. 67 is an end view, looking into the shell depicted in FIG. 63–65.
Figure 68:
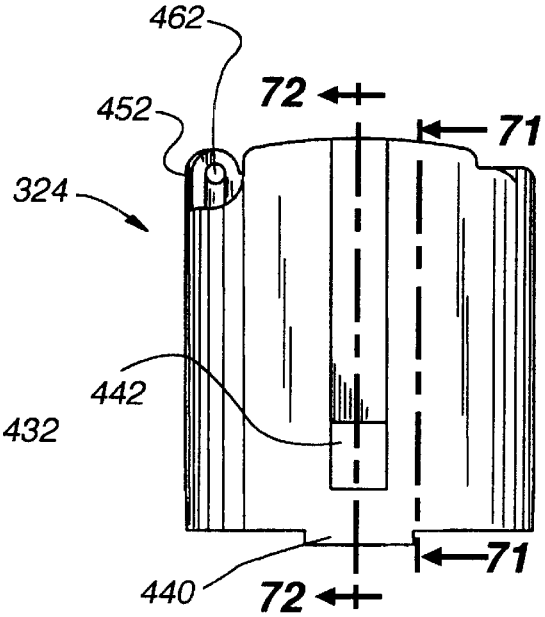
FIG. 68 is a top plan view of the shell depicted in FIGS. 63–65.
Figure 70:
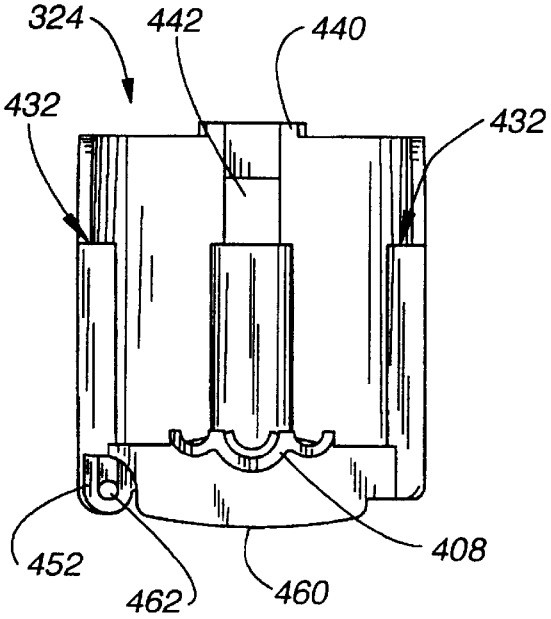
FIG. 70 is a bottom plan view of the shell depicted in FIG. 63–65.
Figure 69:
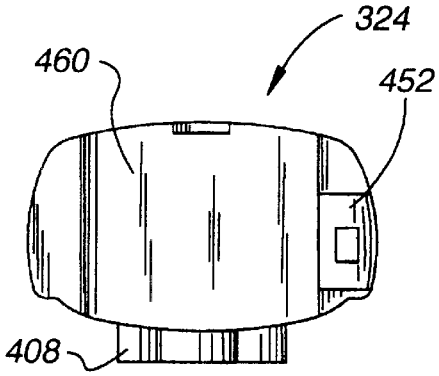
FIG. 69 is an end view of the shell depicted in FIGS. 63–65, depicting the end of the shell opposite from that depicted in FIG. 67.
Figure 71:
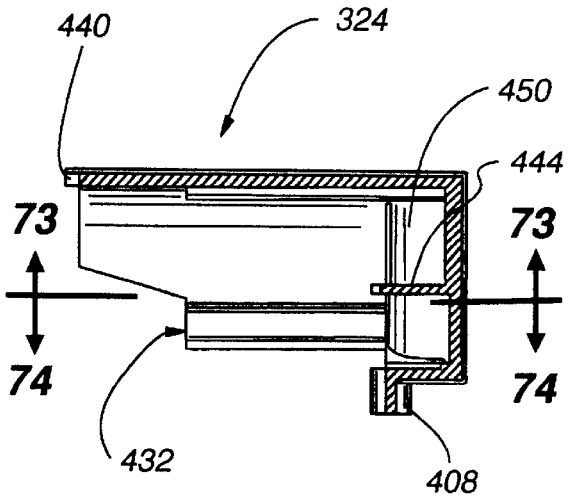
FIG. 71 is a cross-sectional view of the shell taken along line 71—71 of FIG. 68.
Figure 73:
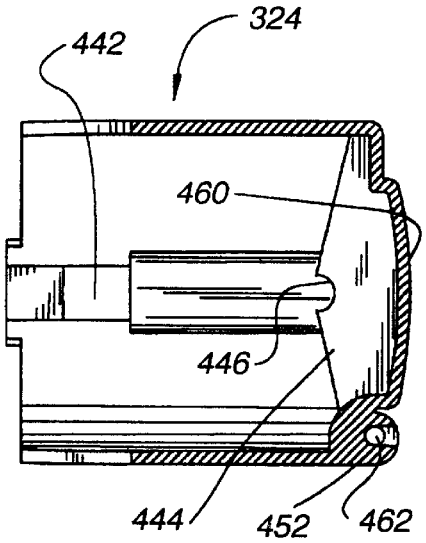
FIG. 73 is a cross-sectional view of the shell taken along line 73—73 of FIG. 71, looking upwardly into the shell depicted in FIGS. 63–65.
Figure 74:
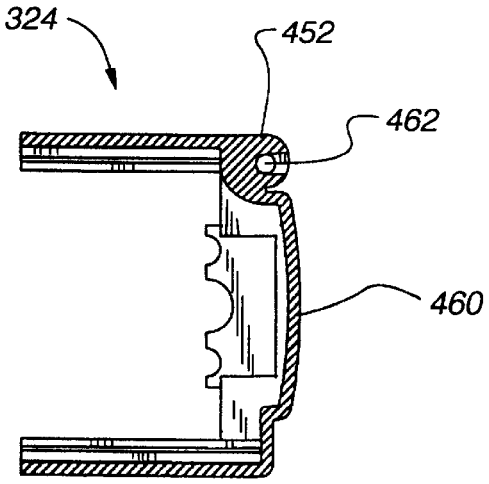
FIG. 74 is a cross-sectional view of the shell taken along line 74—74 of FIG. 71, looking in the opposite direction from that of FIG. 73.
Figure 72:
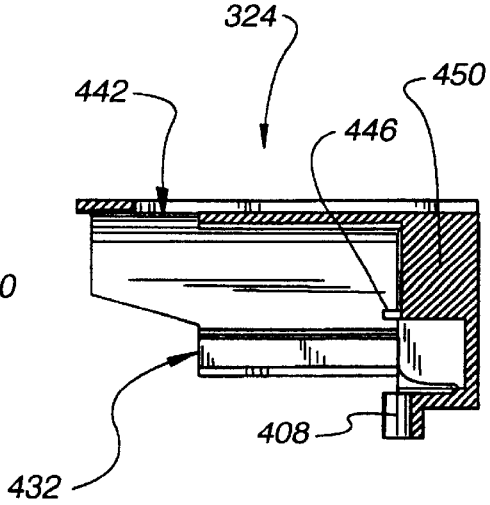
FIG. 72 is a cross-sectional view of the shell similar to FIG. 71, but taken along line 72—72 of FIG. 68.

During assembly of the covering 304, the traverse cord 314 is routed along one arcuate cord trough 346, through one traverse cord passage 404, along the headrail 302 to the opposite end cap 312, 312', then back through the headrail 302, through the other traverse cord passage 404, down the other arcuate cord trough 346 to the tilt wand 336 (see, e.g., FIGS. 130 and 131), from which the cord 314 is routed back to its starting point. The two legs or routes of the traverse cord 314 are retained in position by a first containment tab 406 (e.g., FIGS. 52–54) on the main body 326 and a second containment tab 408 (e.g., FIGS. 63 and 66) on the shell 324. The first and second containment tabs 406, 408 define traverse cord containment channels 410 clearly visible FIGS. 49 and 50. The first and second containment tabs 406, 408 also form a channel 411 (FIG. 50) for the depending drive shaft 332 of the tilt wand drive gear 328. A lower bearing ring 413 (FIG. 51) rides on top of the channel 411 and helps position the tilt wand drive gear 328 in the assembled primary end cap 310. A short vertical wall 412 extends outwardly from each side of the main body 326 and intercepts a sloped portion 414 that in turn intercepts a front vertical wall 416. These three elements 412, 414, 416 of the main body 326 cooperate to help correctly position the shell 324 when it is slid onto shell alignment shelves 418 (e.g., FIG. 53) and snapped over a shell catch 420.

Figure 53:
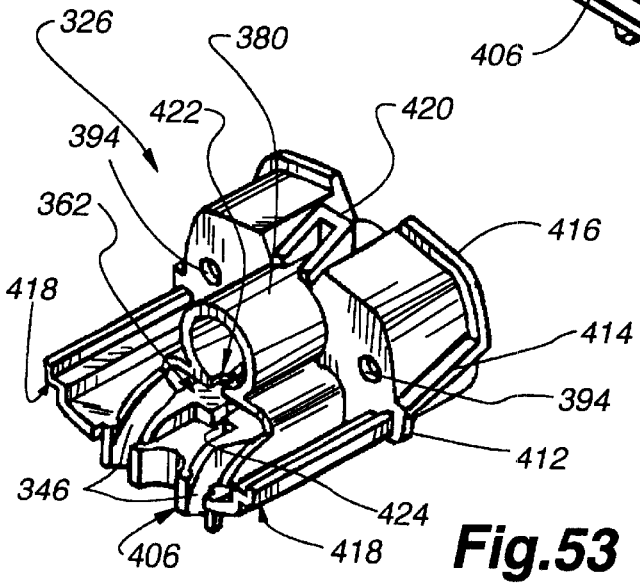
Figure 56:
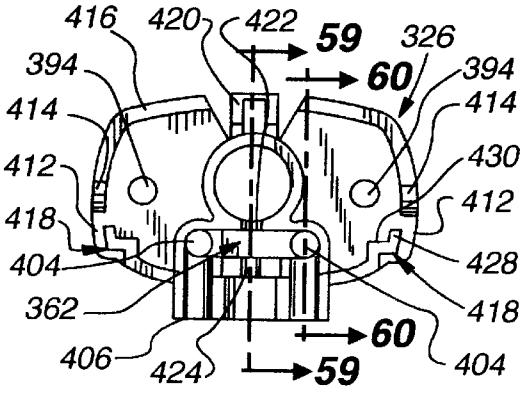
FIG. 56 is an end view of the main body depicted in FIGS. 52 and 53, looking at the end opposite of that depicted in FIG. 54.
Figure 55:
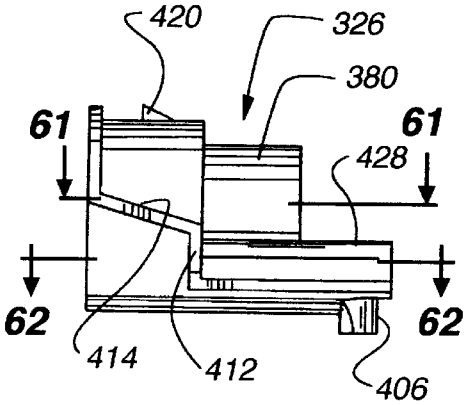
FIG. 55 is an elevation depicting a first side of the main body depicted in FIGS. 52 and 53, the opposite being a mirror image thereof.
Figure 54:
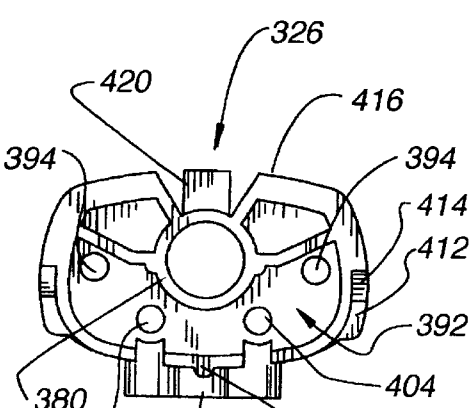
FIG. 54 is an end view of the main body depicted in FIGS. 52 and 53, looking into the headrail pocket comprising part of the main body.
Figure 61:
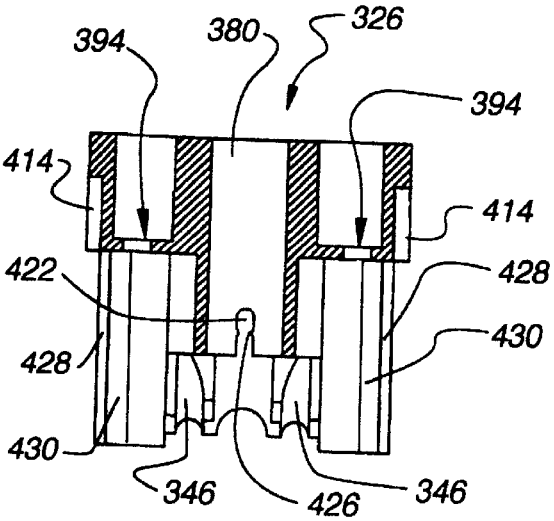
FIG. 61 is a cross-sectional view of the main body depicted in FIGS. 52 and 53 taken along line 61—61 of FIG. 55.
Figure 62:
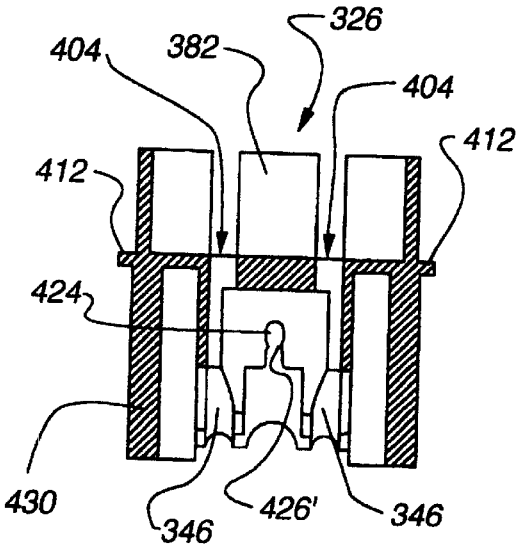
FIG. 62 is a cross-sectional view of the main body depicted in FIGS. 52 and 53 taken along line 62—62 of FIG. 55.

As previously discussed, the main body 326 and shell 324 combination may be used as a secondary end cap 312' if desired (see, e.g., FIGS. 37A and 38A). When this is done, as previously alluded to in connection with FIG. 40A, an idler pulley 342' is mounted to the main body 326 that is being used in the secondary end cap 312'. In particular, the mounting pin 344' is inserted through the idler pulley 342'. Then, the upper part of the mounting pin 344' is slid into an upper mounting pin slot 422 (FIGS. 53, 56, and 61), and a lower portion of the mounting pin 344' is slid into a lower mounting pin slot 424 (FIGS. 53, 56, and 62). FIG. 61 clearly shows that a pair of detents 426 are formed along the upper mounting pin slot 422, and FIG. 62 clearly shows that a similar pair of detents 426' are formed along the lower mounting pin slot 424. Thus, when the idler pulley 342' and its mounting pin 344' is forced into the pulley pocket 362 with sufficient force, the mounting pin 344' snaps past the detents 426, 426' and is thereby retained in the upper and lower mounting pin slots 422, 424, respectively. Subsequently, the traverse cord 314 passing through one traverse cord passage 404 is positioned on the idler pulley 342' and then passed through the other traverse cord passage 404 for its return path through the headrail 302 toward the primary end cap 310.

Figure 58:
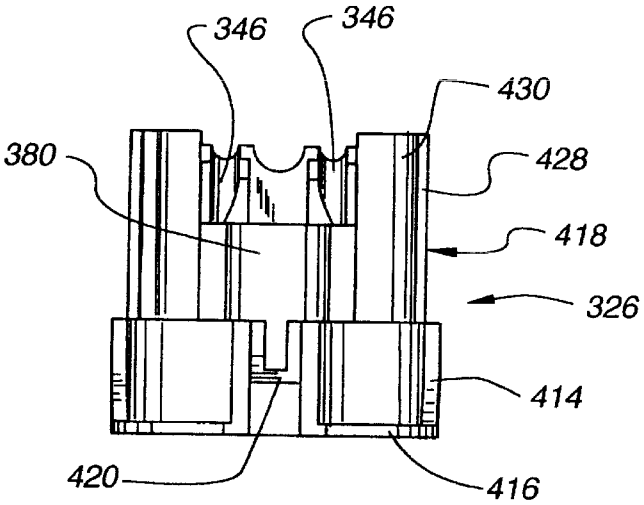
FIG. 58 is a top plan view of the main body depicted in FIGS. 52 and 53.
Figure 57:
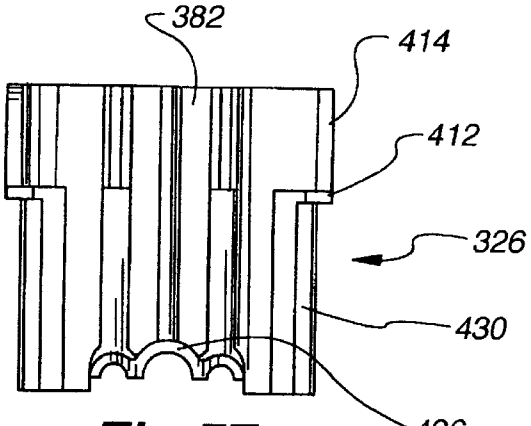
FIG. 57 is a bottom plan view of the main body depicted in FIGS. 52 and 53.

As shown to best advantage in FIGS. 56–58, each shell alignment shelf 418 comprises a vertical part 428 and a horizontal part 430. As will be described below in connection with FIGS. 63–74, the shell 324 comprises a pair of alignment channels 432 that slide on to the shell alignment shelves 418 during the installation of the shell 324 onto the main body 326.

Figure 52:
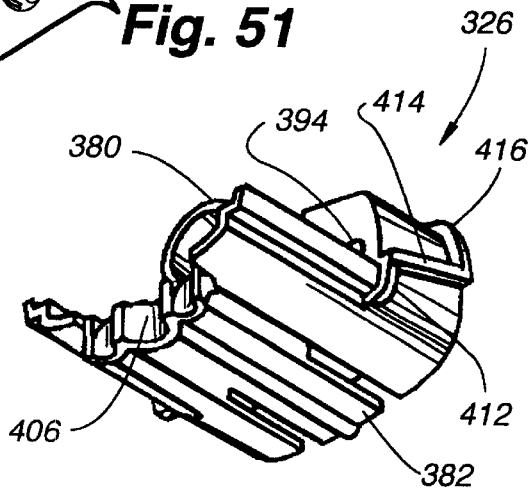
FIGS. 52 and 53 depict two different isometric views of a first alternative form of a main body of the primary end cap for the second alternative control system.
Figure 59:
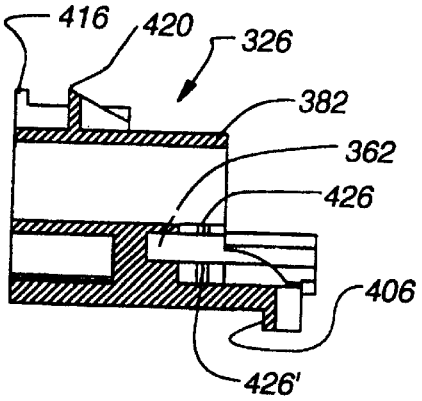
FIG. 59 is a cross-sectional view of the main body depicted in FIGS. 52 and 53 taken along line 59—59 of FIG. 56.
Figure 60:
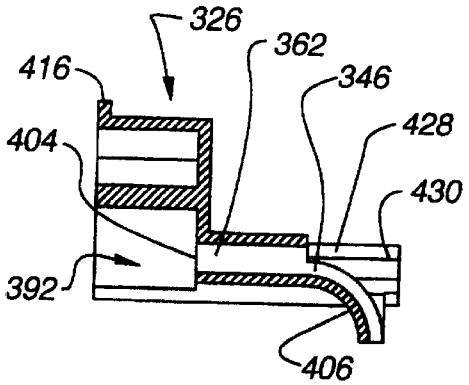
FIG. 60 is a cross-sectional view of the main body depicted in FIG. 52 and 53 taken along line 60—60 of FIG. 56.
Figures 52A, 53A, 58A, 59A, 60A:
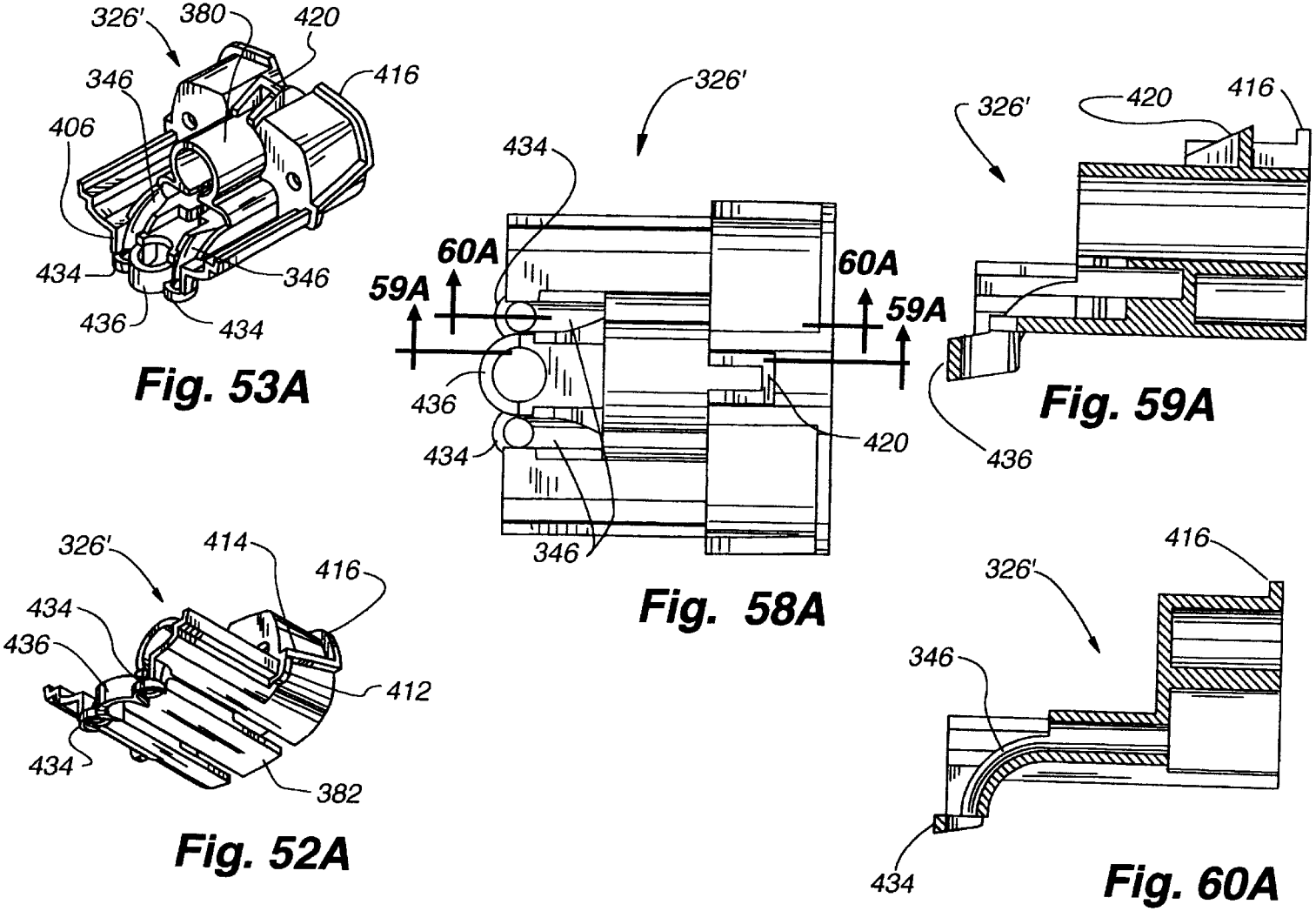
FIGS. 52A and 53A are similar to FIGS. 52 and 53, respectively, but depict a second alternative form of the main body of the primary end cap for the second alternative control system.
FIG. 58A is similar to FIG. 58, but depicts a top plan view of the main body depicted in FIGS. 52A and 53A.
FIG. 59A is similar to FIG. 59, but depicts a cross-sectional view of the main body depicted in FIGS. 52A and 53A taken along line 59A—59A of FIG. 58A.
FIG. 60A is similar to FIG. 60, but depicts a cross-sectional view of the main body depicted in FIGS. 52A and 53A taken along line 60A—60A of FIG. 58A.

FIGS. 52A, 53A, 58A, 59A, and 60A depict a second alternate form of the main body 326' for use in the second alternative control system 300 according to the present invention. FIG. 53A is similar to FIG. 53, FIG. 52A is similar to FIG. 52, FIG. 58A is similar to FIG. 58, FIG. 59A is similar to FIG. 59, and FIG. 60A is similar to FIG. 60. In this form of the main body 326', however, the first containment tab 406 depicted in, for example, FIGS. 52, 53, 58, 59, and 60 has been modified. In particular, the arcuate cord troughs 346 terminate on one end at small rings 434 at the distal end of the first containment tab 406. The traverse cord 314, during threading, is fed through these small rings 434, which help maintain the position of the traverse cord 314 during assembly. Similarly, the center portion of the first containment tab 406, which accommodates a portion of the depending drive shaft 332 (FIG. 40) of the tilt wand drive gear 328 in the assembled primary end cap 310, includes a large ring 436 that encircles the depending drive shaft 332 of the tilt wand drive gear 328. Again, being able to insert the depending drive shaft 332 into the large ring 436 facilitates assembly of the primary end cap 310 and helps to stabilize the tilt wand drive gear 328 during use.

Figure 63:
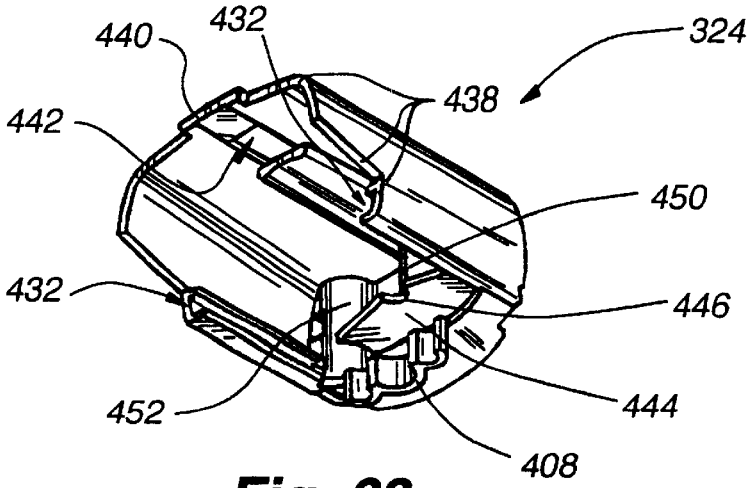
FIGS. 63–65 are isometric views from three different angles of the primary end cap shell also depicted to good advantage in FIG. 51.
Figure 64:
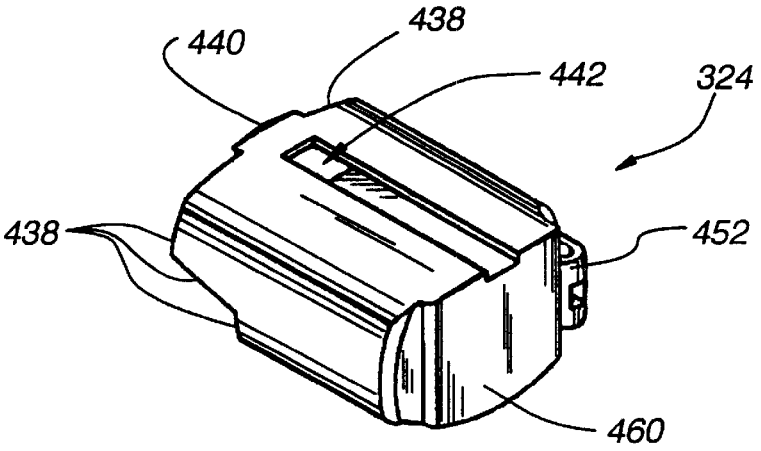
Figure 65:
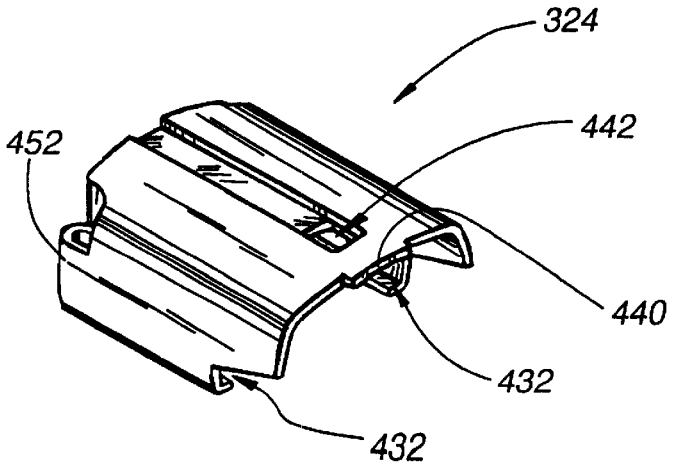

Referring next primarily to FIGS. 63–74, details of the shell 324 of the primary end cap 310 or the second form of the secondary end cap 312' are described next. FIGS. 63–65 are isometric views of the shell 324 from different angles. FIG. 63 is view looking upwardly into the interior of the shell 324. The leading edge 438 of the shell 324 includes a shell removal tab 440. When the shell 324 is slid onto the main body 326, 326' by aligning the shell 324 alignment shelves 418 with the shell alignment channels 432, and sliding the shell 324 onto the main body 326, 326' until the shell leading edge 438 (FIGS. 63 and 64) impacts the short vertical wall 412, sloped portion 414, and front vertical wall 416 of the main body 326, 326' (FIGS. 53 and 55), the shell catch 420 (FIGS. 53 and 54) snaps through a slot 442 depicted to good advantage in FIGS. 63–65.

In order to remove the shell 324 for access to the interior of the primary end cap 310 or second form of the secondary end cap 312', upward force on the shell removal tab 440 permits the shell catch 420 to slide out of the slot 442 thereby permitting removal of the shell 324 from the main body 326, 326'. A substantially horizontal web 444 is visible in FIGS. 63, 67, 71, and 73. A leading edge of this substantially horizontal web includes a cutout 446 (FIGS. 63 and 73) to accommodate an upper bearing sleeve 448 (FIG. 51) of the tilt wand drive gear 328. When the tilt wand drive gear 328 is positioned properly and the shell 324 is slid onto the main body 326, 326', the cutout 446 on the substantially horizontal web 444, in combination with the second containment tab 408, press the tilt wand drive gear 328 horizontally into firm engagement with the tilt rod drive gear 348. Thus, the upper bearing sleeve 448 is rotatably and pressingly supported by the cutout 446 in the substantially horizontal web 444.

A substantially vertical support web 450, which is clearly visible in FIGS. 63, 67, 71, and 72, connects the substantially horizontal web 444 to the inside top of the shell 324, thereby providing support to the substantially horizontal web 444. An interchangeable pivot shaft support 452 is clearly visible in FIGS. 63–65, 67–70, 73, and 74. As shown in, for example, FIGS. 110, 111, and 114, the pivot shaft support 452 supports a pivot shaft 454 connected to a fixed end vane 458, permitting the fixed end vane 458 to pivot with the non-end vanes 24 in the embodiment depicted in, for example, FIGS. 110–114, described more fully below. Since the shell 324 is symmetrical, the interchangeable pivot shaft support 452 may be moved to either corner on a rear wall 460 of the shell 324 by changing a mold insert (not shown) using known molding techniques. As shown to good advantage in FIGS. 68 and 70, the interchangeable pivot shaft support 452 has a passageway 462 through it to accommodate the pivot shaft 454 (FIGS. 110 and 111).

Figure 75:
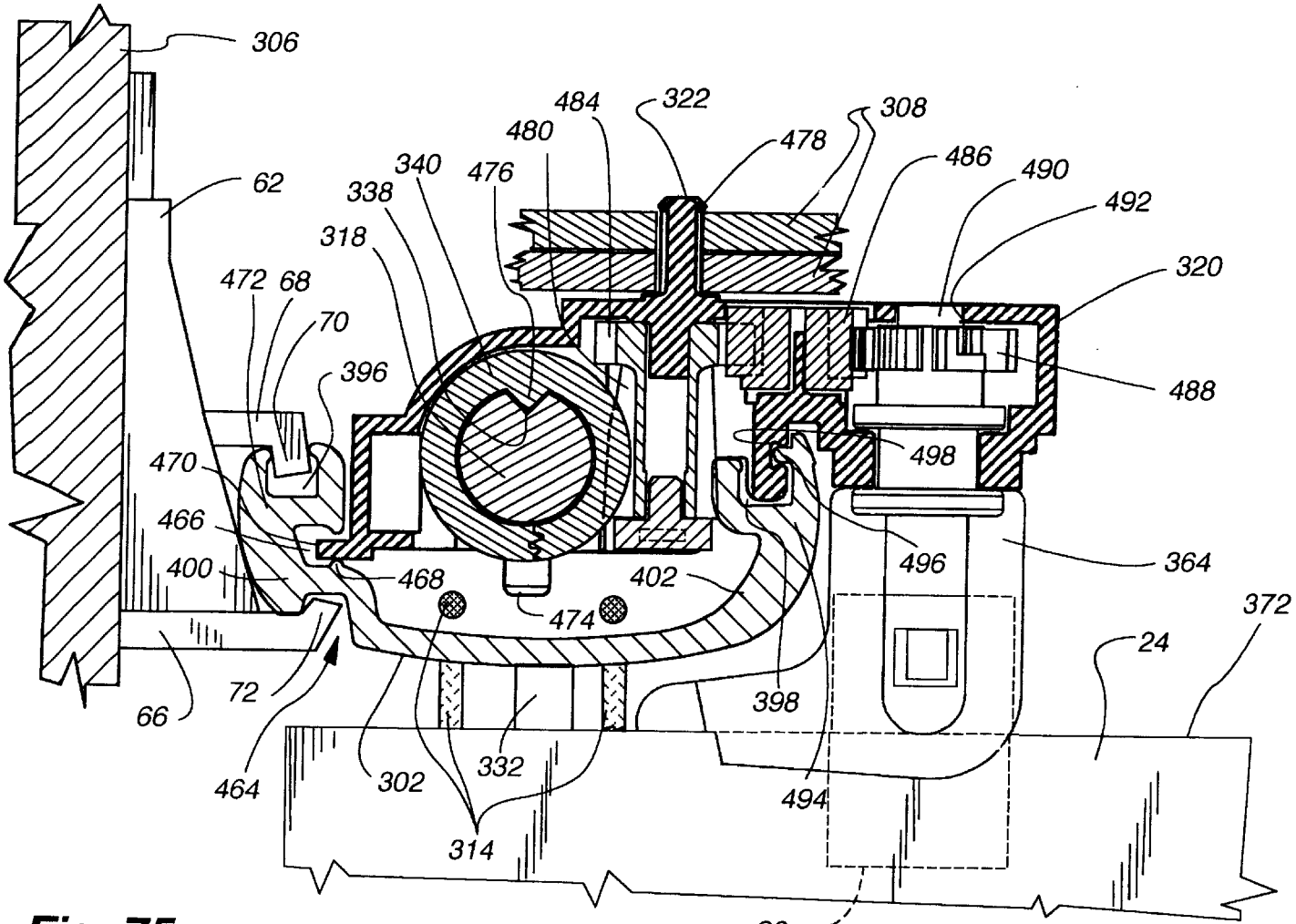
FIG. 75 is similar to FIG. 11, but depicts a fragmentary, cross-sectional view along line 75—75 of FIG. 41 of a portion of the second alternative control system according to the present invention.

FIG. 75 compares to FIG. 11 of the first embodiment and is a cross-sectional view taken along line 75—75 of FIG. 41. FIG. 75 is thus an enlarged cross-sectional view through the headrail 302 and a portion of a carrier 320 suspending a vane 24 that is oriented substantially perpendicularly to the supporting surface 306 to which the headrail 302 is attached by the depicted bracket 62. As shown, the headrail 302 again comprises an inner leg 400 and an outer leg 402. At the point where the inner leg 400 intersects the bottom of the headrail 302, a downwardly opening groove 464 has been formed. This downwardly opening groove 464 accommodates the in-turned lip 72 at the distal end of a lower substantially horizontally disposed plate-like leg 66 of the bracket 62. Just above the downwardly opening groove 464 is an internal groove 466 formed along the surface of the inner leg 400 closest to the center of the headrail 302. A slip ridge 468 is formed along the lower surface of the internal groove 466. The alignment tab 470 of the carrier 320 rides in the internal groove 466 on top of this slip ridge 468. Use of the slip ridge 468 reduces the friction between the alignment tab 470 and the headrail 302. An enlarged head 472 is formed at the upper end of the inner leg 400. An upwardly opening groove 396 is formed in this enlarged head 472 to accommodate the in-turned lip 70 formed at the distal end of an upper, substantially horizontally disposed plate-like leg 68 of the mounting bracket 62. The mounting bracket 62 and the grooves 396, 464 that accommodate its plate-like legs 68, 66, are substantially similar to the corresponding components depicted in, for example, FIG. 11.

As previously described in connection with FIG. 11, the headrail 302 includes a lower region that accommodates the traverse cord 314. Visible between the two paths of traverse cord 314 within the headrail 302 in FIG. 75 is one of a pair of extended worm gear loading ramps 474 that will be described further below in connection with FIGS. 89–101. The worm gear 340 is shown in cooperative engagement with the tilt rod 318. The worm gear 340 includes a longitudinal drive ridge 476 (see also FIGS. 79 and 80) that rides in the longitudinal orientation groove 338 (FIG. 40) formed in the tilt rod 318. Thus, when the tilt wand 336 is manually rotated by a user, that rotates the depending drive shaft 332 of the tilt wand drive gear 328 via the connector 386 (FIG. 50). Rotation of the tilt wand drive gear 328 rotates the tilt rod drive gear 348 via the meshing relationship between the first bevel gear 330 (FIG. 40) and the second bevel gear 350. The cylindrical drive collar 352 of the tilt rod drive gear 348 is keyed via its longitudinal drive ridge 378 (e.g., FIGS. 49 and 50) to the tilt rod 318. Thus, rotation of the tilt rod drive gear 348 and its cylindrical drive collar 352 rotates the tilt rod 318. Rotation of the tilt rod 318 rotates the worm gears 340 since the longitudinal drive ridges 476 (FIGS. 40 and 75) of the worm gears 340 ride in the longitudinal orientation groove 338 (FIGS. 40 and 75) formed in the tilt rod 318. This rotation of the worm gears 340 ultimately results in adjustment of angular orientation of the vanes 24 as described further below.

Continuing to refer to FIG. 75, as was the case with the carrier 32 (FIG. 11) described in connection with the first embodiment, a centrally-located, upstanding cylindrical pin 322, extends upwardly from the top of the carrier 320. An enlarged frusto-conical head 478 is formed on the distal end of the cylindrical pin 322. The interconnected links 308 again are designed to snap past the enlarged frusto-conical head 478 and become pivotally connected to the centrally-located, upstanding cylindrical pin 322. The worm gear 340 is engaged in vertically-oriented, longitudinally-extending teeth 480 of a transition gear 482 (see also FIG. 79). A different set of teeth 484 at the top of the transition gear 482 are engaged with the teeth (nine in the preferred embodiment) of a transfer or idler gear 486, which in turn are engaged in the teeth on a driven hanger pin gear 488 comprising part of the hanger pin 364. The hanger pin 364 includes an upper cylindrical bearing 490 that is accommodated in a bearing port 492 visible to best advantage in FIG. 79. Some of the details concerning the interconnection of these gears 340, 482, 486, 488 are explained more fully below. A reinforcing tab 26 (see also FIG. 40) connected to the upper edge 372 of the vane 24 connects to the hanger pin 364.

In FIG. 75, the outer leg 402 has an enlarged head 494 at its upper end, and the enlarged head 494 includes the upwardly opening groove 398. An inwardly-directed ledge 496, also formed on the enlarged head 494, rides in a C-shaped channel 498 (see also FIG. 79) formed in the carrier 320. The C-shaped channel 498 comprises an upper sliding ridge 500 (FIGS. 80 and 93) and a lower sliding ridge 502. The upper and lower sliding ridges 500, 502 help to minimize friction between the carrier 320 and the headrail 302 as the C-shaped channel 498 slides along the inwardly directed ledge 496.

Figure 76:
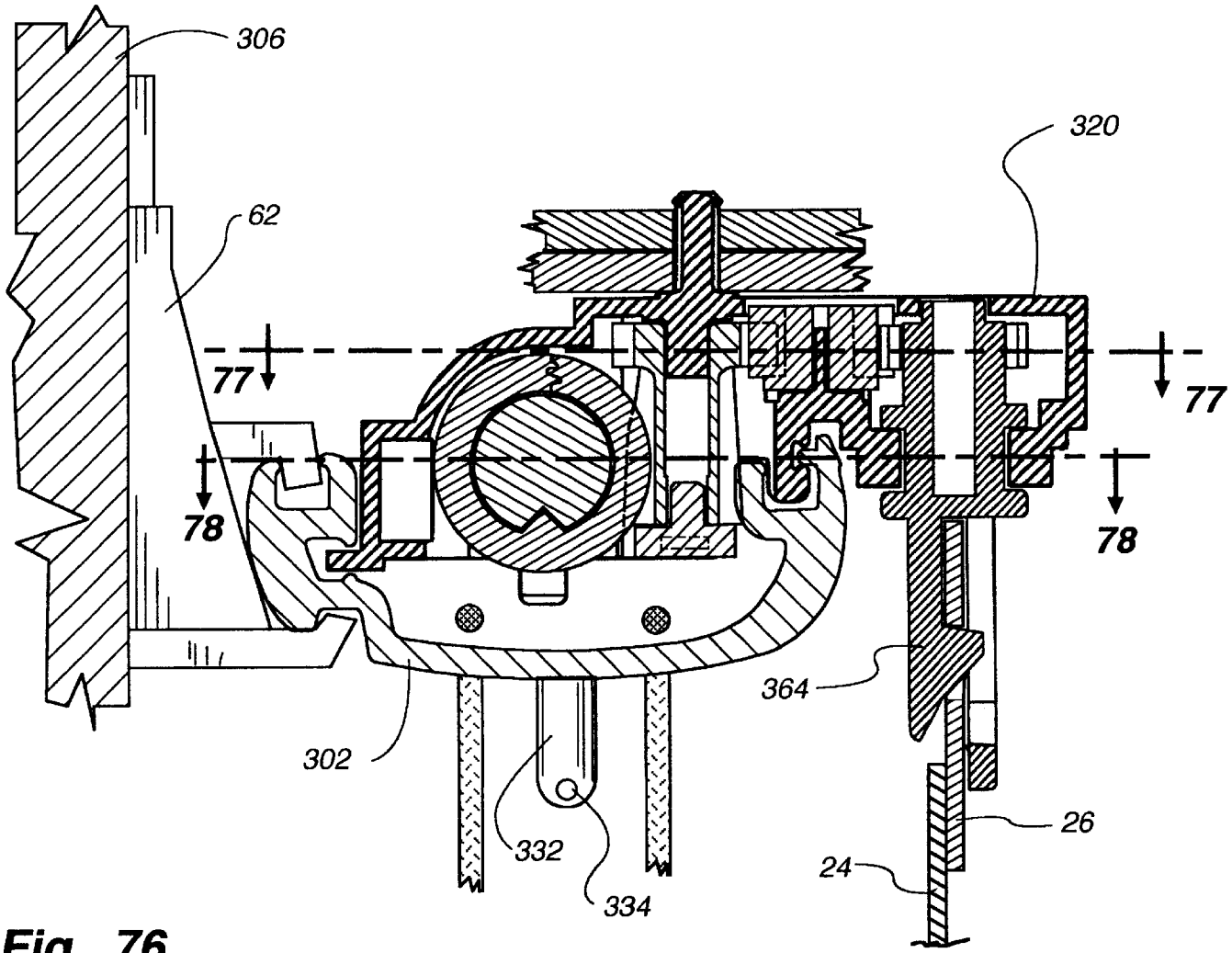
FIG. 76 is similar to FIG. 12 but depicts a fragmentary, cross-sectional view along line 76—76 of FIG. 42 of a portion of the second alternative control system according to the present invention.

FIG. 76 is similar to FIG. 75 and is a cross-sectional view taken along line 76—76 of FIG. 42. In FIG. 76, the slice has been taken through the carrier 320 at a slightly deeper point (i.e., through the hanger pin 364). In FIG. 76, the vane 24 has been rotated to be substantially parallel to the supporting surface 306 to which the headrail 302 is attached by the mounting bracket 62.

Figure 77A:
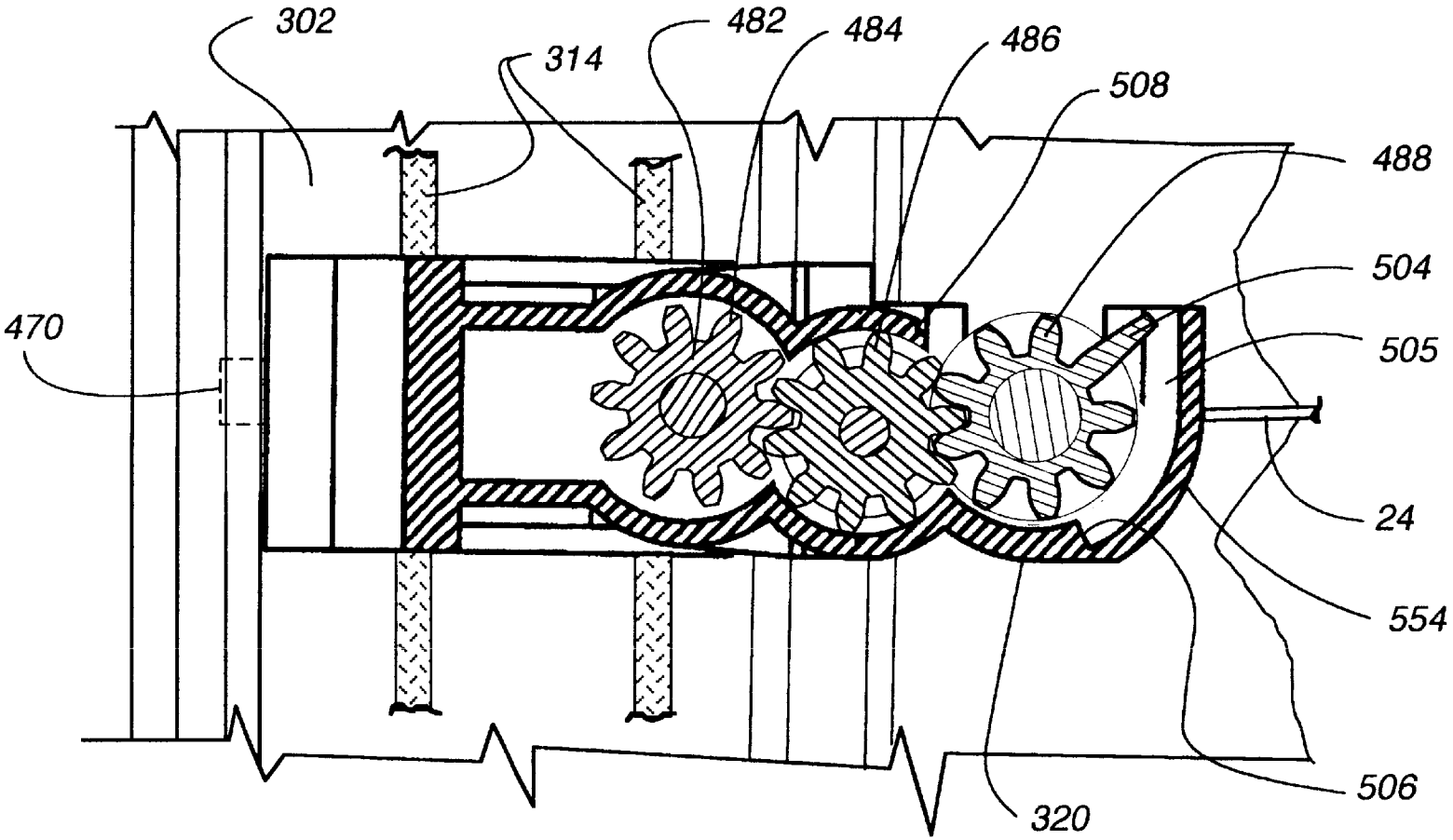
FIGS. 77A and 77B are cross-sectional views looking downwardly at the plane containing line 77—77 of FIG. 76, and depicting the relative position of the gears with the vane in two different orientations.
Figure 77B:
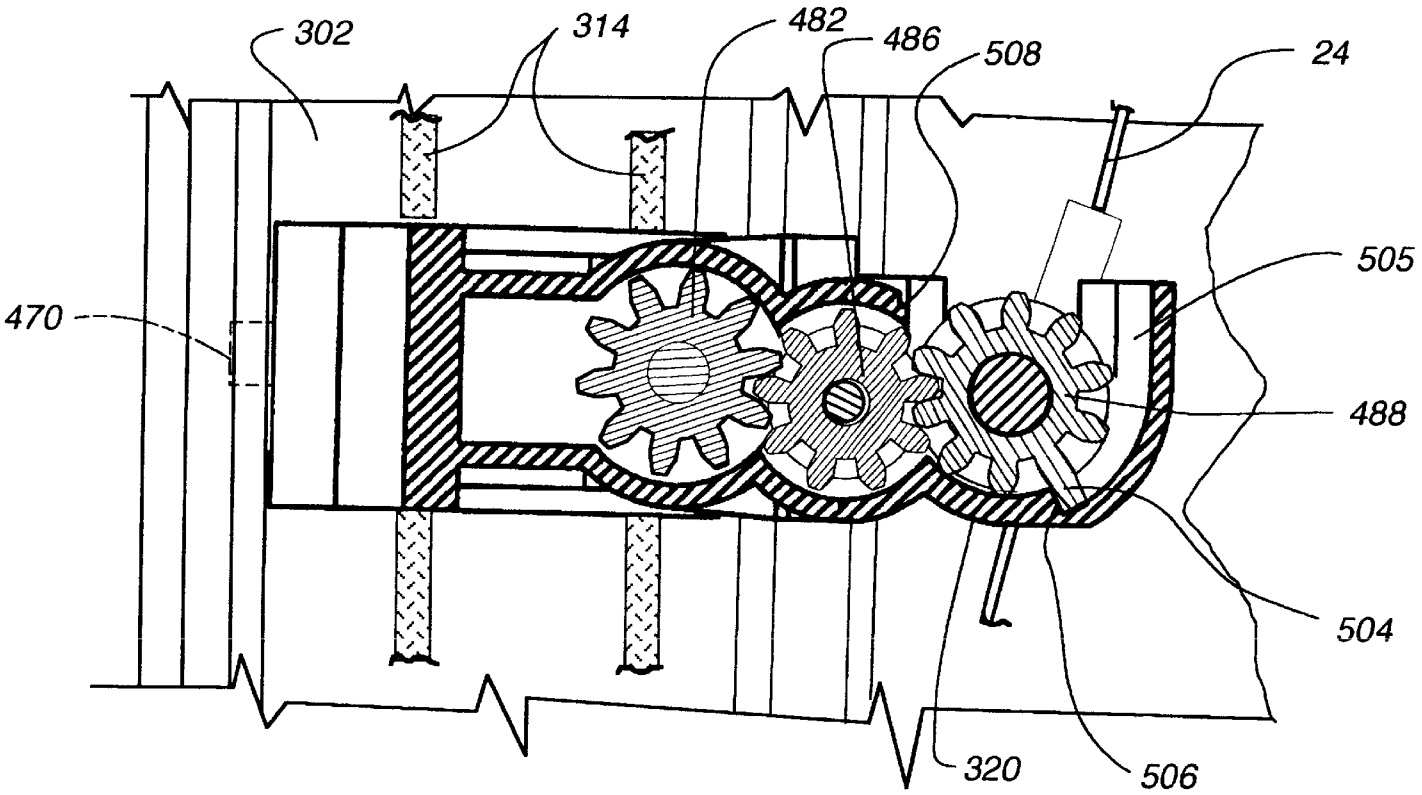

FIGS. 77A and 77B are cross-sectional views taken along line 77—77 of FIG. 76, looking downwardly at a portion of the drive train that translates rotation of the tilt rod 318 into a change in angular position of the vanes 24. In FIG. 77A, the vane 24 is oriented substantially perpendicular to the architectural opening and is thus in its most "open" position. With the drive train in this configuration, an extended tooth (radial abutment finger) 504 of the driven hanger pin gear 488, which rides in a J-shaped channel 505 at the forward end 554 of the carrier 320, is oriented substantially as shown in FIG. 77A, away from and substantially between a first limit stop 506 and a second limit stop 508 comprising part of the carrier 320. In contrast, in FIG. 77B, the vane 24 has been rotated to a substantially closed position. In this position, the extended tooth 504 on the driven hanger pin gear 488 has impacted the first limit stop 506, thereby preventing further clockwise rotation of the vane 24 from the configuration depicted in FIG. 77B. Starting from the position depicted in FIG. 77B, the vane 24 could be rotated approximately 180° counterclockwise, until the extended tooth 504 on the driven hanger pin gear 488 impacts the second limit stop 508.

Figure 78:
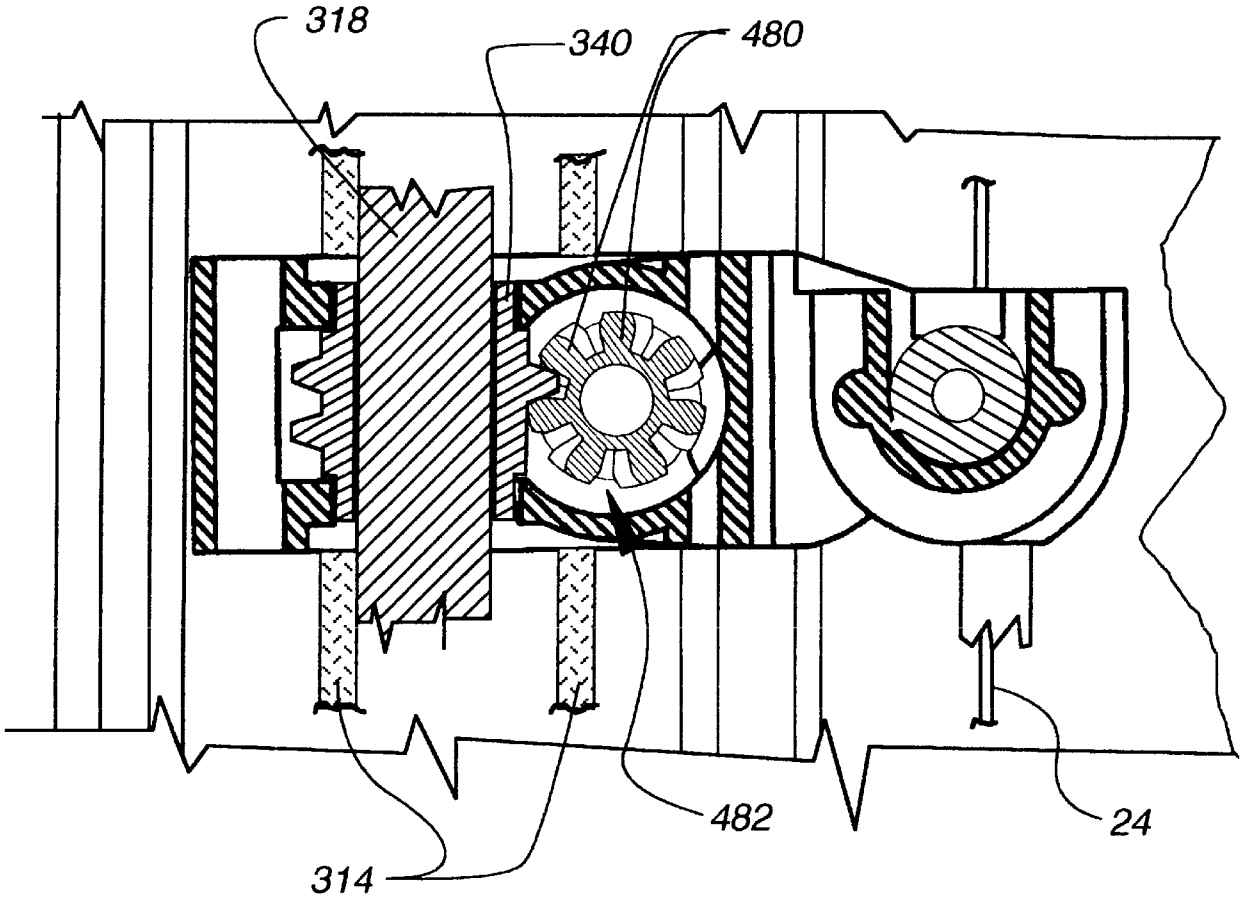
FIG. 78 is a cross-sectional view similar to FIGS. 77A and 77B, but looking downwardly at the plane containing line 78—78 of FIG. 76.

FIG. 78 is a cross-sectional view taken along line 78—78 of FIG. 76, looking downwardly. This figure clearly shows the worm gear 340 mounted on the tilt rod 318 and in engagement with the longitudinally-extending teeth 480 of the transition gear 482. As also clearly visible in FIG. 78, the longitudinally-extending teeth 480 of the transition gear 482 are offset slightly from the vertical to reduce friction between the worm gear 340 and the transition gear 482.

Figure 79:
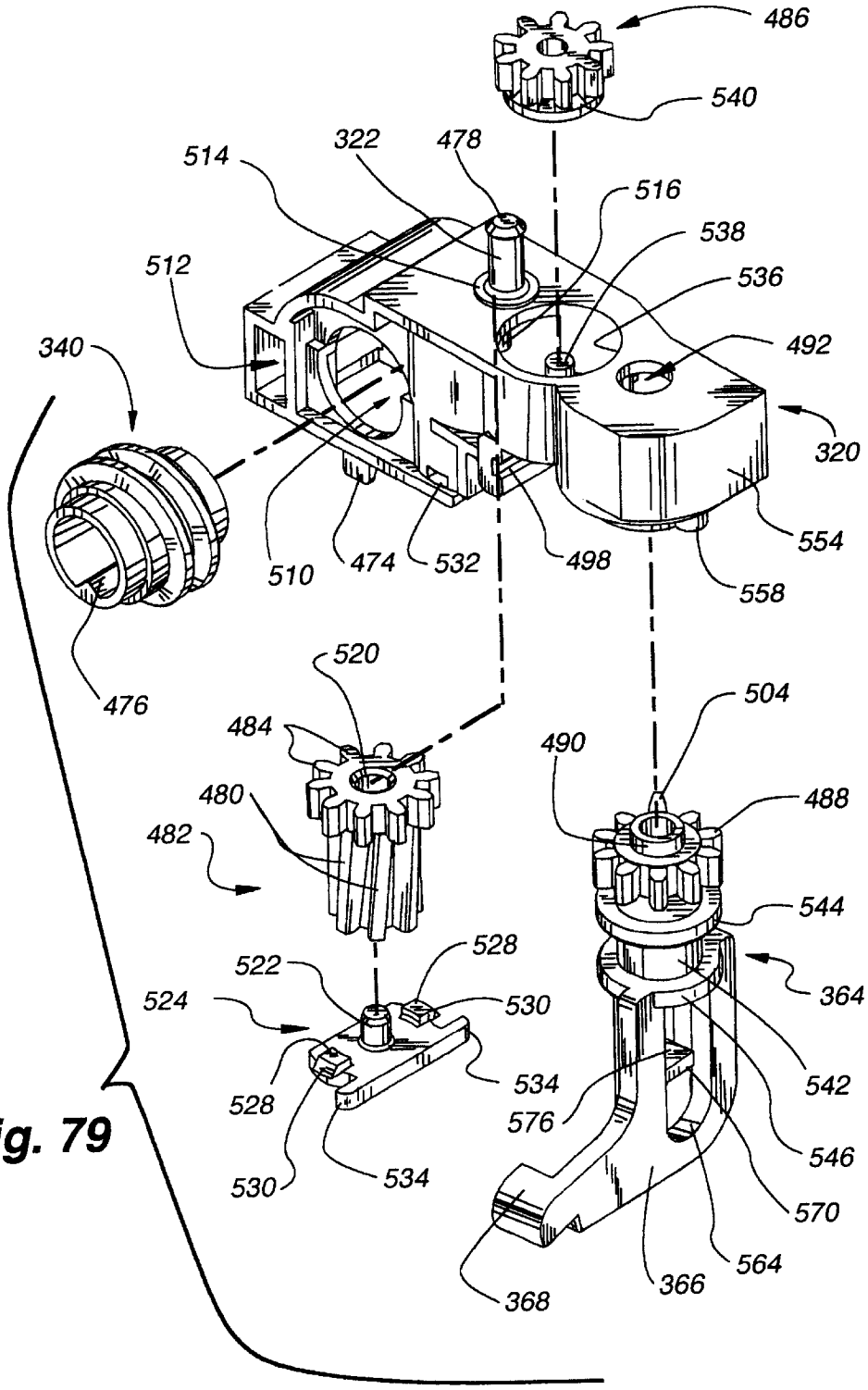
FIG. 79 is an exploded, isometric view of a first form of a carrier and the drive train attached thereto for rotating an associated vane about its vertical, longitudinal axis, according to the second alternative control system.
Figure 80:
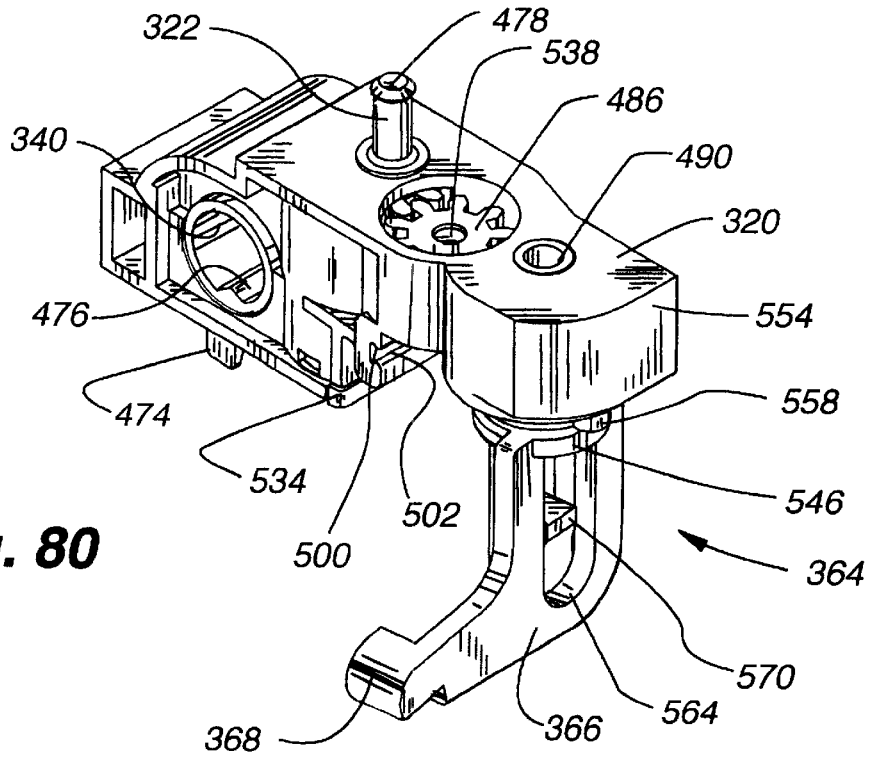
FIG. 80 is an isometric view of the carrier and drive train depicted in FIG. 79 in a fully-assembled condition.
Figure 89:
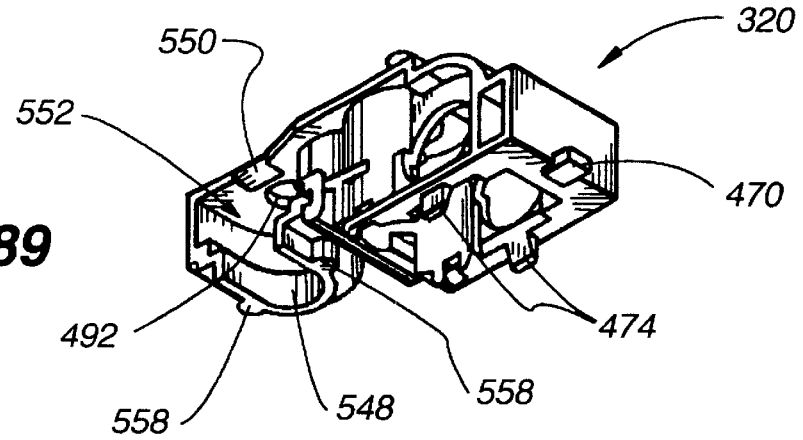
FIG. 89 is an isometric view looking upwardly at the bottom of the carrier that is also shown in FIG. 79 and 80.
Figure 90:
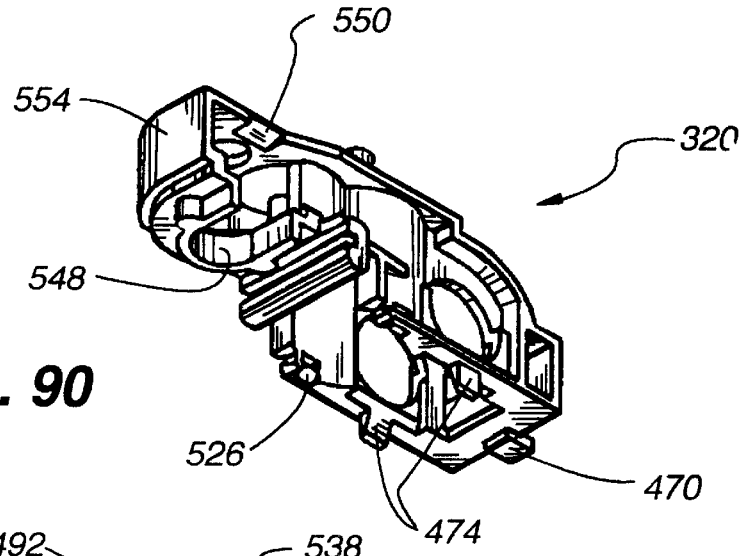
FIG. 90 is an isometric view looking upwardly at the bottom of the carrier depicted in FIG. 89 from a different perspective.

FIGS. 79 and 80 are isometric views of the carrier 320 and the gears 340, 482, 486, 488 associated therewith according to a first form of this second alternative control system 300. This carrier 320, which is also shown in the greatest detail in FIGS. 89–101, is different from the carrier 32 depicted in, for example, FIGS. 20–22, and from the alternative carrier 320' depicted in FIGS. 107–109. The carrier 320 depicted in FIGS. 79, 80, and 89–101 includes a cylindrical passage 510 to accommodate the worm gear 340, through which the tilt rod 318 is inserted. Thus, the cylindrical passage 510 is similar to the cylindrical passage 122 (FIGS. 20–22), but the cylindrical passage 122 directly accommodates the tilt rod 110 (FIG. 6A). The longitudinal drive ridge 476 formed along the inside surface of the worm gear 340 is clearly visible in FIGS. 79 and 80. As previously discussed in connection with FIGS. 75 and 76, this longitudinal drive ridge 476 rides in the longitudinal groove 338 (FIG. 40) in the tilt rod 318 for rotation therewith. The worm gear 340 is inserted into the carrier 320 by pressing the worm gear 340 into the bottom (see FIG. 94) of the carrier 320 and against the extended worm gear loading ramps 474 (FIGS. 89 and 90). The longitudinal ends of the worm gear 340, when pressed against the extended worm-gear loading ramps 474, slightly spread the wails of the carrier 320 until the worm gear 340 snaps into position in the cylindrical passage 510. When the walls of the carrier 320 flex back to their original position, the ends of the worm gear 340 are rotatably accommodated by the sidewalls the carrier 320 as shown to best advantage in FIG. 80.

Figure 92:
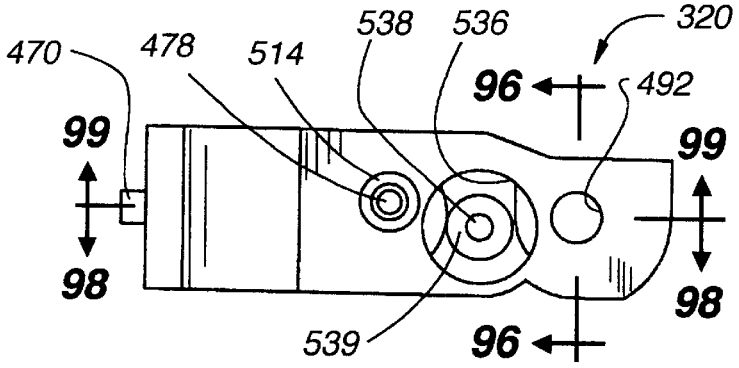
FIG. 92 is a top plan view of the carrier depicted in FIGS. 89–91.
Figure 93:
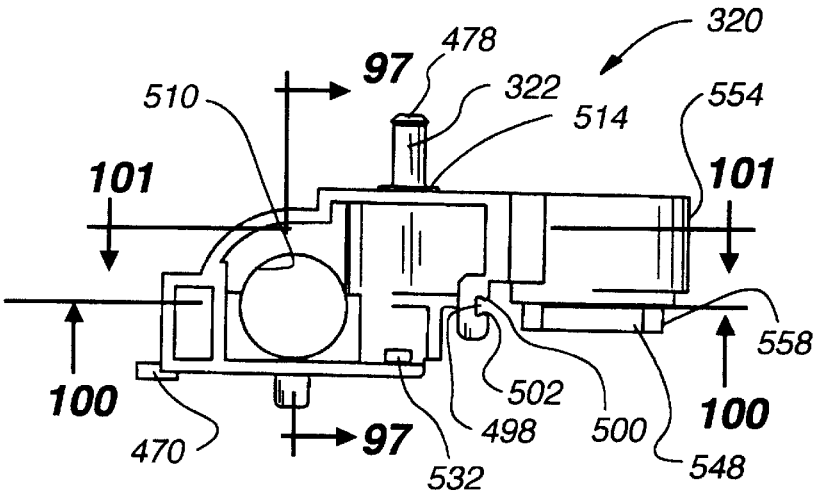
FIG. 93 is an elevation of a first side of a carrier depicted in FIGS. 89–91.
Figure 94:
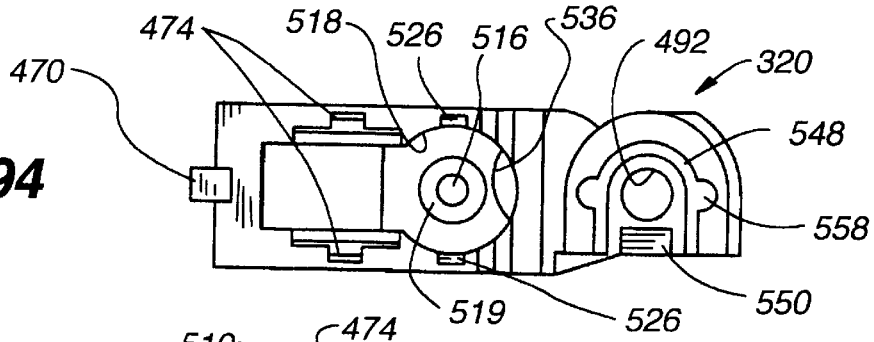
FIG. 94 is a bottom plan view of the carrier depicted in FIGS. 89–91.
Figure 95:
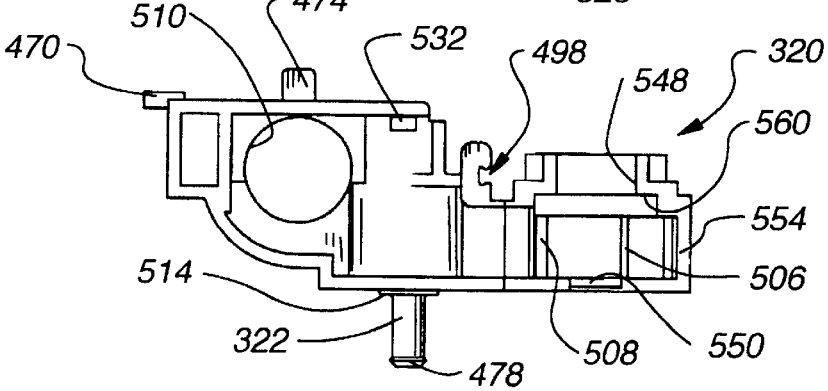
FIG. 95 is an elevation of a second side of the carrier depicted in FIGS. 89–91.

A substantially horizontal channel 512 (FIG. 79) is formed at a rear edge of the carrier 320. The alignment tab 470 (FIG. 75), which was discussed previously, extends from a lower wall of the substantially horizontal channel 512. The substantially horizontal channel 512 may be used during traverse cord 314 routing, but in the preferred embodiment of the second alternative control system 300, the traverse cord 314 does not pass through the substantially horizontal channel 512. FIGS. 92 and 94 show that the alignment tab 470 does not extend along the entire edge of the carrier 320, which reduces the friction between the alignment tab 470 and the slip ridge 468 (FIG. 75) in the internal groove 466 on the inner leg 400 of the headrail 302.

A bearing surface 514 (FIG. 79) is located at the base on the centrally-located, upstanding cylindrical pin 322. The linkage 308 (e.g., FIG. 75), once snapped over the enlarged frusto-conical head 478 and onto the upstanding cylindrical pin 322, pivotally rides on this bearing surface 514. Slightly visible in FIG. 79 is an upper mounting pin 516 for the transition gear 482. This upper mounting pin 516 for the transition gear 482 is more clearly visible in FIG. 99, which is a cross-sectional view taken along line 99—99 of FIG. 92. To install the transition gear 482, it is inserted through a hole 518 (FIG. 94) in the bottom of the carrier 320 until the upper mounting pin 516 for the transition gear 482 extends into a hole 520 (FIG. 79) in the top of the transition gear 482. The transition gear 482 seats against a bearing surface 519 (FIGS. 99 and 100) at the base of the upper mounting pin 516. At this point, a lower mounting pin 522 (FIG. 79) for the transition gear 482 is inserted into a hole (not shown but similar to the hole 520) in the bottom surface of the transition gear 482, and a transition gear retainer 524 to which the lower mounting pin 522 is attached is pressed into position on the bottom of the carrier 320. As shown in FIG. 94, a pair of transition gear retainer loading ramps 526 are formed on the bottom surface of the carrier 320. When the transition gear retainer 524 is forced upwardly against the bottom of the carrier 320, two retention nubs 528 (FIG. 79) on the longitudinal ends of the transition gear retainer 524 impact the transition gear retainer loading ramps 526. In particular, the retention nubs 528 comprise beveled surfaces 530 that ride against the transition gear retainer loading ramps 526. When sufficient pressure is applied to the transition gear retainer 524 during its installation, the retention nubs 528 thereby drive the sidewalls of the carrier 320 outward slightly allowing the retention nubs 528 to snap into a pair of nub ports 532 (one of which is visible in FIG. 79) formed in the sides of the carrier 320. When the retention nubs 528 extend into the corresponding nub ports 532, the sidewalls of the carrier 320 are permitted to return to their original position, thereby retaining the transition gear retainer 524 in position. The transition gear retainer 524 also includes a pair of alignment fingers 534 that ride against a surface of the carrier 320 when the transition gear retainer 524 is fully installed as shown in FIG. 80.

Figure 96:
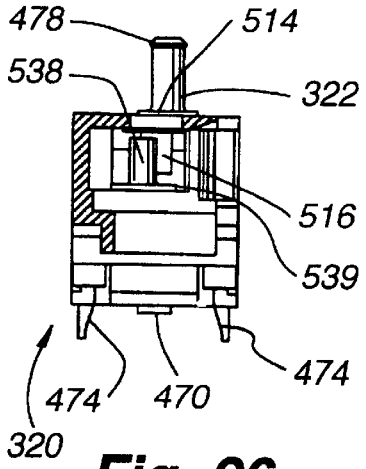
FIG. 96 is a cross-sectional view of the carrier depicted in FIGS. 89–91, taken along line 96—96 of FIG. 92.
Figure 99:
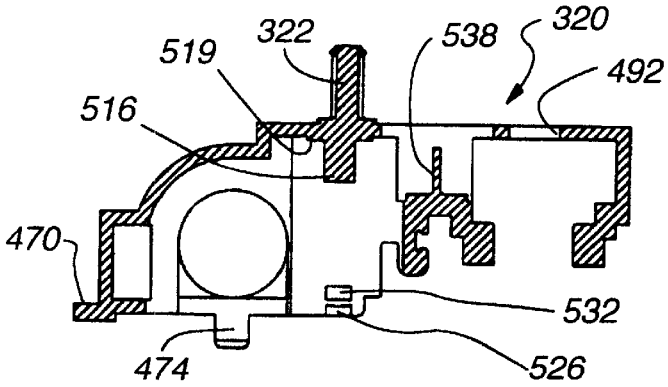
FIG. 99 is a cross-sectional view of the carrier depicted in FIGS. 89–91, taken along line 99—99 of FIG. 92.
Figure 100:
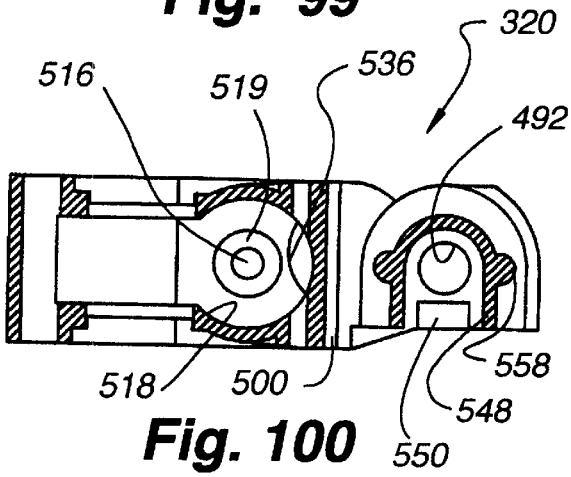
FIG. 100 is a cross-sectional view of the carrier depicted in FIGS. 89–91, taken along line 100—100 of FIG. 93.
Figure 97:
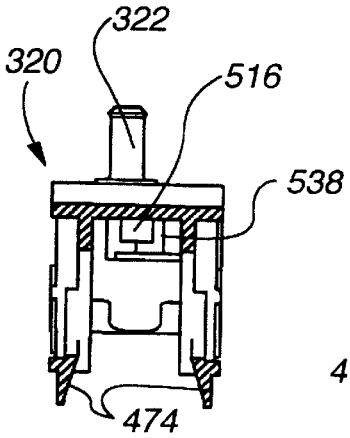
FIG. 97 is a cross-sectional view of the carrier depicted in FIGS. 89–91, taken along line 97—97 of FIG. 93.
Figure 101:
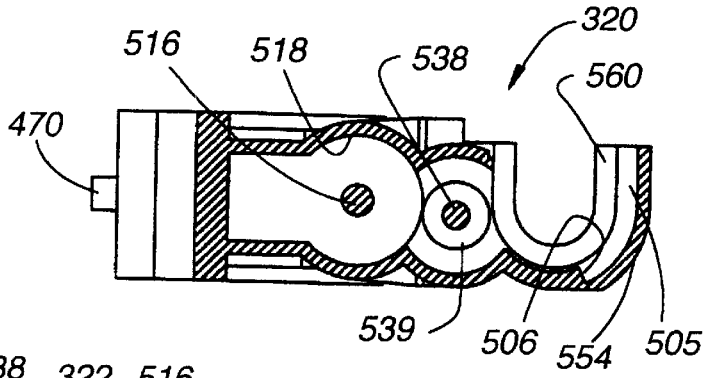
FIG. 101 is a cross-sectional view of the carrier depicted in FIGS. 819–91, taken along line 101—101 of FIG. 93.
Figure 98:
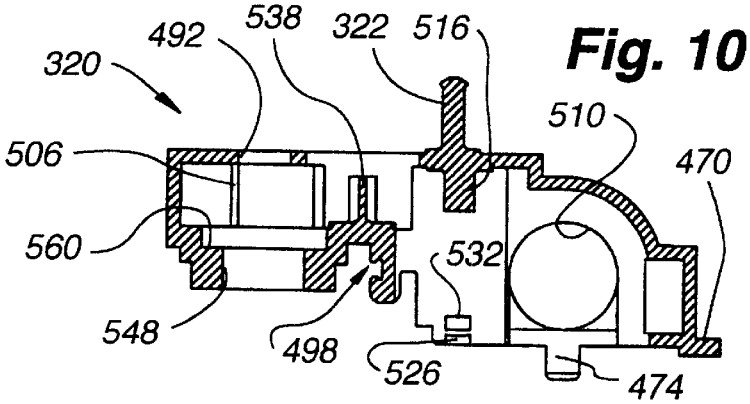
FIG. 98 is a cross-sectional view of the carrier depicted in FIGS. 89–91, taken along line 98—98 of FIG. 92.

The idler gear 486 depicted in FIG. 79 is installed through a gear insertion port 536 in the top wall of the carrier 320. When the idler gear 486 is inserted through the gear insertion port 536, it slips onto a transfer gear mounting pin 538 (see also FIG. 96) extending upwardly from a bottom surface of the carrier 320 and rests on a bearing surface 539 (FIGS. 96 and 101). When the idler gear 486 is properly installed, the horizontally-extending teeth 484 at the top of the transition gear 482 mesh with the teeth of the idler gear 486 and ride above a disc-shaped underplate 540 comprising part of the idler gear 486. Thus, the idler gear 486 is prevented from inadvertently and undesirably becoming dislodged from the transfer gear mounting pin 538.

Figure 91:
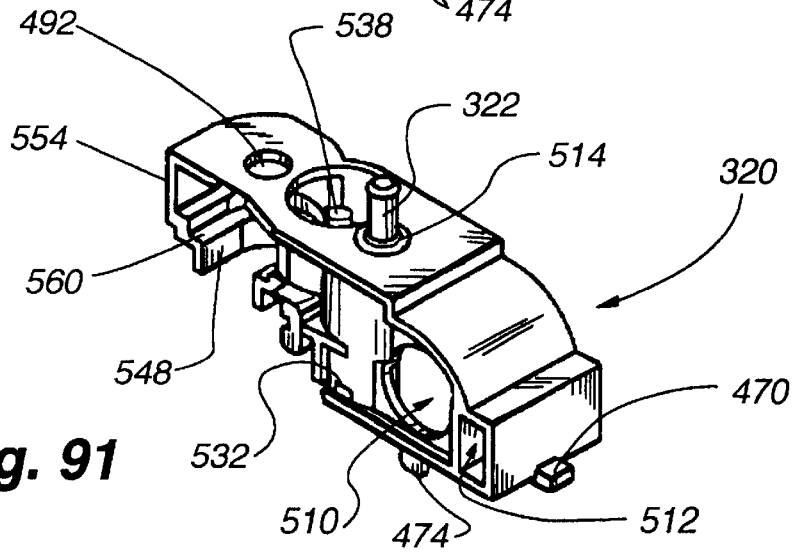
FIG. 91 is an isometric view looking downwardly at the top and one side of the carrier depicted in FIGS. 89 and 90.

To install the hanger pin 364 into the carrier 320, the cylindrical body 542 (e.g., FIG. 79) of the hanger pin 364, which is between an enlarged disc-like portion 544 and a horizontal plate portion 546, is aligned with a U-shaped hanger pin support 548 (FIGS. 89–91). Then, the upper cylindrical bearing 490 (FIG. 79) of the hanger pin 364 is pressed against an integral hangar pin loading ramp 550 (FIGS. 89 and 95), causing the top surface of the carrier 320 to flex slightly upwardly until the upper cylindrical bearing 490 snaps into a bearing port 492 formed in the top wall of the carrier 320. When properly installed, the driven hanger pin gear 488 is rotatably supported in a cavity 552 (FIG. 89) near the forward end 554 (FIG. 90) of the carrier 320, and the enlarged disc-like portion 544 of the hanger pin 364 rides on a bearing surface 560 visible in, for example, FIG. 91. A pair of semi-circular protuberances 558 (FIGS. 89 and 90) bolster the U-shaped hanger pin support 548 by effectively connecting the U-shaped hanger pin support 548 to the bottom surface of the carrier 320.

Referring to FIGS. 79–88, the first form of a hanger pin 364 for use in the second alternative control system 300 is described next in greater detail. As previously discussed, an extended tooth or radial abutment finger 504 comprises part of the driven hanger pin gear 488. As shown to best advantage in FIG. 81, this extended tooth 504 is bolstered by reinforcement 562 since its impact on the first and second limit stops 506, 508 (e.g., FIG. 77A) defines the angular limits that the vanes 24 may be rotated. Below the driven hanger pin gear 488 is the enlarged plate-like portion 544. Below that is the cylindrical body portion 542 just above the horizontal plate portion 546. Extending downwardly from the horizontal plate portion 546 is the boot-shaped web member 366 having a U-shaped cutout 564 in it. The boot-shaped web member 366 has the thickened toe 368 at its distal end. An overplate 566 (FIG. 81) is attached along one edge of the thickened toe 368, and the bottom of the thickened toe 368 defines the abutment surface 370 that was previously described in connection with FIG. 44.

Figure 81:
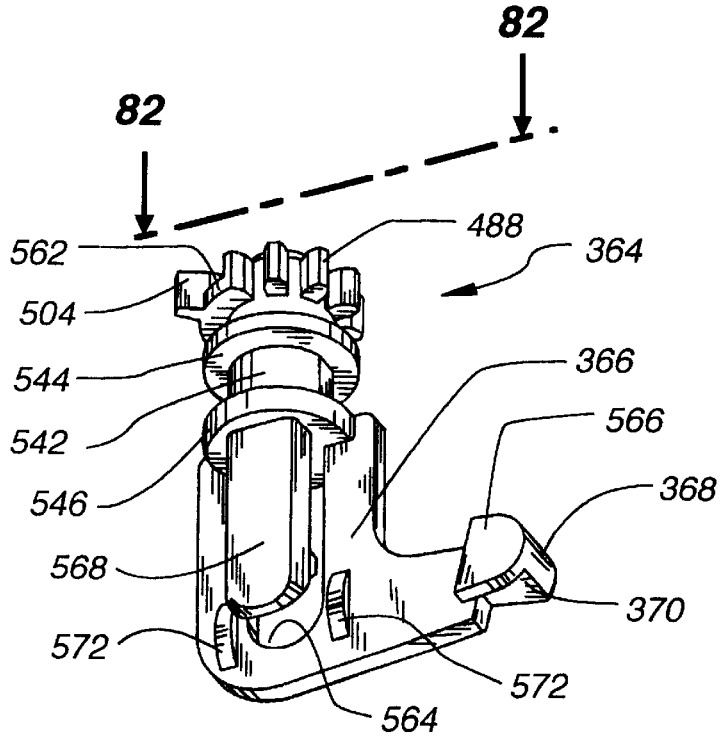
FIG. 81 is an isometric view looking upwardly at a first form on a hanger pin to be used in the second alternative control system according to the present invention.
Figure 82:
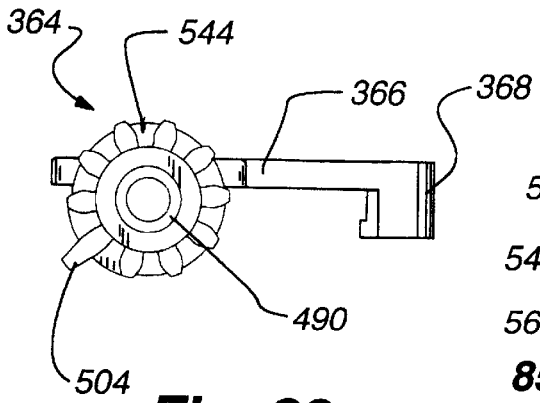
FIG. 82 is a top planned view of the hanger pin depicted in FIG. 81, taken along line 82—82 of FIG. 81.
Figure 83:
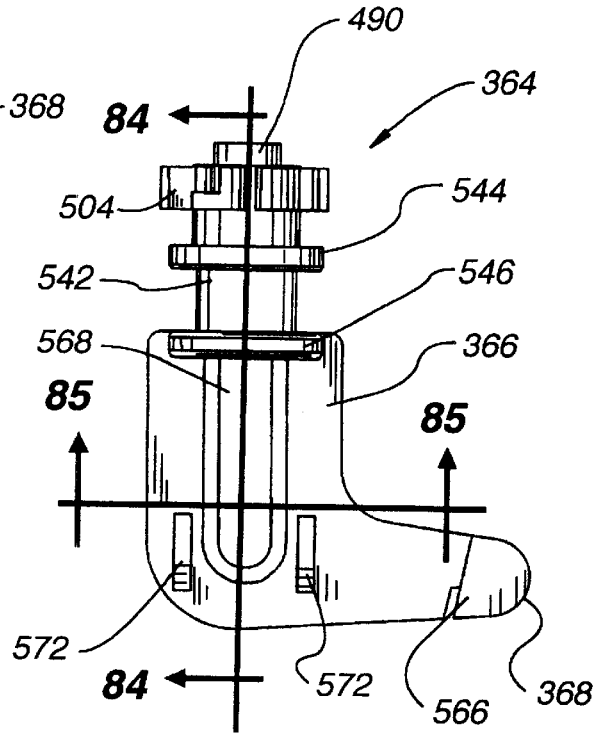
FIG. 83 is an elevation of the hanger pin depicted in FIG. 81.
Figure 84:
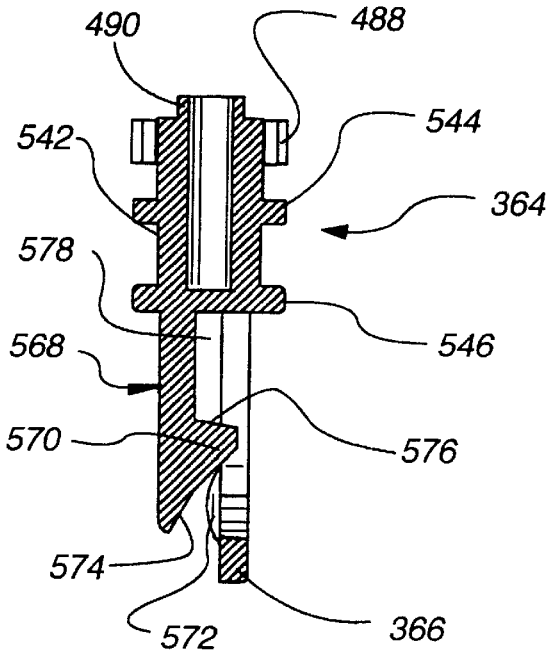
FIG. 84 is a cross-sectional view of the hangar pin depicted in FIG. 81, taken along line 84—84 of FIG. 83.
Figure 85:
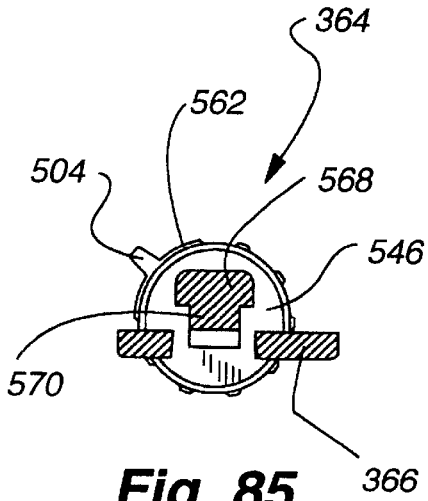
FIG. 85 is a cross-sectional view of the hanger pin depicted in FIG. 81, taken along line 85—85 of FIG. 83.

As shown to good advantage in FIG. 81, a pin 568 extends downwardly from a lower surface of the horizontal plate portion 546. At a distal end of the pin 568 is an enlarged head 570 (FIG. 80) that projects partly into the U-shaped cutout 564 through the boot-shaped web member 366. A pair of guide bumps 572 are formed along the lower side edges of the U-shaped cutout 564 on one side of the boot-shaped web member 366. When a vane 24 is installed onto the hanger pin 364, either directly or via the reinforcing tab 26 (e.g., FIG. 44) attached to the upper edge 372 of the vane 24, the reinforcing tab 26 is guided over the guide bumps 572 and against a beveled surface 574 (FIG. 84) of the enlarged head 570 on the lower distal end of the pin 568. As the reinforcing tab 26 is forced upwardly, the enlarged head 570 of the pin 568 and the guide bumps 572 are forced apart until the enlarged head 570 snaps through the port 28 (FIG. 40) through the reinforcing tab 26. The weight of the vane 24 is then supported by an upper surface 576 (FIGS. 79 and 84) of the enlarged head 570 in the gap 578 between the pin 568 and the boot-shaped web member 366. In order to remove the vane 24, it is necessary to flex the pin 568 away from the boot-shaped web member 366 until a gap between the enlarged head 570 and the guide bumps 572 permits the reinforced tab 26 to slip from the hanger pin 364. When the vane 24 is properly installed (FIG. 44), as previously discussed, the upper edge 372 of the vane 24 is accommodated between the back side of the overplate 566 and a surface of the boot-shaped web member 366, against the abutment surface 370 (FIG. 81) on the underside of the thickened toe 368.

Figure 86:
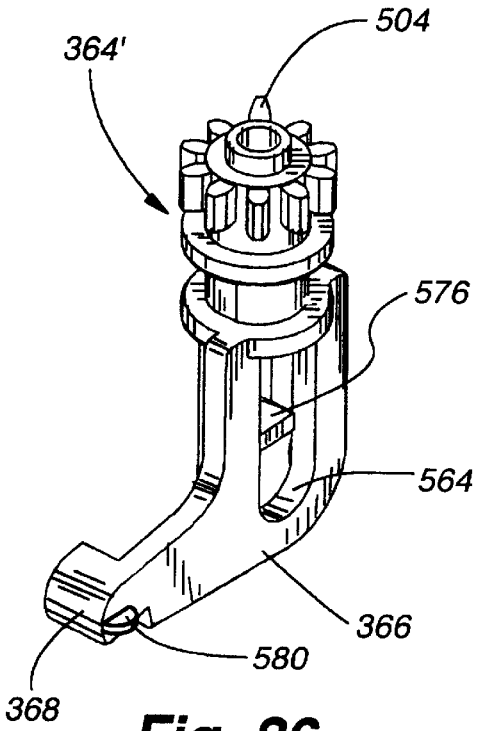
FIG. 86 is an isometric view looking downwardly at a second fort of hanger pin, having a bumper nub, for use in the second alternative control system according to the present invention.
Figure 87:
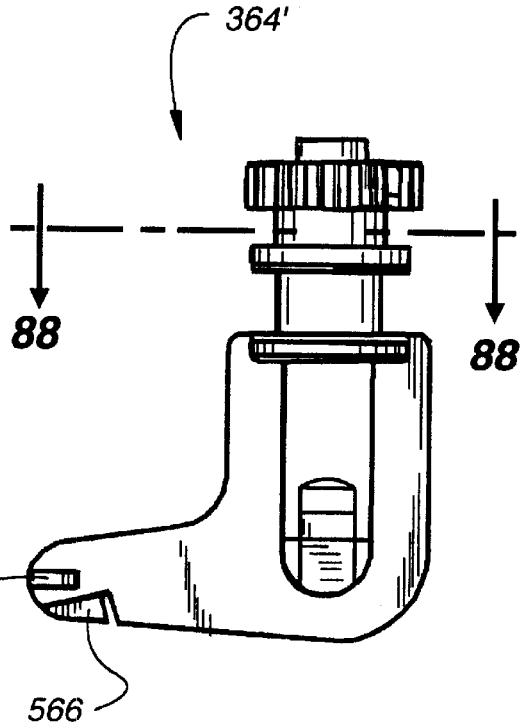
FIG. 87 is an elevation of the hanger pin depicted in FIG. 86.
Figure 88:
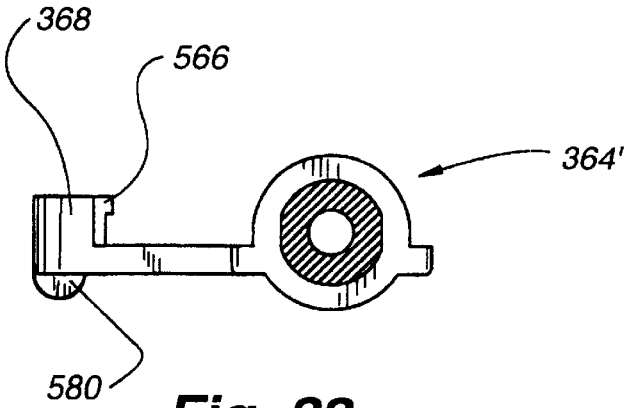
FIG. 88 is a partial cross-sectional view of the hanger pin depicted in FIG. 86, taken along line 88—88 of FIG. 87.

FIGS. 86–88 depict an alternative embodiment for the hanger pin 364'. In this embodiment, a bumper nub 580 is formed on the side of the thickened toe 368 opposite of the side to which the overplate 566 is attached. When the vanes 24 are rotated to their closed configuration (e.g., FIGS. 42 and 48), the bumper nub 580 rests against the adjacent vane 24 thereby minimizing the contact between the hanger pin 364' and the adjacent vane 24 and the wear that can be caused by excessive contact between these two components.

Figure 104:
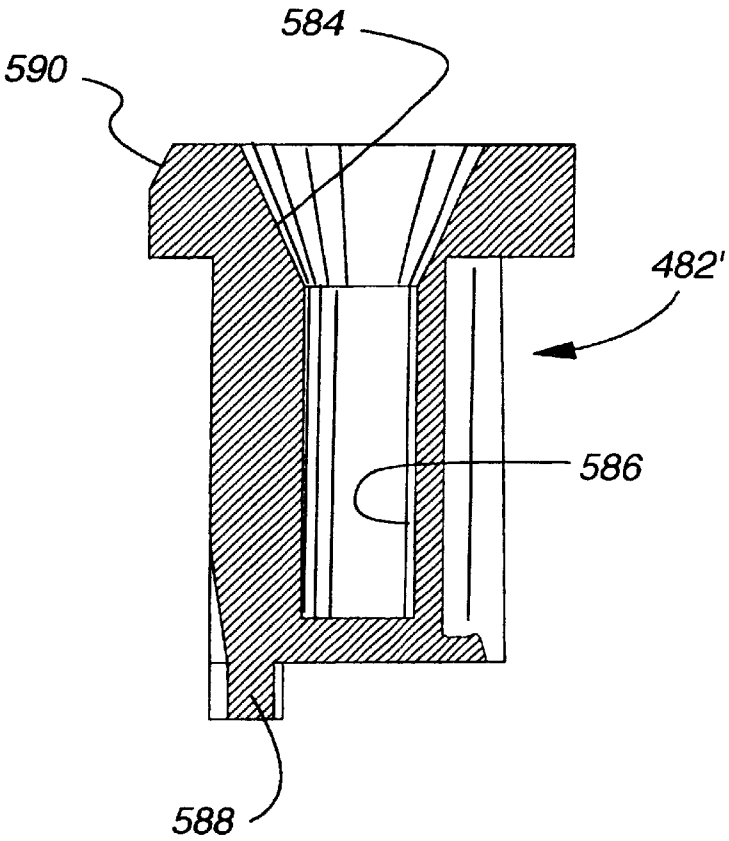
FIG. 104 is a cross-sectional view of the transition gear depicted FIGS. 102 and 103, taken along line 104—104 of FIG. 102.
Figure 103:
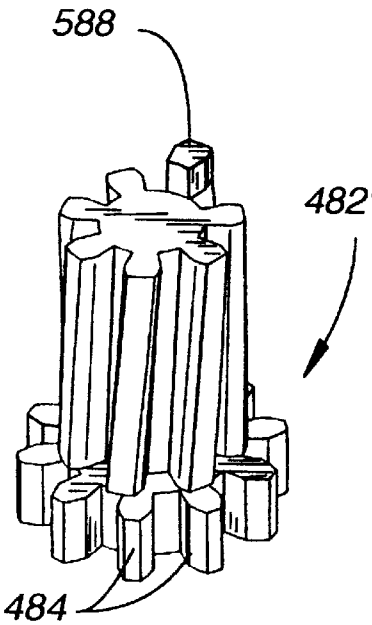
FIG. 103 is an isometric view of the bottom of the transition gear depicted in FIG. 102.
Figure 102:
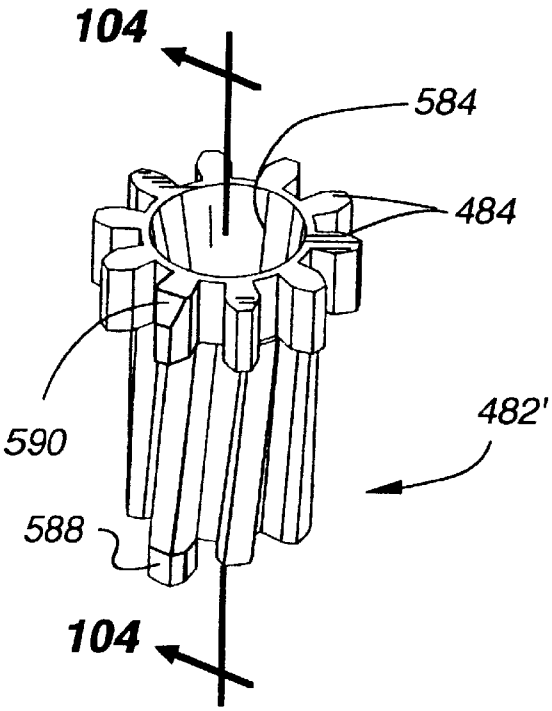
FIG. 102 is an isometric view of an alternative form for the transition gear, depicted to good advantage in its first form in FIG. 79, for use with the alternative form of the carrier depicted in FIGS. 107–109.
Figure 109:
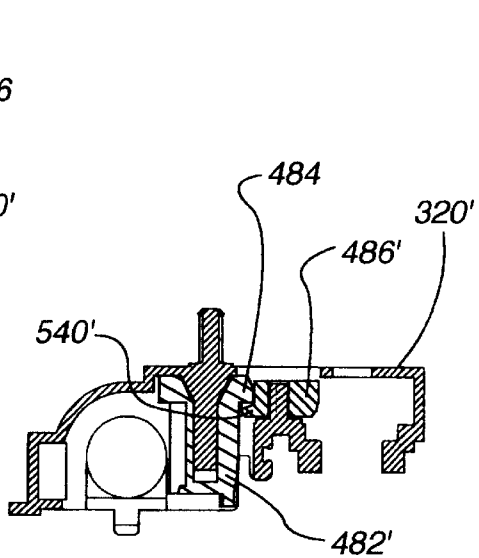
FIG. 109 is similar to FIGS. 107 and 108, but depicts the transition gear and carrier idler gear fully installed in their operational positions in the second form of the carrier.
Figure 107:
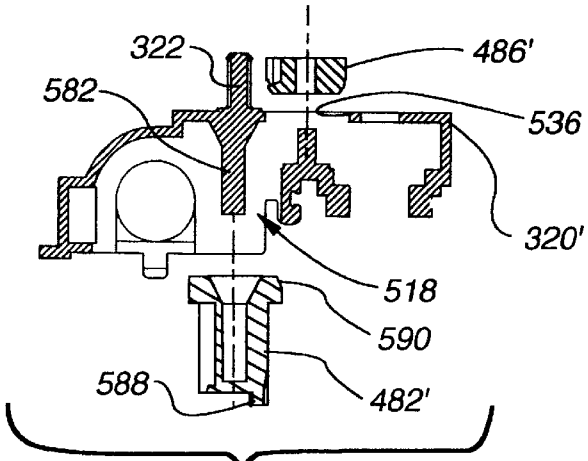
FIG. 107 is an exploded, cross-sectional view of a second form of the carrier for use in the second alternative control system, with the corresponding transition gear and carrier idler gear positioned for installation.
Figure 108:
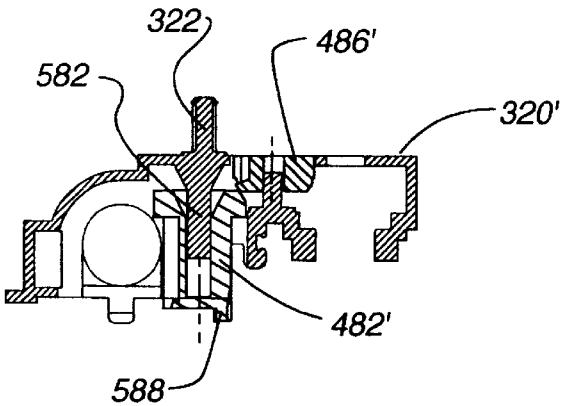
FIG. 108 is similar to FIG. 107, but depicts the relative positions of the transition gear and carrier idler gear as assembly continues.

FIGS. 102–104 depict an alternative transition gear 482' for use with an alternative form of the carrier 320' having an extended post 582 (FIGS. 107–109). As shown in FIGS. 102 and 104, in this form of the transition gear 482', the center of the transition gear 482' is hollowed out to define a frusto-conical portion 584 adjoining a cylindrical portion 586 (FIG. 104). The hollowed-out central portion of the transition gear 482' is designed to accommodate the extended post 582, which is essentially an enlarged version of the upper mounting pin 516 depicted in, for example, FIGS. 94, 98, and 99. This alternative form of the transition gear 482' also includes an alignment marker 588 for purposes described below in connection with FIGS. 107–109.

Figure 105:
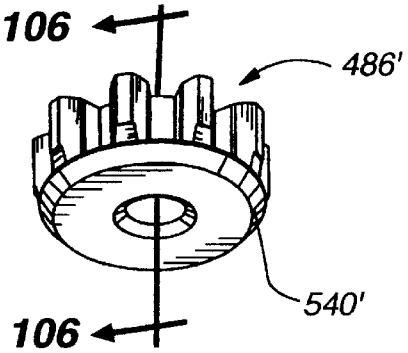
FIG. 105 is an isometric view of the bottom of an alternative form of the carrier transfer or idler gear depicted to good advantage in its first form in FIG. 79.
Figure 106:
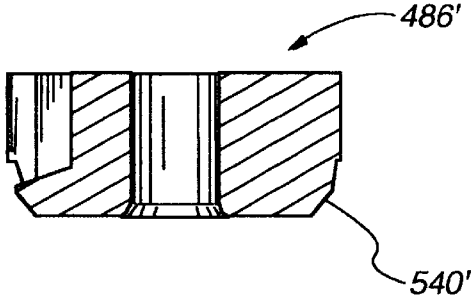
FIG. 106 is a cross-sectional view of the alternative form of the carrier idler gear taken along line 106—106 of FIG. 105.

FIGS. 105 and 106 depict an alternative form for the idler gear 486'(the other idler gear 486 is depicted to good advantage in FIG. 79). In this form of the idler gear 486', the lower edges of the gear teeth are sloped or beveled. Similarly, the circumference of the disc-shaped underplate 540' of the idler gear 486' is highly beveled.

Referring next to FIGS. 107–109, when the transition gear 482' depicted in FIGS. 102–104 is assembled with the idler gear 486' depicted in FIGS. 105 and 106 in the alternative carrier 320' depicted in FIGS. 107–109, the purpose of the altered features become more readily apparent. In FIG. 107, the idler gear 486' is shown just above the carrier 320' ready for insertion through the gear insertion port 536. Similarly, the transition gear 482' is positioned just below the carrier 320' ready for insertion through the hole 518 and onto the extended post 582. In FIG. 108, the idler gear 486' and the transition gear 482' have been partially inserted. As shown in FIG. 108, when the alignment marker 588 on the transition gear 482' is placed directly below the idler gear 486', a lone beveled tooth 590 (shown to best advantage in FIG. 102) on the transition gear 482' is aligned with the circumferentially beveled edge of the disc-shaped underplate 540' on the idler gear 486'. With the two beveled surfaces thus aligned, further downward pressure on the idler gear 486' and upward pressure on the transition gear 482' results in the complete assembly depicted in FIG. 109. Again, the radially-extending teeth 484 on the upper portion of the transition gear 482' ride above the disc-shaped underplate 540' on the idler gear 486' when the idler gear 486' and transition gear 482' are fully installed in the carrier 320' as shown in FIG. 109.

FIGS. 110–114 depict an alternative embodiment of the covering 304' wherein a face sheet of material 592 connects the vanes 24. FIG. 110 is thus similar to FIG. 27. When a face sheet of material 592 joins or interconnect the vanes 24, it is desirable to include additional hardware that permits the ends of the headrail 302 to be covered when the covering 304' is in selective configurations. In FIG. 110, a mounting block 594 (see also, FIGS. 115–119) has been attached to the lead carrier 596, which may be the same as the carrier 320 (FIGS. 79, 80, and 89–101) or the alternative carrier 320' (FIGS. 107–109). This mounting block 594 supports a base leg 598 of a spring-loaded pivot arm 600. The end leg 602 of the pivot arm 600 pivotally supports a free end vane 604 on an affixment pin 606. As shown to good advantage in FIG. 110, when the distal end (i.e., the end that carries the pin 606) of the end leg 602 is riding along the front of the headrail 302 (i.e., when the covering 304' is not fully extended), a first arcuate pocket 608 (see also FIG. 124) on the distal end of the base leg 598 surrounds a first substantially vertical edge 610 (see FIG. 122) of a C-shaped channel 612 comprising part of the mounting block 594. In particular, the first arcuate pocket 608 is an arcuate stop pocket formed between an extension finger 614 (FIG. 124) on the base leg 598 and a hollow pivot shaft 616 (see also FIG. 122) on the base leg 598. At the left edge of FIG. 110, the fixed-end vane 458 is connected to a fixed-end vane mounting system including the pivot shaft 454 mounted in the interchangable pivot shaft support 452 of the shell 324 of the primary end cap 310.

In FIG. 111, the covering 304' has been extended longitudinally to an intermediate position. The distal end of the end leg 602 of the pivot arm 600 continues to ride against a front surface 618 of the headrail 302. Also, the first arcuate pocket 608 (FIG. 110) behind the extension finger 614 (see also FIGS. 122 and 124) and the hollow pivot shaft 616 continues to accommodate the first substantially vertical edge 610 of the C-shaped channel 612 of the mounting block 594. This helps to ensure that the pivot arm 600 is not rotated too far counterclockwise in FIG. 111.

FIG. 112 is similar to FIGS. 110 and 111, but the covering 304' is shown in a fully-extended configuration, similar to what is shown in FIG. 26 for the first embodiment of the present invention. When the covering 304' is fully extended, the distal end of the end leg 602 of the pivot arm 600 extends around the secondary end cap 312. In this configuration, the end of the headrail 302 is covered by the free end vane 604 to create a more esthetically pleasing window covering 304'. As shown in FIG. 112, when the spring-loaded pivot arm 600 is permitted to rotate around the secondary end cap 312, the other arcuate stop pocket 620 (see also FIGS. 110 and 122) defined by the base leg 598 of the pivot arm 600 and the hollow pivot shaft 616 accommodates the opposite or second substantially vertical edge 622 (FIG. 122) of the C-shaped channel 612 in the mounting block 594. This prevents the pivot arm 600 from over-rotating in the clockwise direction as shown in FIG. 112. The free end vane 604 is attached to the affixment pin 606 using mounting plates 240, 246 like those depicted in, for example, FIG. 33.

FIG. 113 is similar to FIG. 112, but the vanes 24 have been rotated to a closed configuration. Similarly, FIG. 114 depicts the fully extended covering 304' with the vanes 24 rotated in a direction opposite from that depicted in FIG. 113. As shown in FIG. 114, when the vanes 24 are rotated, the fixed end vane 458 pivots about the pivot shaft 454 mounted in the interchangeable pivot shaft support 452 (e.g., FIG. 65) under the influence of the face sheet of material 592.

Figure 115:
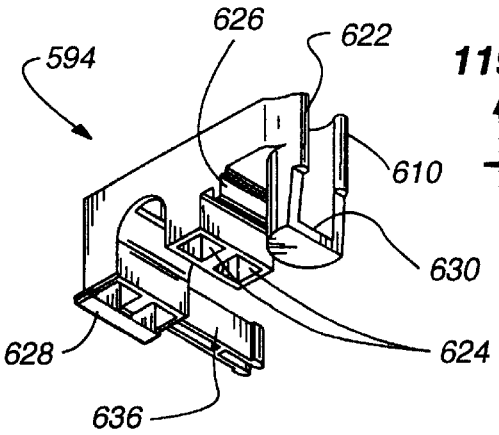

FIGS. 115–119 depict details of the mounting block 594 for use in the second alternative control system 300. FIG. 115 is an isometric view looking upwardly at a bottom of the mounting block 594. As shown in this figure, the mounting block 594 includes two vertically-oriented cord passages 624. Also, a vertical positioning wall 626 extends downwardly from a lower surface of the mounting block 594. Along a lower rear edge of the mounting block 594 extends a plate-like extension 628 that rides in the internal groove 466 (FIG. 75) of the headrail 302 when the mounting block 594 is connected to the lead carrier 596 and the carrier and mounting block combination is installed in the headrail 302. The C-shaped channel 612 (FIG. 117) is defined by the first substantially vertical edge 610 and the second substantially vertical edge 622. At a lower end of the C-shaped channel 612 is a retention shelf 630. When the pivot arm 600 is attached to the mounting block 594, the retention shelf 630 can prevent the pivot arm 600 from passing completely through the C-shaped channel 612.

Figure 116:
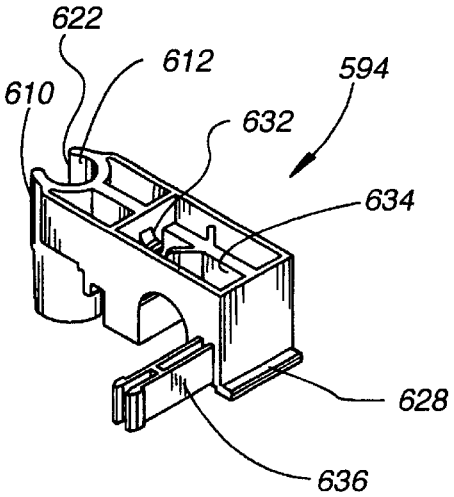
Figure 118:
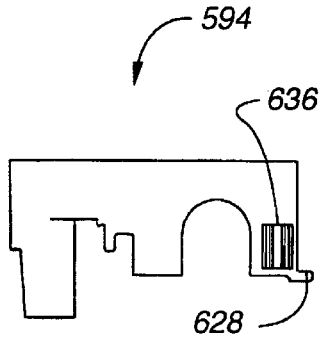
Figure 119:
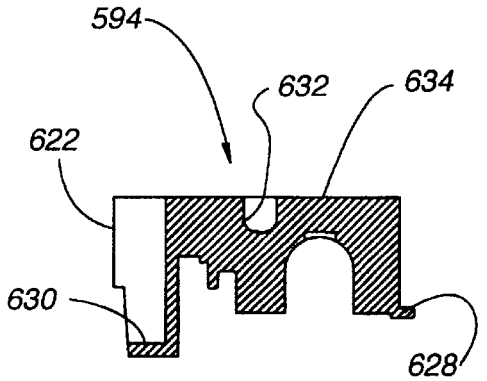

As shown to good advantage in FIG. 116, a cord tray 632 is formed along the edge of a dividing wall 634 in the mounting block 594. The purpose of the cord tray 632 is discussed further below in connection with FIG. 129, but essentially it permits traverse cord 314 routing that forces the carrier attached to the mounting block 594 to move with the traverse cord 314.

Figure 117:
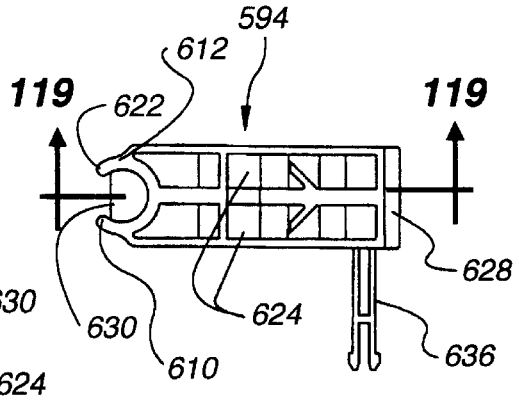

As shown to good advantage in FIGS. 115–117, snap fingers 636 extend from one side of the mounting block 594. These snap fingers 636 removably secure the mounting block 594 to the lead carrier 596 when they are forced through the substantially horizontal channel 512 (FIGS. 79 and 91) of a carrier. When forced through such a channel 512, the snap fingers 636 flex towards each other while passing through the channel 512, and, when the snap fingers 636 exit the opposite side of the carrier, they flex back to their normal configuration, which effectively locks the mounting block 594 to the carrier 320.

Figure 116A:
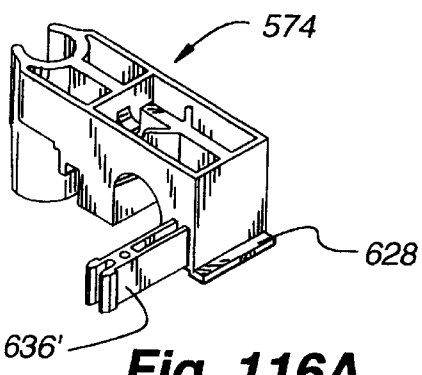
Figure 116B:
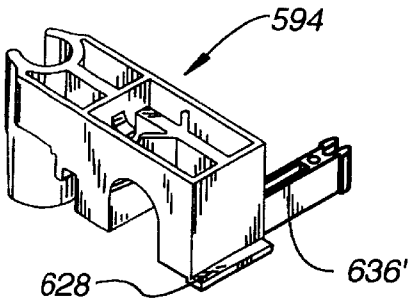

FIGS. 116A and 116B depict a slightly different type of snap fingers 636', but they work in substantially the same matter as those depicted in FIGS. 115–118. Since the mounting block 594 can be connected to either side of a carrier, depending on the particular configuration, it is necessary to have mounting blocks with snap fingers extending from either side of the mounting block. In FIG. 116A, the snap fingers 636' extend from one side of the mounting block 594, and in FIG. 116B, the snap fingers 636' extend from the other side. It is possible to make a single mounting block having snap fingers extending from each side of the mounting block (not shown). In this latter case, one set of snap fingers could be broken from the mounting block when it is determined that they are unnecessary for a selected configuration.

Figure 120B:
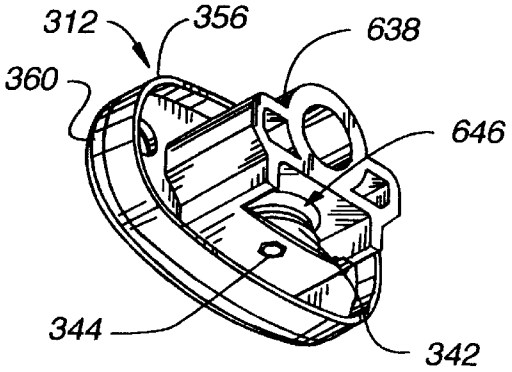
Figure 120A:
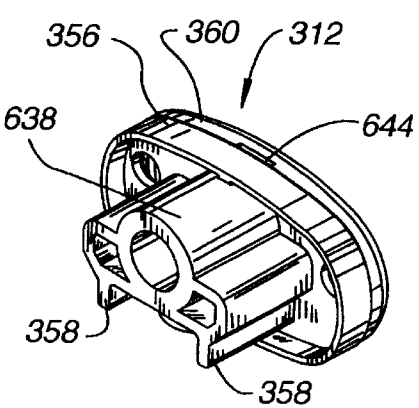
Figure 121:
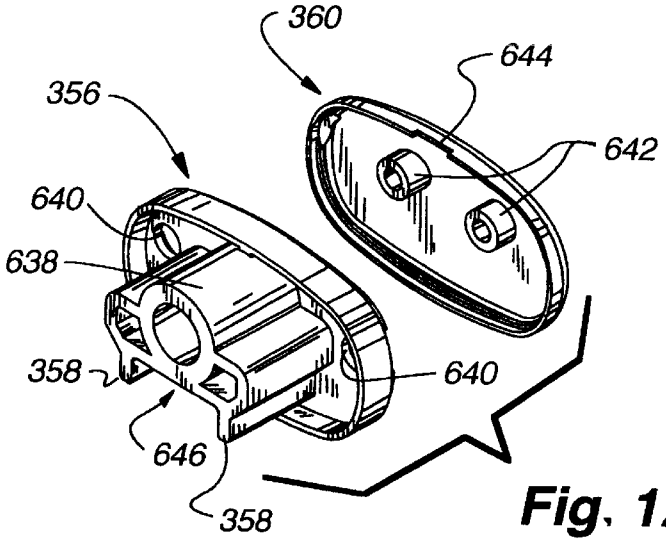

FIGS. 120A , 120B, and 121 are isometric views of the secondary end cap 312 in its first form (i.e., when it is not formed from components that generally form a primary end cap). In FIGS. 120A and 120B, the cover plate 360 is shown as attached to the secondary end cap main body 356. The secondary end cap main body 356 includes a cylindrical tilt rod support 638. Also, a pair of passages 640 exists through the secondary end cap main body 356 to accommodate screw-type fasteners 354 (FIG. 40) used to attach the secondary end cap main body 356 to the headrail 302. Once the secondary end cap main body 356 has been attached to the headrail 302, the cover plate 360 is then attached to the secondary end cap main body 356. In the embodiment of the cover plate 360 depicted in FIG. 121, two cylindrical members 642 are formed on an inner surface of the cover plate 360. Two corresponding nubs (not shown) are formed on an outer surface of the secondary end cap main body 356. The corresponding nubs are of the proper configuration and size so that the cylindrical members 642 on the inner surface of the cover plate 360 can be forced onto the nubs to retain (frictionally or by gluing) the cover plate 360 on the secondary end cap main body 356. The cover plate 360 includes a notch 644 to permit its removal for access to the screw-type fasteners 354 holding the secondary end cap main body 356 to the headrail 302. As shown to the best advantage of FIG. 120B, the idler pulley 342 (FIG. 40) around which the traverse cord 314 passes is mounted in a pulley pocket 646 formed along an inner and lower surface of the main body 356 by the mounting pin 344.

FIGS. 122, 123A, and 123B depict the hardware that permits the free end vane 604 (FIGS. 110–114) to wrap around the headrail 302 and cover the secondary end cap 312. FIG. 122 is an exploded isometric view of the hardware. As shown, the pivot arm 600 is connected to the mounting block 594 by sliding the hollow pivot shaft 616 on the distal end of the base leg 598 of the pivot arm 600 into the C-shaped channel 612 of the mounting block 594. A torsion spring 648 is mounted in a spring notch 650 along the hollow pivot shaft 616 to desirably bias the pivot arm 600, and an affixment pin 606 is then mounted to the distal end of the end leg 602 of the pivot arm 600. The assembled hardware is shown in a first orientation in FIG. 123A and a second orientation in FIG. 123B. In FIGS. 123A and 123B, the pivot arm 600 is shown in the position it would assume with the covering 304' in the fully-extended configuration depicted in FIGS. 112–114.

FIGS. 124–127 are fragmentary views, including cross-sectional views, of a portion of the hardware depicted in FIGS. 122, 123A, and 123B. In particular, FIG. 124 is a fragmentary top plan view of the C-shaped channel 612 on the mounting block 594 with the hollow pivot shaft 616 of the pivot arm 600 mounted therein, and with the pivot arm 600 in the configuration shown in FIGS. 110 and 111. FIG. 125 is a fragmentary cross-sectional view along line 125—125 of FIG. 124. As shown in FIG. 125, the torsion spring 648 is mounted in the spring notch 650 between a first cylindrical portion 652 and a second cylindrical portion 654 that together define the hollow pivot shaft 616 of the pivot arm 600. FIG. 126 is a downwardly-looking, cross-sectional view taken along line 126—126 of FIG. 125. It is apparent from FIG. 126 how the torsion spring 648 operates to push the pivot arm 600 in a clockwise direction as shown in FIG. 126. FIG. 127 is similar to FIG. 126, but the pivot arm 600 has been rotated to its maximum clockwise position (i.e., to the configuration depicted in FIGS. 112–114, 123A, and 123B).

FIG. 128 is a plan view of a duel-draw covering 304" having a face sheet of material 592 joining the vanes 24. In this configuration, a mounting block 594 has been attached to each of two different lead carriers 596 to permit the covering 304" to be drawn simultaneously from two sides or retracted simultaneously toward the two ends of the headrail 302. FIG. 129 is a cross-sectional view taken along line 129—129 of FIG. 128 and shows the traverse cord 314 routing that allows the dual-draw system to work. Looking at the left edge of FIG. 129, a first end of the traverse cord 314 has been passed through one of the cord passages 624 (FIG. 115) and tied in a first knot 658 to prevent it from slipping downward back through the cord passage 624. The traverse cord then exits to the left side of the drawing to one end of the headrail 302. When the traverse cord 314 returns (i.e., the lower traverse cord along the left edge of FIG. 129, it then passes upward through a cord passage 624 in the other mounting block 594 (the righthand one in FIG. 129) and over the cord tray 632 (FIG. 116) before passing downward through the other cord passage 624 through the mounting block 594. Since the traverse cord 314 is thereby bent sharply over the cord tray 632, when the traverse cord 314 exiting the right-most cord passage 624 in the right-most mounting block 594 depicted in FIG. 129 is pulled rightward, the right-most mounting block 594 moves rightward with the traverse cord 314. After exiting the right-most cord passage 624 in the right-most cord block 594, the traverse cord 314 exits the right-hand edge of FIG. 129 to the other end of the headrail 302. When it returns from the right-hand edge as the upper of the two traverse cords, it is subsequently routed back through the headrail toward the only remaining vacant cord passage 624 in the left-most mounting block 594 depicted in FIG. 129, where it is passed upwards through that cord passage 624 and tied in a second knot 660. Thus, the traverse cord 314 forms a continuous loop.

FIG. 131 schematically shows the complete traverse cord 314 routing for the dual-draw system. As shown, the rear-most leg of the traverse cord 314 (i.e., the one with the upwardly and rightwardly pointing arrows associated therewith in FIG. 131) is attached at point 662 to the mounting block 594 attached to one lead carrier. The traverse cord 314 then goes around the idler pulley 342' and begins heading back toward the tilt wand 336. At point 664, the traverse cord 314 is attached to the other mounting block 594 and then continues in its loop back to the tilt wand 336. As may be seen from reviewing FIG. 131, when the traverse cord 314 is pulled in a first direction, the mounting blocks 594 are pulled towards each other, and when the traverse cord 314 is pulled in the opposite direction, the mounting blocks 594 are pulled away from each other.

FIG. 130 is similar to FIG. 131, but schematically depicts the traverse cord 314 routing for a single draw system like that shown in FIGS. 110–114. In FIG. 130, the traverse cord 314 attaches to a mounting block at point 668.

Although a first and two alternative embodiments of this invention have been described above with a certain degree of particularity, those skilled in the art could make numerous alterations to the disclosed embodiments without departing from the spirit or scope of this invention. All directional references (e.g., upper, lower, upward, downward, left, right, leftward, rightward, top, bottom, above, below, vertical, horizontal, clockwise, and counterclockwise) are only used for identification purposes to aid the reader's understanding of the present invention, and do not create limitations, particularly as to the position, orientation, or use of the invention. It is intended that all matter contained in the above description or shown in the accompanying drawings shall be interpreted as illustrative only and not limiting. Changes in detail or structure may be made without departing from the spirit of the invention as defined in the appended claims.

The invention claimed is:

1. A control system for a vertical blind that includes a plurality of vertically-suspended vanes, said control system comprising an elongated headrail, said vanes adapted to be longitudinally spaced along said elongated headrail; and a primary end cap, said primary end cap comprising a main body including a pair of integrally-formed arcuate cord troughs adapted to cradle a traverse cord that selectively retracts and extends said vanes, wherein said arcuate cord troughs are curved to guide said traverse cord into a longitudinal direction of said elongated headrail; and a shell slidingly engage with and covering said main body.

2. The control system of claim 1, wherein said main body further comprises a headrail pocket adapted to frictionally receive an end of said elongated headrail.

3. The control system of claim 2, wherein said main body further comprises a mounting tongue adapted to frictionally engage a lower exterior surface of said elongated headrail.

4. The control system of claim 2, wherein said main body further comprises two traverse cord passages extending through a lower portion of said main body, each said traverse cord passage having a first end opening into said headrail pocket and a second end opening onto one of said arcuate cord troughs.

5. The control system of claim 1, wherein said main body further comprises a pair of shell alignment shelves, and said shell further comprises a pair of shell alignment channels, said shell alignment channels slidingly engaging said shell alignment shelves.

6. The control system of claim 1, wherein said main body further comprises a first containment tab, and said shell further comprises a second containment tab, said first and second containment tabs together defining first and second containment channels adapted to slippingly retain the traverse cord.

7. The control system of claim 6, wherein said arcuate cord troughs extend onto said first containment tab and terminate at one end at small rings at a distal end of said first containment tab.

8. The control system of claim 6, wherein said first and second containment tabs also together define a third containment channel.

9. The control system of claim 8, wherein said third containment channel includes a large ring at a distal end of said first containment tab.

10. The control system of claim 1, wherein said shell includes a horizontal web having a leading edge, and wherein said leading edge of said horizontal web includes a cutout.

11. The control system of claim 10, wherein said shell further comprises a vertical support web that connects said horizontal web to an inside top of said shell.

12. The control system of claim 1, wherein said shell further comprises an interchangeable pivot shaft support formed on an exterior surface of said shell.

13. The control system of claim 1, wherein said plurality of vertically-suspended vanes includes a fixed end vane, and wherein said primary end cap further comprises an interchangeable pivot shaft support formed on an exterior surface of said shell and adapted to pivotally support said fixed end vane.

14. The control system of claim 1, wherein said main body further comprises a bearing socket adapted to rotatably support a rotating member.

15. A control system for a vertical blind that includes a plurality of vertically-suspended vanes, said control system comprising an elongated headrail, said vanes adapted to be longitudinally spaced along said elongated headrail; and a secondary end cap comprising a main body defining a horizontally-disposed cylindrical support adapted to rotatably support a rotating member;

a pulley pocket disposed below said cylindrical support and adapted to rotatably support an idler pulley mounted on a mounting pin having an upper part and a lower part, said pulley pocket having an upper wall adapted to retain said upper part of said mounting pin and a lower wall adapted to retain said lower part of said mounting pin; and a pair of passages adapted to accommodate screw-type fasteners that attach said main body to the headrail.

16. The control system of claim 15, further comprising a cover plate attached to said main body and covering said pair of passages.

17. The control system of claim 16, wherein said cover plate has two cylindrical members formed on an inner surface of said cover plate.

18. The control system of claim 15 further comprising a shell slidingly engaged with and covering said main body.

19. The control system of claim 18, wherein said main body further comprises an upper mounting pin slot and a lower mounting pin slot.

20. The control system of claim 19, wherein each of said upper and lower mounting pin slots further comprises a pair of detents adapted to snappingly retain a mounting pin for said idler pulley in said upper and lower mounting in slots.

21. A control system for a vertical blind that includes a plurality of vertically suspended vanes, each vane having a longitudinal axis, said control system comprising an elongated headrail, said vanes adapted to be longitudinally spaced along said headrail;

a plurality of carriers operatively associated with said headrail, wherein one vane is adapted to be operatively associated with each said carrier; and a control means for selectively pivoting said vanes about pivot axes parallel to said longitudinal axes between an opened angular position and a closed angular position, wherein said control means comprises an elongated tilt rod extending lengthwise of said headrail, said tilt rod being mounted for rotation about a longitudinal axis;

a worm gear operatively connected with said tilt rod for rotation therewith;

a transition gear operatively connected with said worm gear for rotation therewith;

an idler gear operatively corrected with said transition gear for rotation therewith; and a hanger pin gear operatively connected with said idler gear.

22. The control system of claim 21, wherein said plurality of vanes includes a fixed end vane, said control system further including a face sheet of material interconnecting said vanes such that movement of said vanes associated with said carriers effects pivotal movement of said fixed end vane.

23. The control system of claim 22, further including a free end vane adapted to be positioned at a secondary end cap when said carriers are in said extended position and a mounting block movable with said carriers supporting said free end vane, said mounting block including a pivot arm adapted to extend around said secondary end cap to position said free end vane in longitudinal alignment with said headrail when the carriers are in said extended position.

24. The system of claim 21 wherein said headrail is made of panted aluminum and said carriers are made of Celcon®.

25. The system of claim 21, wherein said first control means further comprises a linkage that interconnects said carriers and establishes a maximum spacing between adjacent carriers.

26. The system of claim 25 wherein said linkage is a scissors-type linkage.

27. A control system for a vertical blind that includes a plurality of vertically-suspended vanes, each vane having a longitudinal axis, said control system comprising an elongated headrail having a primary end cap, said vanes being longitudinally spaced along said headrail;

a plurality of carriers, said carriers being operatively associated with said headrail, wherein one vane of said plurality of vanes is adapted to be suspended by and operatively associated with each said carrier; and a vane-orientation system to selectively pivot said vanes about pivot axes parallel to said vane longitudinal ayes between an opened angular position and a closed angular position, wherein said vane-orientation system comprises a tilt rod having a longitudinal axis, said tilt rod mounted in said headrail for selective rotation about its longitudinal axis;

a vane drive system operatively connected to said tilt rod such that selective rotation of said tilt rod is adapted to effect pivotal movement of said plurality of vanes about their said longitudinal axes; and a tilt rod drive system operatively connected to an end of said tilt rod to selectively rotate said tilt rod, wherein said tilt rod drive system is housed at least partially within said primary end cap and comprises a tilt wand drive gear having a first bevel gear and a depending drive shaft interconnected with said first bevel gear;

a tilt rod drive gear having a second bevel gear meshing with said first bevel gear; and a cylindrical drive collar interconnected with said second bevel gear, wherein rotation of said tilt rod drive gear rotates said tilt rod.

28. The control system of claim 27, wherein said tilt rod drive system further comprises a tilt wand disposed at one end of said headrail and operatively connected to said depending drive shaft, such that selective rotation of said tilt wand rotates said depending drive shaft to effect corresponding pivotal movement of said plurality of vanes about their said longitudinal axes.

29. The control system of claim 27, wherein said tilt rod includes a longitudinal groove that interconnects said tilt rod with said tilt rod drive system, and wherein said cylindrical drive collar has an inner surface with a longitudinal drive ridge extending radially inwardly therefrom, said drive ridge riding in said longitudinal groove of said tilt rod.

30. The control system of claim 27, wherein, at a lowest distal end of said depending drive shaft is a first transverse connection opening for removably affixing said tilt wand to said tilt wand drive gear.

31. The control system of claim 30, wherein, at an upper distal end of said tilt wand is second transverse connection opening, and further wherein a connector removably affixes said tilt wand to said tilt wand drive gear via said first and second transverse connection openings.

32. The control system of claim 27, wherein said primary end cap comprises a main body and a shell slidingly engaged with and covering said main body.

33. The control system of claim 32, wherein said main body of said primary end cap further comprises a first containment tab, and said shell further comprises a second containment tab, said first and second containment tabs together defining a containment channel that rotatably supports said depending drive shaft of said tilt wand drive gear.

34. The control system of claim 33, wherein said containment channel includes a large ring at a distal end of said first containment tab, and wherein said large ring encircles a portion of said depending drive shaft of said tilt wand drive gear.

35. The control system of claim 33, wherein said main body of said primary end cap further comprises a bearing socket that rotatably supports said cylindrical drive collar of said tilt wand drive gear.

36. The control system of claim 35, wherein said cylindrical drive collar of said tilt rod drive gear further comprises a bearing ring that rides against a longitudinal end of said bearing socket.

37. The control system of claim 32, wherein said tilt wand drive gear includes an upper bearing sleeve, and wherein said shell includes a horizontal web having a leading edge, and wherein said leading edge of said horizontal web includes a cutout, and wherein said cutout on said leading edge of said horizontal web rotatably and pressingly support said upper bearing sleeve of said tilt wand drive gear.

38. The control system of claim 37, wherein said shell further comprises a vertical support web that connects said horizontal web to an inside top of said shell, thereby providing support to said horizontal web.

39. The control system of claim 32, wherein said shell further comprises an interchangeable pivot shaft support formed on an exterior surface of said shell.

40. The control system of claim 27, wherein said tilt rod includes a longitudinal orientation groove, wherein each said carrier of said plurality of carriers includes a cylindrical passage, and wherein said vane drive system further comprises a plurality of worm gears, each worm gear in cooperative engagement with said tilt rod for rotation therewith and rotatably mounted in one of said carrier cylindrical passages, each said worm gear having an inside surface with a longitudinal drive ridge formed thereon, said tilt rod inserted through said worn gears such that said longitudinal drive ridges of said worm gears ride in said longitudinal orientation groove in said tilt rod.

41. The control system of claim 40, wherein each said carrier further comprises extended worm gear loading ramps, each said worm gear being inserted into a respective carrier by pressing longitudinal ends of said worm gear against said worm gear loading ramps until said worm gear snaps into said cylindrical passage of said respective carrier.

42. The control system of claim 27, wherein said vane drive system further comprises a plurality of worm gears, each worm gear in cooperative engagement with said tilt rod for rotation therewith and rotatably mounted in one of said carriers.

43. The control system of claim 42, wherein said tilt rod includes a longitudinal orientation groove, wherein each said worm gear has an inner surface with a longitudinal drive ridge extending radially inwardly therefrom, and wherein each worm gear is slid onto said tilt rod with said drive ridge riding in said longitudinal groove of said tilt rod thereby interconnecting said tilt rod with said vane drive system.

44. A control system for a vertical blind that includes a plurality of vertically-suspended vanes, each vane having a longitudinal axis, said control system comprising an elongated headrail having a primary end cap and a secondary end cap, said vanes being adapted to longitudinally move along said headrail between an extended position and a retracted position;

a plurality of carriers, said carriers being operatively associated with and longitudinally, slideably movable along said headrail, wherein one vane of said plurality of vanes is adapted to be suspended by and operatively associated with each said carrier;

a plurality of hanger pins, one for each carrier of said plurality of carriers, each said hanger pin further comprising a boot-shaped web member having a U-shaped cutout in it; and a vane-retention pin extending adjacent to said U-shaped cutout, said vane-retention pin having an enlarged head that projects partly into said U-shaped cutout and that has an upper surface adapted to support a vane from said plurality of vanes; and a vane-retraction system to selectively move said vanes between said extended position and said retracted position; and a vane-orientation system to selectively pivot said vanes about pivot axes parallel to said vane longitudinal axes between an opened angular position and a closed angular position, wherein said vane-orientation system further comprises a tilt rod having a longitudinal axis, said tilt rod mounted in said headrail for selective rotation about its longitudinal axis;

a tilt rod drive system operatively connected to an end of said tilt rod to selectively rotate said tilt rod; and a vane drive system operatively connected to said tilt rod such that selective rotation of said tilt rod is adapted to effect pivotal movement of said plurality of vanes about their said longitudinal axes.

45. The control system of claim 44, wherein each of said plurality of vanes includes a reinforcing tab along a vane upper edge, said reinforcing tab being adapted to be mounted to said vane-retention pin.

46. The control system of claim 45, wherein each of said reinforcing tabs has an opening therethrough, and wherein each of said vane-retention pins is adapted to support one of said plurality of vanes by said opening in said reinforcing tab.

47. The control system of claim 44, wherein said boot-shaped web member further comprises a distal end with a thickened toe adapted to ride on a vane upper edge;

a pair of guide bumps formed on one side of said boot-shaped web member along lower side edges of said U-shaped cutout.

48. The control system of claim 47, wherein said thickened toe defines an abutment surface adapted to ride against said vane upper edge.

49. The control system of claim 47, wherein each of said plurality of vanes has a first vertical centerline parallel to said vane longitudinal axes, and wherein each of said plurality of hanger pins has a second vertical centerline, and further wherein said first vertical centerline does not overlap said second vertical centerline, thereby producing a rotative force adapted to drive said vane upper edges against said abutment surfaces.

50. The control system of claim 47, wherein each said hanger pin further comprises a bumper nub formed on said distal end of said boot-shaped web adjacent to said thickened toe.

51. A control system for a vertical blind that includes a plurality of vertically-suspended vanes, each vane having a longitudinal axis, said control system comprising an elongated headrail having a primary end cap and a secondary end cap, said vanes being adapted to longitudinally move along said headrail between an extended position and a retracted position;

a plurality of carriers, said carriers being operatively associated with and longitudinally, slideably movable along said headrail, wherein one vane of said plurality of vanes is adapted to be suspended by and operatively associated with each said carrier;

a plurality of hanger pins, one for each carrier of said plurality of carriers;

a vane-retraction system to selectively move said vanes between said extended position and said retracted position; and a vane-orientation system to selectively pivot said vanes about pivot axes parallel to said vane longitudinal axes between an opened angular position and a closed angular position, wherein said vane-orientation system further comprises a tilt rod having a longitudinal axis, said tilt rod mounted in said headrail for selective rotation about its longitudinal axis;

a tilt rod drive system operatively connected to an end of said tilt rod to selectively rotate said tilt rod; and a vane drive system operatively connected to said tilt rod such that selective rotation of said tilt rod is adapted to effect pivotal movement of said plurality of vanes about their said longitudinal axes, wherein said vane drive system further comprises, for each carrier of said plurality of carriers, a worm gear mounted in said carrier and operatively connected with said tilt rod for rotation therewith;

a transition gear mounted in said carrier and operatively connected with said worm gear for rotation therewith;

an idler gear mounted in said carrier and operatively connected with said transition gear for rotation therewith; and a driven hanger pin gear comprising part of said hanger pin, said hanger pin gear being mounted in said carrier and operatively connected with said idler gear for rotation therewith.

52. The control system of claim 51, wherein said transition gear further comprises an alignment marker.

53. The control system of claim 51, wherein said worm gear includes an internal, longitudinal drive ridge that keys said worm gear to said tilt rod for rotation therewith; wherein said transition gear includes a plurality of vertically-oriented, longitudinally-extending teeth and a plurality of radially-extending teeth, said longitudinally-extending teeth being engaged with said worm gear for rotation therewith, and said radially-extending teeth being engaged with said idler gear; and wherein said idler gear engages said driven hanger pin gear for rotation of said hanger pin.

54. The control system of claim 53, wherein said longitudinally-extending teeth of said transition gear are offset slightly from the vertical to reduce friction between said worm gear and said transition gear.

55. The control system of claim 53, wherein said transition gear is rotatably mounted on an upper mounting pin comprising part of said carrier, wherein said upper mounting pin is rotatably accommodated in a hole in a top of said transition gear, said idler gear is rotatably mounted on a transfer gear mounting pin comprising part of said carrier; and said hanger pin is rotatably supported by said carrier.

56. The control system of claim 55, wherein said upper mounting pin of said carrier is a frusto-conical-shaped extended post, and further wherein said hole in said top of said transition gear is a corresponding frusto-conical-shaped hole that accommodates said extended post.

57. The control system of claim 55, wherein said vane-orientation system further comprising a transition gear retainer having a lower mounting pin, wherein said lower mounting pin is rotatably accommodated in a hole in a bottom of said transition gear, and wherein said transition gear retainer is mounted on said carrier.

58. The control system of claim 57, wherein said transition gear retainer further comprises two retention nubs, said retention nubs being snappingly accommodated in a pair of corresponding nub ports in said carrier.

59. The control system of claim 55, wherein said hanger pin further comprises an upper cylindrical bearing and a cylindrical body, said upper cylindrical bearing being rotatably mounted in a bearing port formed in a top wall of said carrier, and said cylindrical body being rotatably supported by a U-shaped hanger pin support comprising part of said carrier.

60. The control system of claim 55, wherein said idler gear further comprises a disc-shaped underplate, and said horizontally-extending teeth of said transition gear ride above said disc-shaped underplate, thereby preventing said idler gear from dislodging from said transfer gear mounting pin.

61. The control system of claim 55, wherein said driven hanger pin gear further comprises a radial abutment finger adapted to define angular limits that said plurality of vanes may be rotated.

62. The control system of claim 61, wherein said carrier further comprises a J-shaped channel, a first limit stop, and a second limit stop, and wherein said radial abutment finger rides in said J-shaped channel between said first and second limit stops.

63. The control system of claim 62, wherein when said plurality of vanes are oriented in a first closed position, said radial abutment finger impacts said first limit stop, thereby being adapted to prevent further rotation of said plurality of vanes in a first direction, and when said plurality of vanes are oriented in a second closed position, said radial abutment finger impacts said second limit stop, thereby being adapted to prevent further rotation of said plurality of vanes in a second direction.

64. The control system of claim 63, wherein said plurality of vanes are adapted to rotate approximately 180° between said first and second closed positions.

65. The control system of claim 51, wherein said headrail includes a generally U-shaped trough-like member opening upwardly so as to define an open top side, a bottom wall, an inner upstanding leg, and an outer upstanding leg.

66. The control system of claim 65, wherein said outer upstanding leg has an upper end with an enlarged head having an upwardly-opening groove and an inwardly-directed ledge, wherein each of said carriers has a C-shaped channel formed wherein, and said inwardly-directed ledge rides in said C-shaped channel.

67. The control system of claim 66, wherein said C-shaped channel further comprises an upper sliding ridge and a lower sliding ridge, said upper and lower sliding ridges riding on opposite sides of said inwardly-directed ledge.

68. The control system of claim 65, wherein said headrail further comprises an internal groove formed along a surface of said inner upstanding leg closest to a center of said headrail, and further wherein a slip ridge is formed along a lower surface of said internal groove, and wherein each of said carriers further comprises an alignment tab that rides on said slip ridge during movement of said carriers longitudinally of said headrail.

69. The control system of claim 68, wherein each of said carriers further comprises a lower wall with said alignment tab extending therefrom.

70. The control system of claim 69, wherein said headrail is made of painted aluminum and said carriers are made of Celcon®.

71. The control system of claim 65, wherein a minority of each of said plurality of carriers is disposed within said generally U-shaped trough-like member of said headrail.

72. The control system of claim 71, wherein said plurality of carriers are interconnected by linkage which establishes a maximum spacing between adjacent carriers.

73. The control system of claim 72, wherein said linkage is mounted to and interconnected with said carriers on a top of said carriers and externally of said headrail.

74. The control system of claim 72, wherein said linkage is a scissors-type linkage.

75. The control system of claim 72, wherein each of said plurality of carriers includes a hanger system adapted to suspend an associated one of said plurality of vanes, and wherein said headrail has a longitudinal centerline and said hanger systems are offset from said headrail centerline.

76. A control system for a vertical blind that includes a plurality of vertically-suspended vanes, each vane having a longitudinal axis, said control system comprising an elongated headrail, said plurality of vanes being adapted to longitudinally move along said headrail between an extended position and a retracted position;

a plurality of carriers, said carriers being operatively associated with and longitudinally, slideably movable along said headrail, wherein one vane of said plurality of vanes is adapted to be suspended by and operatively associated with each said carrier; and a vane-retraction system to selectively move said vanes between said extended position and said retracted position, said vane-retraction system comprising a primary end cap attached to said headrail, wherein said primary end cap comprises a main body that includes a pair of integrally-formed arcuate cord troughs that cradle a traverse cord adapted to selectively retract and extend said plurality of vanes, wherein said arcuate cord troughs are curved to guide said traverse cord into a longitudinal direction of said elongated headrail.

77. The control system of claim 76, wherein said primary end cap further comprises a shell slidingly engaged with and covering said main body.

78. The control system of claim 77, wherein said main body further comprises a pair of shell alignment shelves, and said shell further comprises a pair of shell alignment channels, said shell alignment channels slidingly engaging said shell alignment shelves.

79. The control system of claim 77, wherein said main body further comprises a first containment tab, and said shell further comprises a second containment tab, said first and second containment tabs together defining first and second containment channels that slippingly retain said traverse cord.

80. The control system of claim 76, wherein said main body of said primary end cap further comprises a headrail pocket adapted to frictionally receive an end of said headrail.

81. The control system of claim 80, wherein said main body further comprises two traverse cord passages extending through a lower portion of said main body, each said traverse cord passage having a first end opening into said headrail pocket and a second end opening onto one of said arcuate cord troughs.

82. The control system of claim 81, wherein each said carrier further comprises a centrally-located upstanding cylindrical pin, and wherein said carriers are longitudinally distributed along said headrail by interconnected links attached to said centrally-located upstanding cylindrical pins.

83. The control system of claim 82, wherein said centrally-located upstanding cylindrical pins have enlarged frusto-conical heads, and wherein said interconnected links snap over said enlarged frusto-conical heads.

84. The control system of claim 81, wherein said vane-retraction system further comprises a linkage interconnecting said carriers, said linkage being adapted to stack said plurality of vanes adjacent to at least one side of an architectural opening when said vertical blind is retracted and being adapted to uniformly space said plurality of vanes across the architectural opening when said vertical blind is extended.

85. The control system of claim 84, wherein said linkage is a scissor-type linkage.

86. The control system of claim 81, wherein said vane-retraction system further comprises a secondary end cap attached to said headrail, and wherein said traverse cord is routed along one arcuate cord trough, through one traverse cord passage, longitudinally along said headrail to said secondary end cap, around a first idler pulley rotatably mounted in said secondary end cap by a mounting pin, then back longitudinally along said headrail, through said other traverse cord passage, down said other arcuate cord trough, around a second idler pulley, and back to its starting point.

87. The control system of claim 86, wherein said second idler pulley is mounted in a tilt wand operatively connected at an end of said headrail adjacent to said primary end cap.

88. The control system of claim 76, wherein said plurality of carriers includes at least one lead carriers and a plurality of follower carriers, said lead carrier being connected to said traverse cord and moveable by said traverse cord longitudinally of said headrail, wherein movement of said lead carrier causes said follower carriers to move therewith.

89. The control system of claim 88, wherein said plurality of vanes includes a free end vane, and further wherein a face sheet of material is adapted to connect said plurality of vanes, and wherein, when said plurality of vanes are rotated, said free end vane pivots under the influence of said face sheet of material.

90. The control system of claim 89, wherein a mounting block is attached to said at least one lead carrier, said mounting block comprising a C-shaped channel that supports a spring-loaded pivot arm to which said free end vane is attached.

91. The control system of claim 90, wherein snap fingers extend from one side of said mounting block and into a substantially horizontal channel through said at least one lead carrier to removably secure said mounting block to said at least one lead carrier.

92. The control system of claim 90, wherein said spring-loaded pivot arm comprises a base leg and an end leg, wherein said base leg has a distal end forming a hollow pivot shaft that mounts in said C-shaped channel, and wherein said end leg has a distal end with an affixment pin mounted thereto, said free end vane being attached to said affixment pin.

93. The control system of claim 92, wherein said vane-retraction system further comprises a secondary end cap attached to said headrail, and wherein said pivot arm extends around said secondary end cap to position said free end vane in longitudinal alignment with said headrail when said plurality of carriers are in said extended position.

94. The control system of claim 93, wherein said pivot arm and free end vane are positioned laterally adjacent said headrail when said plurality of carriers are in said retracted position.

95. The control system of claim 94, said pivot arm has a guide surface, said guide surface being biased against said headrail in sliding engagement therewith.

96. The control system of claim 95, wherein said secondary end cap has an end surface in longitudinal alignment with said headrail, and wherein said guide surface engages said end surface when said plurality of carriers are fully extended.

97. The control system of claim 96, wherein said headrail has a lateral side surface against which said guide surface is engaged when said carriers are in said retracted position, and wherein said guide surface moves against the bias of said pivot arm when said plurality of carriers are moved from said extended position to said retracted position.

98. The control system of claim 89, wherein said plurality of vanes include a fixed end vane, and further wherein said fixed end vane is adapted to pivot under the influence of said face sheet of material to cover said primary end cap.

99. The control system of claim 88, wherein said vane-retraction system further comprises a secondary end cap attached to said headrail, and wherein said traverse cord is routed around an idler pulley rotatably mounted in said secondary end cap by a mounting pin.

100. The control system of claim 88, wherein said vane-retraction system further comprises a secondary end cap attached to said headrail, and wherein said secondary end cap comprises a main body defining a pulley pocket, and wherein an idler pulley is rotatably mounted in said pulley pocket by a mounting pin.

101. The control system of claim 100, wherein said main body further comprises an upper mounting pin slot and a lower mounting pin slot.

102. The control system of claim 101, wherein each of said upper and lower mounting pin slots further comprises a pair of detents that snappingly retain said mounting pin in said upper and lower mounting pin slots.

103. The control system of claim 100, wherein said mounting pin has upper part and a lower part, and said second main body has an upper mounting pin slot and a lower mounting pin slot, wherein said mounting pin passes through said idler pulley, and further wherein said upper part of said mounting pin is retained in said upper mounting pin slot and said lower part of said mounting pin is retained in said lower mounting pin slot.

104. The control system of claim 103, wherein each of said upper and lower mounting pin slots further comprises a pair of detents, and wherein said mounting pin is snappingly retained in said upper and lower mounting pin slots by said pairs of detents.

105. The control system of claim 88, wherein said vane-retraction system further comprises a secondary end cap attached to said headrail, and wherein said secondary end cap further comprises a second main body and a shell slidingly engaged with and covering said second main body, wherein an idler pulley is rotatably mounted to said second main body by a mounting pin, and said traverse cord is positioned on said idler pulley.

106. The control system of claim 88, wherein said blind is a duel-draw blind, and wherein said at least one lead carrier comprises a first lead carrier and a second lead carrier, said first and second lead carriers being connected to said traverse cord for movement with said traverse cord longitudinally of said headrail, said first and second lead carriers moving in respective opposite direction, wherein movement of said first and second lead carriers causes said follower carriers to move accordingly, and wherein a first mounting block is attached to said first lead carrier, and a second mounting block is attached to said second lead carrier, and further wherein said first mounting block comprises a first cord passage and a second cord passage, and wherein said second mounting block comprises a third cord passage and a fourth cord passage.

107. The control system of claim 106, wherein first snap fingers extend from one side of said first mounting block and into a substantially horizontal channel through said first lead carrier to removably secure said first mounting block to said first lead carrier, and wherein second snap fingers extend from one side of said second mounting block and into a substantially horizontal channel through said second lead carrier to removably secure said second mounting block to said second lead carrier.

108. The control system of claim 106, wherein a dividing wall is present between said third cord passage and said fourth cord passage, and wherein a cord tray is formed along an upper edge of said dividing wall.

109. The control system of claim 108, wherein said vane-retraction system further comprises a secondary end cap attached to said headrail, and wherein said main body of said primary end cap further comprises two traverse cord passages extending through a lower portion of said main body, each said traverse cord passage having a first end opening into said headrail and a second end opening onto one of said arcuate cord troughs, wherein said traverse cord has a first end and a second end, and wherein, starting at said second end of said traverse cord, said traverse cord is routed downwardly through said second cord passage in said first mounting block, longitudinally along said headrail toward said secondary end cap, around a first idler pulley rotatably mounted in said secondary end cap, longitudinally along said headrail toward said primary end cap, upwardly through said fourth cord passage in said second mounting block, over said cord tray formed along said upper edge of said dividing wall, downwardly through said third cord passage, longitudinally along said headrail toward said primary end cap, through a first of said two traverse cord passages from its first end to its second end, along a first of said pair of arcuate cord troughs, around a second pulley rotatably mounted adjacent to said primary end cap, along a second of said pair of arcuate cord troughs, through a second of said two traverse cord passages from its second end to its first end, longitudinally along said headrail toward said secondary end cap, and upwardly though said first cord passage in said first mounting block.

* * * * *

UNITED STATES PATENT AND TRADEMARK OFFICE

CERTIFICATE OF CORRECTION

PATENT NO. : 6,491,085 B1
DATED : December 10, 2001
INVENTOR(S) : James M. Anthony et al.

It is certified that error appears in the above-identified patent and that said Letters Patent is hereby corrected as shown below:

Column 35,
Line 12, delete the second occurrence of “in” and insert -- pin --.
Line 51, delete “panted” and insert -- painted --.

Column 37,
Line 23, third to last line, delete “worn” and insert -- worm --.

Signed and Sealed this

Ninth Day of September, 2003

JAMES E. ROGAN
*Director of the United States Patent and Trademark Office*